US008743156B2

(12) United States Patent
Higashi et al.

(10) Patent No.: US 8,743,156 B2
(45) Date of Patent: Jun. 3, 2014

(54) DRIVING METHOD FOR IMAGE DISPLAY APPARATUS WITH CORRECTION SIGNAL

(75) Inventors: Amane Higashi, Aichi (JP); Toshiyuki Nagatsuma, Kanagawa (JP); Akira Sakaigawa, Kanagawa (JP); Masaaki Kabe, Kanagawa (JP)

(73) Assignee: Japan Display West Inc., Aichi-Ken (JP)

( * ) Notice: Subject to any disclaimer, the term of this patent is extended or adjusted under 35 U.S.C. 154(b) by 339 days.

(21) Appl. No.: 13/137,343

(22) Filed: Aug. 8, 2011

(65) Prior Publication Data

US 2012/0050345 A1 Mar. 1, 2012

(30) Foreign Application Priority Data

Sep. 1, 2010 (JP) ..... 2010-195430

(51) Int. Cl.
*G09G 5/10* (2006.01)

(52) U.S. Cl.
USPC ..... 345/690

(58) Field of Classification Search
USPC ..... 345/690
See application file for complete search history.

(56) References Cited

U.S. PATENT DOCUMENTS

| | | | | |
|---|---|---|---|---|
| 7,277,075 | B1 | 10/2007 | Hirano et al. | |
| 2006/0262251 | A1 | 11/2006 | Kim et al. | |
| 2007/0064162 | A1 | 3/2007 | Yamamoto et al. | |
| 2009/0160747 | A1* | 6/2009 | Morisue et al. | 345/88 |
| 2009/0207182 | A1 | 8/2009 | Takada et al. | |
| 2009/0315921 | A1 | 12/2009 | Sakaigawa et al. | |
| 2009/0322802 | A1 | 12/2009 | Noguchi et al. | |
| 2011/0181633 | A1* | 7/2011 | Higashi et al. | 345/691 |
| 2011/0181634 | A1* | 7/2011 | Higashi et al. | 345/691 |
| 2011/0181635 | A1* | 7/2011 | Kabe et al. | 345/694 |
| 2012/0013649 | A1 | 1/2012 | Higashi et al. | |
| 2012/0249404 | A1* | 10/2012 | Sakaigawa et al. | 345/88 |

FOREIGN PATENT DOCUMENTS

| | | |
|---|---|---|
| JP | 04-130395 | 5/1992 |
| JP | 2001-147666 | 5/2001 |
| JP | 2007-010753 A | 1/2007 |
| JP | 2009-192887 A | 8/2009 |
| JP | 2010-033009 A | 2/2010 |
| JP | 2010-033014 A | 2/2010 |
| JP | 2012-022217 A | 2/2012 |
| WO | WO-2004/086128 | 10/2004 |

OTHER PUBLICATIONS

Japanese Office Action issued Jul. 20, 2013 for corresponding Japanese Application No. 2010-195430.

* cited by examiner

*Primary Examiner* — William Boddie
*Assistant Examiner* — Andrew Schnirel
(74) *Attorney, Agent, or Firm* — Rader, Fishman & Grauer PLLC

(57) ABSTRACT

A driving method for an image display apparatus is disclosed. The image display apparatus includes an image display panel including a plurality of pixels each including first, second, third and fourth subpixels and arrayed in a two-dimensional matrix. A signal processing section determines an expansion coefficient based on a saturation value and a maximum value of brightness in an HSV color space expanded by addition of a fourth color to three primary colors. First to third correction signal values and a fourth correction signal value are determined based on the expansion coefficient, first to third subpixel input signals and first to third constants. A fourth subpixel output signal is determined from the fourth correction signal value and a fifth correction signal value determined from the expansion coefficient and the first to third subpixel input signals and output to the fourth subpixel.

14 Claims, 24 Drawing Sheets

DRIVING METHOD FOR IMAGE DISPLAY APPARATUS WITH CORRECTION SIGNAL

BACKGROUND

This disclosure relates to a driving method for an image display apparatus.

In recent years, an image display apparatus such as, for example, a color liquid crystal display apparatus has a problem in increase of the power consumption involved in enhancement of performances. Particularly as enhancement in definition, increase of the color reproduction range and increase in luminance advance, for example, in a color liquid crystal display apparatus, the power consumption of a backlight increases. Attention is paid to an apparatus which solves the problem just described. The apparatus has a four-subpixel configuration which includes, in addition to three subpixels including a red displaying subpixel for displaying red, a green displaying subpixel for displaying green and a blue displaying subpixel for displaying blue, for example, a white displaying subpixel for displaying white. The white displaying subpixel enhances the brightness. Since the four-subpixel configuration can achieve a high luminance with power consumption similar to that of existing display apparatus, if the luminance is equal to that of existing display apparatus, then it is possible to decrease the power consumption of the backlight and improvement of the display quality can be anticipated.

For example, a color image display apparatus disclosed in Japanese Patent No. 3167026 (hereinafter referred to as Patent Document 1) includes:

means for producing three different color signals from an input signal using an additive primary color process; and means for adding the color signals of the three hues at equal ratios to produce an auxiliary signal and supplying totaling four display signals including the auxiliary signal and three different color signals obtained by subtracting the auxiliary signal from the signals of the three hues to a display unit. It is to be noted that a red displaying subpixel, a green displaying subpixel and a blue displaying subpixel are driven by the three different color signals while a white displaying subpixel is driven by the auxiliary signal.

Meanwhile, Japanese Patent No. 3805150 (hereinafter referred to as Patent Document 2) discloses a liquid crystal display apparatus which includes a liquid crystal panel wherein a red outputting subpixel, a green outputting subpixel, a blue outputting subpixel and a luminance subpixel form one main pixel unit so that color display can be carried out, including:

calculation means for calculating, using digital values Ri, Gi and Bi of a red inputting subpixel, a green inputting subpixel and a blue inputting subpixel obtained from an input image signal, a digital value W for driving the luminance subpixel and digital values Ro, Go and Bo for driving the red outputting subpixel, green outputting subpixel and blue outputting subpixel;

the calculation means calculating such values of the digital values Ro, Go and Bo as well as W which satisfy a relationship of $$Ri:Gi:Bi=(Ro+W):(Go+W):(Bo+W)$$

and with which enhancement of the luminance from that of the configuration which includes only the red inputting subpixel, green inputting subpixel and blue inputting subpixel is achieved by the addition of the luminance subpixel.

Further, PCT/KR 2004/000659 (hereinafter referred to as Patent Document 3) discloses a liquid crystal display apparatus which includes first pixels each configured from a red displaying subpixel, a green displaying subpixel and a blue displaying subpixel and second pixels each configured from a red displaying subpixel, a green displaying subpixel and a white displaying subpixel and wherein the first and second pixels are arrayed alternately in a first direction and the first and second pixels are arrayed alternately also in a second direction. The Patent Document 3 further discloses a liquid crystal display apparatus wherein the first and second pixels are arrayed alternately in the first direction while, in the second direction, the first pixels are arrayed adjacent each other and besides the second pixels are arrayed adjacent each other.

SUMMARY

Incidentally, in the apparatus disclosed in Patent Document 1 and Patent Document 2, although the luminance of the white displaying subpixel increases, the luminance of the red displaying subpixel, green displaying subpixel or blue displaying subpixel does not increase. Usually, a color filter is not disposed for the white displaying subpixel. Accordingly, the color of emitted light of the white displaying subpixel becomes the color of emitted light of a planar light source apparatus. Therefore, the image display apparatus is influenced significantly by the color of emitted light of the planar light source apparatus, and there is the possibility that a color shift may occur with the image display apparatus. Or, a liquid crystal display apparatus has a tendency that, if the gradation becomes low, that the color purity degrades. Therefore, if the same luminance can be maintained, then it is preferable to lower the luminance of the white displaying subpixel as far as possible while the luminance of the red displaying subpixel, green displaying subpixel or blue displaying subpixel is increased.

In the apparatus disclosed in Patent Document 3, the second pixel includes a white displaying subpixel in place of the blue displaying subpixel. Further, an output signal to the white displaying subpixel is an output signal to a blue displaying subpixel assumed to exist before the replacement with the white displaying subpixel. Therefore, optimization of output signals to the blue displaying subpixel which composes the first pixel and the white displaying subpixel which composes the second pixel is not achieved. Further, since variation in color or variation in luminance occurs, there is a problem also in that the picture quality is deteriorated significantly.

Therefore, it is desirable to provide a driving method for an image display apparatus which is less likely to be influenced by the color of emitted light of a planar light source apparatus or suffer from a color shift and besides can achieve optimization of output signals to individual subpixels and can achieve increase of the luminance with certainty.

According a first embodiment of the disclosed technology, there is provided a driving method for an image display apparatus which includes:

(A) an image display panel wherein a plurality of pixels each including a first subpixel for displaying a first primary color, a second subpixel for displaying a second primary color, a third subpixel for displaying a third primary color and a fourth subpixel for displaying a fourth color are arrayed in a two-dimensional matrix; and (B) a signal processing section.

The signal processing section is capable of:

determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal at least based on a third subpixel input signal and the expansion coefficient $\alpha_0$ and outputting the third subpixel output signal to the third subpixel.

The driving method is carried out by the signal processing section and includes:

(a) determining a maximum value $V_{max}(S)$ of brightness taking a saturation S in an HSV color space enlarged by adding the fourth color as a variable;

(b) determining the saturation S and the brightness V(S) of a plurality of pixels based on subpixel input signal values to the plural pixels; and (c) determining the expansion coefficient $\alpha_0$ based on at least one of values of $V_{max}(S)/V(S)$ determined with regard to the plural pixels.

The driving method further includes:

(d) for each of the pixels, determining a first correction signal value based on the expansion coefficient $\alpha_0$, the first subpixel input signal and a first constant;

determining a second correction signal value based on the expansion coefficient $\alpha_0$, the second subpixel input signal and a second constant;

determining a third correction signal value based on the expansion coefficient $\alpha_0$, the third subpixel input signal and a third constant;

determining a correction signal value having a maximum value from among the first, second and third correction signal values as a fourth correction signal value; and determining a fifth correction signal value based on the expansion coefficient $\alpha_0$, first subpixel input signal, second subpixel input signal and third correction signal value; and (e) determining, for each of the pixels, a fourth subpixel output signal from the fourth and fifth correction signal values and outputting the determined signal to the fourth subpixel.

According to a second embodiment of the disclosed technology, there is provided a driving method for an image display apparatus which includes:

(A) an image display panel wherein totaling $P_0 \times Q_0$ pixels are arrayed in a two-dimensional matrix including $P_0$ pixels arrayed in a first direction and $Q_0$ pixels arrayed in a second direction; and (B) a signal processing section.

Each of the pixels includes a first subpixel for displaying a first primary color, a second subpixel for displaying a second primary color, a third subpixel for displaying a third primary color and a fourth subpixel for displaying a fourth color.

The signal processing section is capable of:

determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal at least based on a third subpixel input signal and the expansion coefficient $\alpha_0$ and outputting the third subpixel output signal to the third subpixel.

The driving method is carried out by the signal processing section and includes:

(a) determining a maximum value $V_{max}(S)$ of brightness taking a saturation S in an HSV color space enlarged by adding the fourth color as a variable;

(b) determining the saturation S and the brightness V(S) of a plurality of pixels based on subpixel input signal values to the plural pixels; and (c) determining the expansion coefficient $\alpha_0$ based on at least one of values of $V_{max}(S)/V(S)$ determined with regard to the plural pixels.

The driving method further includes:

(d) for a (p,q)th pixel where p=1, 2 . . . $P_0$ and q=1, 2 . . . , $Q_0$ when the pixels are counted along the second direction, determining a first correction signal value based on the expansion coefficient $\alpha_0$, a first subpixel input signal to the (p,q)th pixel, a first subpixel input signal to an adjacent pixel adjacent to the (p,q)th pixel along the second direction and a first constant;

determining a second correction signal value based on the expansion coefficient $\alpha_0$, a second subpixel input signal to the (p,q)th pixel, a second subpixel input signal to the adjacent pixel and a second constant;

determining a third correction signal value based on the expansion coefficient $\alpha_0$, a third subpixel input signal to the (p,q)th pixel, a third subpixel input signal to the adjacent pixel and a third constant;

determining a correction signal value having a maximum value from among the first, second and third correction signal values as a fourth correction signal value; and determining a fifth correction signal value based on the expansion coefficient $\alpha_0$, the first subpixel input signal, second subpixel input signal and third correction signal value to the (p,q)th pixel and the first subpixel input signal, second subpixel input signal and third correction signal value to the adjacent pixel; and (e) determining, for the (p,q)th pixel, a fourth subpixel output signal of the (p,q)th pixel from the fourth and fifth correction signal values and outputting the fourth subpixel output signal to the fourth subpixel in the (p,q)th pixel.

According to a third embodiment of the disclosed technology, there is provided a driving method for an image processing apparatus which includes:

(A) an image display panel wherein pixels each including a first subpixel for displaying a first primary color, a second subpixel for displaying a second primary color, and a third subpixel for displaying a third primary color are arrayed in first and second directions in a two-dimensional matrix such that each of a plurality of pixel groups is configured at least from a first pixel and a second pixel arrayed in the first direction, between which a fourth subpixel for displaying a fourth color is disposed; and (B) a signal processing section.

The signal processing section is capable of:

regarding the first pixel, determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal at least based on a third subpixel input signal and the expansion coefficient $\alpha_0$ and outputting the third subpixel output signal to the third subpixel; and regarding the second pixel, determining a first subpixel output signal at least based on a first subpixel input signal and the expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal at least based on a third subpixel input signal and the expansion coefficient $\alpha_0$ and outputting the third subpixel output signal to the third subpixel.

The driving method is carried out by the signal processing section and includes:

(a) determining a maximum value $V_{max}(S)$ of brightness taking a saturation S in an HSV color space enlarged by adding the fourth color as a variable;

(b) determining the saturation S and the brightness V(S) of a plurality of first pixels and second pixels based on subpixel input signal values to the plural first and second pixels; and (c) determining the expansion coefficient $\alpha_0$ based on at least one of values of $V_{max}(S)/V(S)$ determined with regard to the plural first and second pixels.

The driving method further includes:

(d) for each pixel group, determining a first correction signal value based on the expansion coefficient $\alpha_0$, the first subpixel input signals to the first and second pixels and a first constant;

determining a second correction signal value based on the expansion coefficient $\alpha_0$, the second subpixel input signals to the first and second pixels and a second constant;

determining a third correction signal value based on the expansion coefficient $\alpha_0$, the third subpixel input signals to the first and second pixels and a third constant;

determining a correction signal value having a maximum value from among the first, second and third correction signal values as a fourth correction signal value; and determining a fifth correction signal value based on the expansion coefficient $\alpha_0$, the first and second subpixel input signals and third correction signal value to the first pixel, and the first and second subpixel input signals and third correction signal value to the second pixel; and (e) determining, for each of the pixel groups, a fourth subpixel output signal from the fourth and fifth correction signal values and outputting the fourth subpixel output signal to the fourth subpixel.

According to a firth embodiment of the disclosed technology, there is provided a driving method for an image display apparatus which includes:

(A) an image display panel wherein totaling P×Q pixel groups are arrayed in a two-dimensional matrix including P pixel groups arrayed in a first direction and Q pixel groups arrayed in a second direction; and (B) a signal processing section.

Each of the pixel groups includes a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of:

regarding the first subpixel, determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal to a (p,q)th, where p=1, 2 . . . P and q=1, 2 . . . , Q, first pixel when the pixels are counted along the first direction at least based on a third subpixel input signal to the (p,q)th first pixel and a third subpixel input signal to a (p,q)th second pixel and outputting the third subpixel output signal to the third subpixel;

regarding the second pixel, determining a first subpixel output signal at least based on a first subpixel input signal and the expansion coefficient $\alpha_0$ and outputting the first subpixel output signal to the first subpixel; and determining a second subpixel output signal at least based on a second subpixel input signal and the expansion coefficient $\alpha_0$ and outputting the second subpixel output signal to the second subpixel.

The driving method is carried out by the signal processing section and includes:

(a) determining a maximum value $V_{max}(S)$ of brightness taking a saturation S in an HSV color space enlarged by adding the fourth color as a variable;

(b) determining the saturation S and the brightness V(S) of a plurality of first pixels and second pixels based on subpixel input signal values to the plural first and second pixels; and (c) determining the expansion coefficient $\alpha_0$ based on at least one of values of $V_{max}(S)/V(S)$ determined with regard to the plural first and second pixels.

The driving method further includes:

(d) for the (p,q)th pixel group, determining a first correction signal value based on the expansion coefficient $\alpha_0$, the first subpixel input signal to the second pixel, a first subpixel input signal to an adjacent pixel adjacent to the second pixel along the first direction and a first constant;

determining a second correction signal value based on the expansion coefficient $\alpha_0$, the second subpixel input signal to the second pixel, a second subpixel input signal to the adjacent pixel and a second constant; and determining a third correction signal value based on.the expansion coefficient $\alpha_0$, the third subpixel input signal to the second pixel, a third subpixel input signal to the adjacent pixel and a third constant;

determining a correction signal value having a maximum value from among the first, second and third correction signal values as a fourth correction signal value; and determining a fifth correction signal value based on the expansion coefficient $\alpha_0$, first, second and third subpixel input signals to the second pixel and first, second and third subpixel input signals to the adjacent pixel; and (e) determining, for the (p,q)th pixel group, a fourth subpixel output signal from the fourth and fifth correction signal values and outputting the fourth subpixel output signal to the fourth subpixel.

According to a fifth embodiment of the disclosed technology, there is provided a driving method for an image display apparatus which includes:

(A) an image display panel wherein totaling P×Q pixel groups are arrayed in a two-dimensional matrix including P pixel groups arrayed in a first direction and Q pixel groups arrayed in a second direction; and (B) a signal processing section.

Each of the pixel groups includes a first pixel and a second pixel along the first direction.

The first pixel includes a first subpixel for displaying a first primary color, a second subpixel for displaying a second primary color and a third subpixel for displaying a third primary color.

The second pixel includes a first subpixel for displaying the first primary color, a second subpixel for displaying the second primary color and a fourth subpixel for displaying a fourth color.

The signal processing section is capable of:

regarding the first pixel, determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal based on a third subpixel input signal to a (p,q)th, where p=1, 2, . . . , P and q=1, 2, . . . , Q, first pixel when the pixels are counted along the second direction and a third subpixel input signal to a (p,q)th second pixel and outputting the third subpixel output signal to the third subpixel;

regarding the second pixel, determining a first subpixel output signal at least based on a first subpixel input signal and the expansion coefficient $\alpha_0$ and outputting the first subpixel output signal to the first subpixel; and determining a second subpixel output signal at least based on a second subpixel input signal and the expansion coefficient $\alpha$ and outputting the second subpixel output signal to the second subpixel.

The driving method is carried out by the signal processing section and includes:

(a) determining a maximum value $V_{max}(S)$ of brightness taking a saturation S in an HSV color space enlarged by adding the fourth color as a variable;

(b) determining the saturation S and the brightness V(S) of a plurality of first pixels and second pixels based on subpixel input signal values to the plural first and second pixels; and (c) determining the expansion coefficient $\alpha_0$ based on at least one of values of $V_{max}(S)/V(S)$ determined regarding the plural first and second pixels.

The driving method further includes:

(d) for the (p,q)th pixel group, determining a first correction signal value based on the expansion coefficient $\alpha_0$, the first subpixel input signal to the second pixel, a first subpixel input signal to an adjacent pixel adjacent to the second pixel along the second direction and a first constant;

determining a second correction signal value based on the expansion coefficient $\alpha_0$, the second subpixel input signal to the second pixel, a second subpixel input signal to the adjacent pixel and a second constant;

determining a third correction signal value based on the expansion coefficient $\alpha_0$, the third subpixel input signal to the second pixel, a third subpixel input signal to the adjacent pixel and a third constant;

determining a correction signal value having a maximum value from among the first, second and third correction signal values as a fourth correction signal value; and determining a fifth correction signal value based on the expansion coefficient $\alpha_0$, first, second and third subpixel input signals to the first pixel, and first, second and third subpixel input signals to the adjacent pixel; and (e) determining, for the (p,q)th pixel group, a fourth subpixel output signal from the fourth and fifth correction signal values and outputting the fourth subpixel output signal to the fourth subpixel.

In the first to fifth embodiments, a correction signal value having a maximum value from among the first, second and third correction signal values is determined as a fourth correction signal value, and a fourth subpixel output signal is determined from the fourth and fifth correction signal values. Therefore, it is possible to suppress the luminance of the fourth subpixel as low as possible and increase the luminance of the first, second and third subpixels. As a result, the image display apparatus becomes less likely to be influenced by the color of emitted light from a planar light source apparatus and becomes less likely to suffer from color displacement. Further, occurrence of such a problem that, as the gradation becomes low, the color purity drops can be suppressed.

Further, in the driving methods according to the first to fifth embodiments, the color space, that is, the HSV color space, is expanded by addition of a fourth color, and the subpixel output signals are determined at least based on the subpixel input signals and the expansion coefficient $\alpha_0$. Since the output signal values are expanded based on the expansion coefficient $\alpha_0$ in this manner, not only it is possible to achieve optimization of the output signals to the subpixels but also the luminance of, for example, a red displaying subpixel, a green displaying subpixel and a blue displaying subpixel is increased. Therefore, increase of the luminance can be achieved with certainty, or it is possible to achieve reduction of power consumption of an entire image display apparatus assembly in which the image display apparatus is incorporated.

Meanwhile, in the driving method according to the first embodiment, increase of the luminance of the display image can be achieved, which is optimum to image display of, for example, a still picture, an advertizing medium, a standby display screen image of a portable telephone set and so forth. On the other hand, if the driving method according to the first embodiment is applied to a driving method for an image display apparatus assembly, then since the luminance of the planar light source apparatus can be reduced based on the expansion coefficient $\alpha_0$, reduction of power consumption of the planar light source apparatus can be achieved.

Meanwhile, in the driving method according to the second embodiment, the fourth subpixel output signal to the (p,q)th pixel is determined based on the subpixel input signals to the (p,q)th pixel and subpixel input signals to an adjacent pixel which is positioned adjacent the (p,q)th pixel in the second direction. In other words, the fourth subpixel output signal to a certain pixel is determined based also on input signals to the adjacent pixel adjacent the certain pixel, and therefore, optimization of the output signal to the fourth subpixel can be anticipated. Further, the fourth subpixel is provided. As a result, increase of the luminance can be achieved with certainly, and enhancement of the display quality can be anticipated.

Meanwhile, in the driving methods according to the third and fourth embodiments, the signal processing section determines and outputs the fourth subpixel output signal from the first subpixel input signals, second subpixel input signals and third subpixel input signals to the first and second pixels of each pixel group. In other words, the fourth subpixel output signal is determined based on the input signals to the first and second pixels which are positioned adjacent each other, and therefore, optimization of the output signal to the fourth subpixel can be achieved. Besides, in the driving methods according to the third and fourth embodiments, since one fourth subpixel is disposed for each pixel group configured at least from a first pixel and a second pixel, reduction of the area of the opening region for the subpixels can be suppressed. As a result, increase of the luminance can be achieved with certainty and enhancement of the display quality can be achieved. Further, it is possible to lower the power consumption of the backlight.

On the other hand, in the driving method according to the fifth embodiment, the fourth subpixel output signal to the (p,q)th second pixel is determined based on the subpixel input signals to the (p,q)th second signal and the subpixel input signals to an adjacent pixel which is positioned adjacent the second pixel along the second direction. In other words, the fourth subpixel output signal to the second pixel which configures a certain pixel group is determined based not only on the input signals to the second pixel which configure the certain pixel group but also on the input signals to an adjacent pixel which is positioned adjacent the second pixel. Therefore, optimization of the output signal to the fourth subpixel is achieved. Besides, since one fourth subpixel is disposed for each pixel group configured from a first pixel and a second pixel, reduction of the area of the opening region for the subpixels can be suppressed. As a result, increase of the luminance can be achieved with certainty, and enhancement of the display quality can be achieved.

DETAILED DESCRIPTION OF THE PREFERRED EMBODIMENTS

Figure 1:
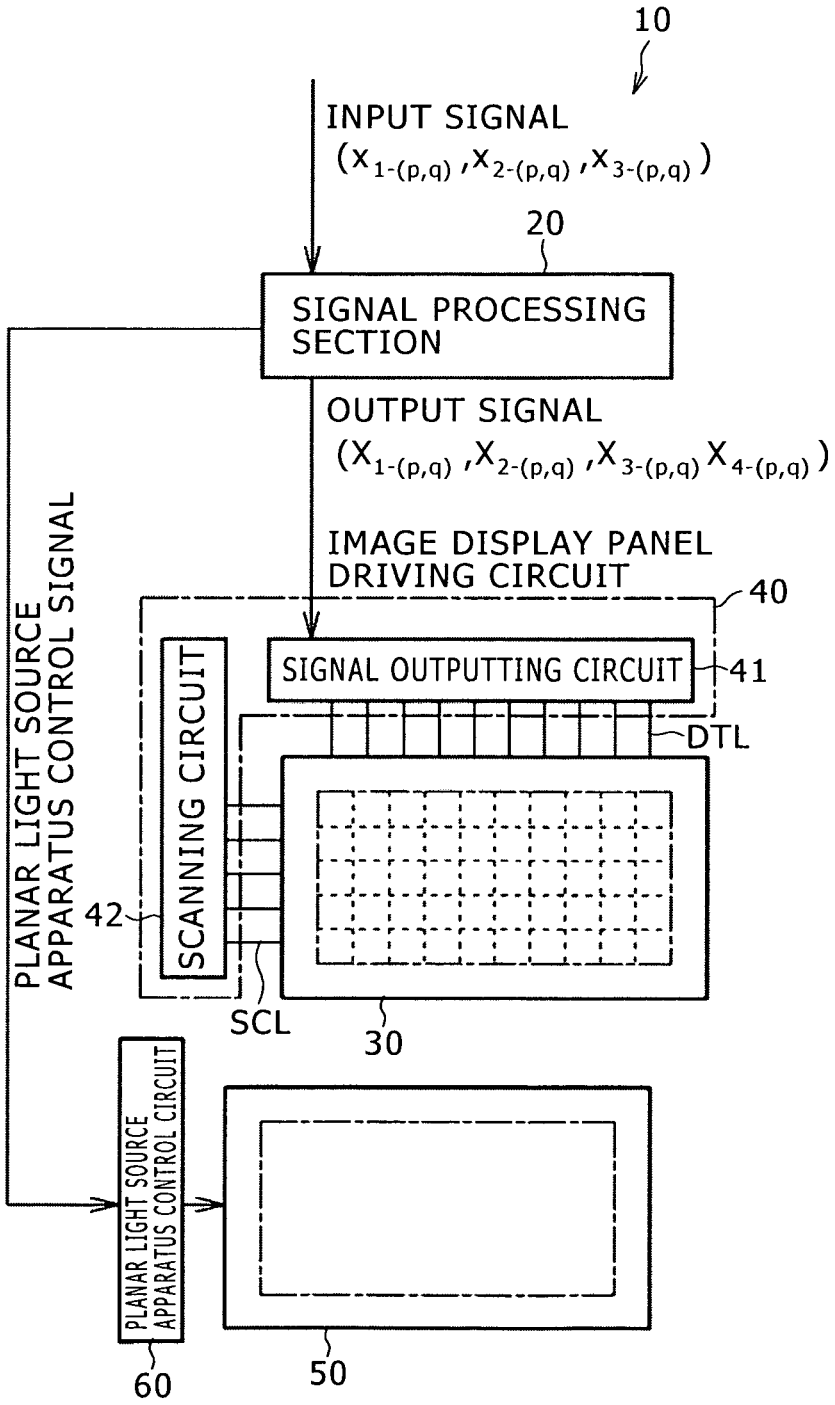
FIG. 1 is a block diagram of an image display apparatus of a working example 1.

In the following, the technology disclosed herein is described in connection with preferred working examples thereof. However, the disclosed technology is not limited to the working examples, and various numerical values, materials and so forth specified in the description of working examples are merely illustrative. It is to be noted that the description is given in the following order.

1. General description of the driving method for the image display apparatus according to the first to fifth embodiments of the disclosed technology
2. Working example 1 (driving method for the image display apparatus according to the first embodiment of the disclosed technology)
3. Working example 2 (modification to the working example 1)
4. Working example 3 (different modification to the working example 1)
5. Working example 4 (driving method for the image display apparatus according to the second embodiment of the disclosed technology)
6. Working example 5 (driving method for the image display apparatus according to the third embodiment of the disclosed technology)
7. Working example 6 (modification to the working example 5)
8. Working example 7 (different modification to the working example 5)
9. Working example 8 (driving method for the image display apparatus according to the fourth embodiment of the disclosed technology)
10. Working example 9 (modification to the working example 8)
11. Working example 10 (driving method for the image display apparatus according to the fifth embodiment of the disclosed technology), others General description of the driving method for the image display apparatus according to the first to fifth embodiments of the disclosed technology An image display apparatus assembly used for driving methods for an image display apparatus assembly according to first to fifth embodiments includes an image display apparatus according to the first to fifth embodiments and a planar light source apparatus for illuminating the image display apparatus from the rear side. Further, the driving methods according to the first to fifth embodiments can be applied to the driving method for the image display apparatus assembly according to any of the first to fifth embodiments.

The driving method for an image display apparatus according to the first embodiment may be configured in such a mode that, though not limited specifically, the first correction signal value is determined by subtracting the first constant from the product of the expansion coefficient $\alpha_0$ and the first subpixel input signal;

the second correction signal value is determined by subtracting the second constant from the product of the expansion coefficient $\alpha_0$ and the second subpixel input signal; and the third correction signal value is determined by subtracting the third constant from the product of the expansion coefficient $\alpha_0$ and the third subpixel input signal. In such a mode as just described, though not limited specifically, the first constant may be determined as a maximum value capable of being taken by the first subpixel input signal and the second constant may be determined as a maximum value capable of being taken by the second subpixel input signal while the third constant may be determined as a maximum value capable of being taken by the third subpixel input signal.

The driving method according to the first embodiment including such a preferred mode as described above may be configured in such a mode that, though not limited specifically, a correction signal value having a lower value from between the fourth and fifth correction signal values is determined as the fourth subpixel output signal, or an average value of the fourth and fifth correction signal values is determined as the fourth subpixel output signal.

Meanwhile, the driving method for an image display apparatus according to the second embodiment may be configured in such a mode that, though not limited specifically, a higher one of a value determined by subtracting the first constant from the product of the expansion coefficient $\alpha_0$ and the first subpixel input signal to the (p,q)th pixel and another value determined by subtracting the first constant from the product of the expansion coefficient $\alpha_0$ and the first subpixel input signal to the adjacent pixel being determined as the first correction signal value;

a higher one of a value determined by subtracting the second constant from the product of the expansion coefficient $\alpha_0$ and the second subpixel input signal to the (p,q)th pixel and another value determined by subtracting the second constant from the product of the expansion coefficient $\alpha_0$ and the second subpixel input signal to the adjacent pixel being determined as the second correction signal value;

a higher one of a value determined by subtracting the third constant from the product of the expansion coefficient $\alpha_0$ and the third subpixel input signal to the (p,q)th pixel and another value determined by subtracting the third constant from the product of the expansion coefficient $\alpha_0$ and the third subpixel input signal to the adjacent pixel being determined as the third correction signal value. In such a mode as just described, though not limited specifically, the first constant may be determined as a maximum value capable of being taken by the first subpixel input signal and the second constant may be determined as a maximum value capable of being taken by the second subpixel input signal while the third constant may be determined as a maximum value capable of being taken by the third subpixel input signal.

The driving method according to the second embodiment including such a preferred mode as described above may be configured in such a mode that, though not limited specifically, a correction signal value having a lower value from between the fourth and fifth correction signal values is determined as the fourth subpixel output signal, or an average value of the fourth and fifth correction signal values is determined as the fourth subpixel output signal.

The driving method for an image display apparatus according to the third, fourth or fifth embodiment may be configured in such a mode that, though not limited specifically, a higher one of a value determined by subtracting the first constant from the product of the expansion coefficient $\alpha_0$ and the first subpixel input signal to the first pixel or the adjacent pixel and another value determined by subtracting the first constant from the product of the expansion coefficient $\alpha_0$ and the first subpixel input signal to the second pixel is determined as the first correction signal value;

a higher one of a value determined by subtracting the second constant from the product of the expansion coefficient $\alpha_0$ and the second subpixel input signal to the first pixel or the adjacent pixel and another value determined by subtracting the second constant from the product of the expansion coefficient $\alpha_0$ and the second subpixel input signal to the second pixel is determined as the second correction signal value; and a higher one of a value determined by subtracting the third constant from the product of the expansion coefficient $\alpha_0$ and the third subpixel input signal to the first pixel or the adjacent pixel and another value determined by subtracting the third constant from the product of the expansion coefficient $\alpha_0$ and the third subpixel input signal to the second pixel is determined as the third correction signal value. In such a mode as just described, though not limited specifically, the first constant may be determined as a maximum value capable of being taken by the first subpixel input signal and the second constant may be determined as a maximum value capable of being taken by the second subpixel input signal while the third constant may be determined as a maximum value capable of being taken by the third subpixel input signal (in the driving method according to the third embodiment) or one half (½) of the maximum value capable of being taken by the third subpixel input signal (in the driving method according to the fourth or fifth embodiment).

The driving method according to the third, fourth or fifth embodiment including such a preferred mode as described above may be configured in such a mode that, though not limited specifically, a correction signal value having a lower value from between the fourth and fifth correction signal values is determined as the fourth subpixel output signal, or an average value of the fourth and fifth correction signal values is determined as the fourth subpixel output signal.

In the driving method according to the first to fifth embodiments including the preferred forms, the saturation S and the brightness V(S) are represented respectively by $$S=(\mathrm{Max}-\mathrm{Min})/\mathrm{Max}$$

$$V(S)=\mathrm{Max}$$

where

Max: a maximum value of three subpixel input signal values including the first, second and third subpixel input signal values to the pixel Min: a minimum value of three subpixel input signal values including the first, second and third subpixel input signal values to the pixel It is to be noted that the saturation S can assume a value ranging from 0 to 1, and the brightness V(S) can assume a value ranging from 0 to $2^n-1$. Here, n is a display gradation bit number, and "H" of the "HSV color space" signifies the hue representative of a type of the color; "S" the saturation or chroma representative of a brilliance of the color; and "V" a brightness value or a lightness value representative of brightness or luminosity of the color. This similarly applies also in the description given below.

Meanwhile, such a mode can be configured that a minimum value $\alpha_{min}$ from among values of $V_{max}(S)/V(S)$ [$\equiv\alpha(S)$] determined with regard to the plural pixels or plural first pixels and second pixels is determined as the expansion coefficient $\alpha_0$. Or, although it depends upon an image to be displayed, one of values within $(1\pm0.4)\cdot\alpha_{min}$ may be used as the expansion coefficient $\alpha_0$. Or else, although the expansion coefficient $\alpha_0$ is determined based at least on one value from among values of $V_{max}(S)/V(S)$ [$\equiv\alpha(S)$] determined with regard to the plural pixels or plural first pixels and second pixels, the expansion coefficient $\alpha_0$ may be determined based on one of the values such as, for example, the minimum value $\alpha_{min}$, or a plurality of values $\alpha(S)$ may be determined in order beginning with the minimum value and an average value $\alpha_{avr}$ of the values may be used as the expansion coefficient $\alpha_0$. Or otherwise, a value within the range of $(1\pm0.4)\cdot\alpha_{ave}$ may be used as the expansion coefficient $\alpha_0$. Or alternatively, in the case where the number of pixels when the plural values $\alpha(S)$ are determined in order beginning with the minimum value is smaller than a predetermined number, the plural number may be changed to determine a plurality of values $\alpha(S)$ in order beginning with the minimum value.

The expansion coefficient $\alpha_0$ may be determined for every one image display frame. Or the driving method of any of the first to fifth embodiments may be configured, as occasion demands, such that the luminance of the light source for illuminating the image display apparatus such as, for example, a planar light source apparatus is reduced based on the expansion coefficient $\alpha_0$.

Such a mode may be configured that a plurality of pixels or pixel groups with regard to which the saturation S and the brightness V(S) are to be determined are all pixels or all pixel groups. Or, they may be 1/N all pixels or pixel groups. It is to be noted that "N" is a natural number equal to or greater than 2. As a particular value of N, for example, a power of two such as 2, 4, 8, 16, . . . may used. If the former mode is adopted, then the picture quality can be maintained good to the utmost without suffering from a picture quality variation. On the other hand, if the latter mode is adopted, then enhancement of the processing speed and simplification in circuitry of the signal processing can be anticipated.

In the driving method according to the first or second embodiment including the preferred modes described hereinabove, regarding a (p,q)th pixel where $1\le p\le P_0$ and $1\le q\le Q_0$, a first subpixel input signal having a signal value of $x_{1-(p,q)}$, a second subpixel input signal having a signal value of $x_{2-(p,q)}$ and a third subpixel input signal having a signal value of $x_{3-(p,q)}$ are input to the signal processing section. Further, the signal processing section outputs, regarding the (p,q)th pixel, a first subpixel output signal having a signal value $X_{1-(p,q)}$ for determining a display gradation of a first subpixel, a second subpixel output signal having a signal value $X_{2-(p,q)}$ for determining a display gradation of a second subpixel, a third subpixel output signal having a signal value $X_{3-(p,q)}$ for determining a display gradation of a third subpixel, and a fourth subpixel output signal having a signal value $X_{4-(p,q)}$ for determining a display gradation of a fourth subpixel.

Meanwhile, in the driving method according to the third, fourth or fifth embodiment including the preferred modes described hereinabove, regarding a first pixel which configures a (p,q)th pixel group where $1\le p\le P$ and $1\le q\le Q$, to the signal processing section, a first subpixel input signal having a signal value of $x_{1-(p,q)-1}$, a second subpixel input signal having a signal value of $x_{2-(p,q)-1}$, and a third subpixel input signal having a signal value of $x_{3-(p,q)-1}$, are input, and regarding a second pixel which configures the (p,q)th pixel group, to the signal processing section, a first subpixel input signal having a signal value of $x_{1-(p,q)-2}$, a second subpixel input signal having a signal value of $x_{2-(p,q)-2}$, and a third subpixel input signal having a signal value of $x_{3-(p,q)-2}$, are input.

Further, regarding the first pixel which configures the (p,q) th pixel group, the signal processing section outputs a first subpixel output signal having a signal value $X_{1-(p,q)-1}$ for determining a display gradation of the first subpixel, a second subpixel output signal having a signal value $X_{2-(p,q)-1}$ for determining a display gradation of the second subpixel, and a third subpixel output signal having a signal value $X_{3-(p,q)-1}$ for determining a display gradation of the third subpixel.

Further, regarding the second pixel which configures the (p,q)th pixel group, the signal processing section outputs a first subpixel output signal having a signal value $X_{1-(p,q)-2}$ for determining a display gradation of the first subpixel, a second subpixel output signal having a signal value $X_{2-(p,q)-2}$ for determining a display gradation of the second subpixel, and a third subpixel output signal having a signal value $X_{3-(p,q)-2}$ for determining a display gradation of the third subpixel (driving method according to the third embodiment).

Further, regarding the fourth subpixel, the signal processing section outputs a fourth subpixel output signal having a signal value $X_{4-(p,q)}$ for determining a display gradation of the fourth subpixel (driving method according to the third, fourth or fifth embodiment).

Further, in the driving method according to the second or fifth embodiment, regarding an adjacent pixel positioned adjacent the (p,q)th pixel, to the signal processing section, a first subpixel input signal having a signal value $x_{1-(p,q')}$, a second subpixel input signal having a signal value $x_{2-(p,q')}$, and a third subpixel input signal having a signal value $x_{3-(p,q')}$ are input.

Further, in the driving method according to the fourth embodiment, regarding an adjacent pixel positioned adjacent the (p,q)th pixel, to the signal processing section a first subpixel input signal having a signal value $x_{1-(p',q)}$, a second subpixel input signal having a signal value $x_{2-(p',q)}$, and a third subpixel input signal having a signal value $x_{3-(p',q)}$ are input.

Further, $Max_{(p,q)}$, $Min_{(p,q)}$, $MaX_{(p,q)-1}$, $Min_{(p,q)-1}$, $Max_{(p,q)-2}$, $Min_{(p,q-2)}$, $Max_{(p',q)-1}$, $Min_{(p',q)-1}$, $Max_{(p,q')}$ and $Min_{(p,q')}$ are defined in the following manner.

$Max_{(p,q)}$: a maximum value among three subpixel input signal values including a first subpixel input signal value $x_{1-(p,q)}$, a second subpixel input signal value $x_{2-(p,q)}$ and a third subpixel input signal value $x_{3-(p,q)}$ to the (p,q)th pixel $Min_{(p,q)}$: a minimum value among the three subpixel input signal values including the first subpixel input signal value $x_{1-(p,q)}$, second subpixel input signal value $x_{2-(p,q)}$ and third subpixel input signal value $x_{3-(p,q)}$ to the (p,q)th pixel $Max_{(p,q)-1}$: a maximum value among three subpixel input signal values including a first subpixel input signal value $x_{1-(p,q)-1}$, a second subpixel input signal value $x_{2-(p,q)-1}$ and a third subpixel input signal value $x_{3-(p,q)-1}$ to the (p,q)th first pixel $Min_{(p,q)-1}$: a minimum value among the three subpixel input signal values including the first subpixel input signal value $x_{1-(p,q)-1}$, second subpixel input signal value $x_{2-(p,q)-1}$ and third subpixel input signal value $x_{3-(p,q)-1}$ to the (p,q)th first pixel $Max_{(p,q)-2}$: a maximum value among three subpixel input signal values including a first subpixel input signal value $x_{1-(p,q)-2}$, a second subpixel input signal value $x_{2-(p,q)-2}$ and a third subpixel input signal value $x_{3-(p,q)-2}$ to the (p,q)th second pixel $Min_{(p,q)-2}$: a minimum value among the three subpixel input signal values including the first subpixel input signal value $x_{1-(p,q)-2}$, second subpixel input signal value $x_{2-(p,q)-2}$ and third subpixel input signal value $x_{3-(p,q)-2}$ to the (p,q)th second pixel $Max_{(p',q)-1}$: a maximum value among three subpixel input signal values including a first subpixel input signal value $x_{1-(p',q)}$, a second subpixel input signal value $x_{2-(p',q)}$ and a third subpixel input signal value $x_{3-(p',q)}$ to an adjacent pixel positioned adjacent the (p,q)th second pixel along the first direction $Min_{(p',q)-1}$: a minimum value among the three subpixel input signal values including the first subpixel input signal value $x_{1-(p',q)}$, second subpixel input signal value $x_{2-(p',q)}$ and third subpixel input signal value $x_{3-(p',q)}$ to the adjacent pixel positioned adjacent the (p,q)th second pixel along the first direction $Max_{(p,q')}$: a maximum value among three subpixel input signal values including a first subpixel input signal value $x_{1-(p,q')}$, a second subpixel input signal value $x_{2-(p,q')}$ and a third subpixel input signal value $x_{3-(p,q')}$ to an adjacent pixel positioned adjacent a (p,q)th second pixel along the second direction $Min_{(p,q')}$: a minimum value among the three subpixel input signal values including the first subpixel input signal value $x_{1-(p,q')}$, second subpixel input signal value $x_{2-(p,q')}$ and third subpixel input signal value $x_{3-(p,q')}$ to the adjacent pixel positioned adjacent the (p,q)th second pixel along the second direction In the driving method according to the first embodiment, for each pixel, the fifth correction signal value $CS_{5-(p,q)}$ is determined based on the expansion coefficient $\alpha_0$, first subpixel input signal, second subpixel input signal and third correction signal value. However, the fifth correction signal value $CS_{5-(p,q)}$ may otherwise be determined based at least on a value of Min and the expansion coefficient $\alpha_0$. Or the fifth correction signal value can be determined based at least on a function of Min and the expansion coefficient $\alpha_0$. More particularly, the fifth correction signal value $CS_{5-(p,q)}$ can be determined, for example, in accordance with expressions given below. It is to be noted that $c_{11}$, $c_{12}$, $c_{13}$, $c_{14}$, $c_{15}$, $c_{16}$ and $c_{17}$ in the expressions are constants. What value, what expression or what function should be applied for the value, expression or function of the fifth correction signal value $CS_{5-(p,q)}$ may be determined suitably by making a prototype of the image display apparatus or the image display apparatus assembly and carrying out evaluation of images, for example, by an image observer. This similar applies also to the description given hereinbelow.

$$CS_{5-(p,q)}=c_{11}(Min_{(p,q)})\cdot\alpha_0 \tag{1-1}$$

or $$CS_{5-(p,q)}=c_{12}(Min_{(p,q)})^2\cdot\alpha_0 \tag{1-2}$$

or else $$CS_{5-(p,q)}=c_{13}(Max_{(p,q)})^{1/2}\cdot\alpha_0 \tag{1-3}$$

or else $$CS_{5-(p,q)}=c_{14}\{\text{product of } (Min_{(p,q)}/Max_{(p,q)}) \text{ or } 2^n-1 \text{ and } \alpha_0\} \tag{1-4}$$

or else $$CS_{5-(p,q)}=c_{15}[\{\text{product of } (2^n-1)\times \text{Min}_{(p,q)}/(\text{Max}_{(p,q)}-\text{Min}_{(p,q)}) \text{ or } 2^n-1 \text{ and } \alpha_0\}] \quad (1\text{-}5)$$

or else $$CS_{5-(p,q)}=c_{16}\{\text{product of lower one of values of } (\text{Max}_{(p,q)})^{1/2} \text{ and } \text{Min}_{(p,q)} \text{ and } \alpha_0\} \quad (1\text{-}6)$$

Then, in the driving method according to the first embodiment, for each of the pixels:

a first correction signal value $CS_{1-(p,q)}$ is determined based on the expansion coefficient $\alpha_0$, the first subpixel input signal $x_{1-(p,q)}$ and a first constant $K_1$;

a second correction signal value $CS_{2-(p,q)}$ is determined based on the expansion coefficient $\alpha_0$, the second subpixel input signal $x_{2-(p,q)}$ and a second constant $K_2$; and a third correction signal value $CS_{3-(p,q)}$ is determined based on the expansion coefficient $\alpha_0$, the third subpixel input signal $x_{3-(p,q)}$ and a third constant K3. More particularly, for example, as described hereinabove, such a mode may be adopted that:

the first correction signal value $CS_{1-(p,q)}$ is determined by subtracting the first constant $K_1$ from the product of the expansion coefficient $\alpha_0$ and the first subpixel input signal $x_{1-(p,q)}$;

the second correction signal value $CS_{2-(p,q)}$ is determined by subtracting the second constant $K_2$ from the product of the expansion coefficient $\alpha_0$ and the second subpixel input signal $x_{2-(p,q)}$; and the third correction signal value $CS_{3-(p,q)}$ is determined by subtracting the third constant $K_3$ from the product of the expansion coefficient $\alpha_0$ and the third subpixel input signal $x_{3-(p,q)}$. It is to be noted that, though not limited specifically, for example, the first constant $K_1$ may be a maximum value capable of being taken by the first subpixel input signal; the second constant $K_2$ may be a maximum value capable of being taken by the second subpixel input signal; and the third constant $K_3$ may be a maximum value capable of being taken by the third subpixel input signal.

$$CS_{1-(p,q)}=x_{1-(p,q)}\cdot\alpha_0-K_1 \quad (1\text{-}a_1)$$

$$CS_{2-(p,q)}=x_{2-(p,q)}\cdot\alpha_0-K_2 \quad (1\text{-}b_1)$$

$$CS_{3-(p,q)}=x_{3-(p,q)}\cdot\alpha_0-K_3. \quad (1\text{-}c_1)$$

Further, in the driving method according to the first embodiment, for each pixel, a correction signal value having a maximum value from among the first correction signal value $CS_{1-(p,q)}$, second correction signal value $CS_{2-(p,q)}$ and third correction signal value $CS_{3-(p,q)}$ is determined as a fourth correction signal value $CS_{4-(p,q)}$. In particular, the fourth correction value is determined in accordance with $$CS_{4-(p,q)}=c_{17}\cdot\max(CS_{1-(p,q)},CS_{2-(p,q)},CS_{3-(p,q)}) \quad (1\text{-}d_1)$$

Then, a fourth subpixel output signal $X_{4-(p,q)}$ is determined from the fourth correction signal value $CS_{4-(p,q)}$ and the fifth correction signal value $CS_{5-(p,q)}$ and output to the fourth subpixel. More particularly, as described hereinabove, for example, the correction signal value having a lower value from between the fourth correction signal value $CS_{4-(p,q)}$ and the fifth correction signal value $CS_{5-(p,q)}$ is determined as the fourth subpixel output signal $X_{4-(p,q)}$. In particular, the fourth subpixel output signal $X_{4-(p,q)}$ is determined in accordance with $$X_{4-(p,q)}=\min(CS_{4-(p,q)},CS_{5-(p,q)}) \quad (1\text{-}e_1)$$

or an average value of the fourth correction signal value $CS_{4-(p,q)}$ and the fifth correction signal value $CS_{5-(p,q)}$ may be determined as the fourth subpixel output signal $X_{4-(p,q)}$. In particular, the fourth subpixel output signal $X_{4-(p,q)}$ is determined in accordance with $$X_{4-(p,q)}=(CS_{4-(p,q)}+CS_{5-(p,q)})/2 \quad (1\text{-}f_1)$$

Or else, the expression $(1\text{-}f_1)$ may be expanded such that the fourth subpixel output signal $X_{4-(p,q)}$ is determined in accordance with $$X_{4-(p,q)}=(k_4\cdot CS_{4-(p,q)}+k_5\cdot CS_{5-(p,q)})/(k_4+k_5) \quad (1\text{-}g_1)$$

where $k_4$ and $k_5$ are constants. The average value may be determined not as an arithmetical mean but as a geometrical mean or else in accordance with $$X_{4-(p,q)}=k'_4\cdot CS_{4-(p,q)}+k'_5\cdot CS_{5-(p,q)}$$

or otherwise as a root-mean-square value given by $$X_{4-(p,q)}=[(CS_{4-(p,q)}^2+CS_{5-(p,q)}^2)/2]^{1/2}$$

This similarly applies also to the driving methods according to the second to fifth embodiments hereinafter described. It is to be noted that $k'_4$ and $k'_5$ are constants.

It is to be noted that max( ) signifies that a maximum value from among values in ( ) is selected, and min( ) signifies that a minimum value from among values in ( ) is selected. If the value of min( ) is in the negative, the value of min( ) is determined to be zero.

In the driving method according to the second embodiment, for a (p,q)th pixel along the second direction, the fifth correction signal value $CS_{5-(p,q)}$ is determined based on the expansion coefficient $\alpha_0$, the first subpixel input signal, second subpixel input signal and third correction signal value to the (p,q)th pixel and the first subpixel input signal, second subpixel input signal and third correction signal value to the adjacent pixel. However, such a mode may be adopted that the fifth correction signal value $CS_{5-(p,q)}$ is determined at least based on the value of Min of the (p,q) th pixel, the value of Min of the adjacent pixel and the expansion coefficient $\alpha_0$ or that the fifth correction signal value $CS_{5-(p,q)}$ is determined at least based on a function of Min of the (p,q) th pixel, a function of Min of the adjacent pixel and the expansion coefficient $\alpha_0$. In particular, the fifth correction signal value $CS_{5-(p,q)}$ can be determined in accordance with the expressions given below. In the expressions, $c_{21}$, $C_{22}$, $c_{23}$, $C_{24}$, $c_{25}$ and $c_{26}$ are constants. It is to be noted that, for the convenience of description, "$SG_{2-(p,q)}$" is referred to as fourth subpixel control second signal value and "$SG_{1-(p,q)}$" as fourth subpixel control first signal value $S_{G1-(p,q)}$, and "$SG_{3-(p,q)}$" as third subpixel control signal value, and they are defined as given below:

$$SG_{1-(p,q)}=c_{21}(\text{Min}_{(p,q)-1})\cdot\alpha_0 \quad (2\text{-}1\text{-}1)$$

$$SG_{2-(p,q)}=c_{21}(\text{Min}_{(p,q)-2})\cdot\alpha_0 \quad (2\text{-}1\text{-}2)$$

or $$SG_{1-(p,q)}=c_{22}(\text{Min}_{(p,q)-1})^2\cdot\alpha_0 \quad (2\text{-}2\text{-}1)$$

$$SG_{2-(p,q)}=c_{22}(\text{Min}_{(p,q)-2})^2\cdot\alpha_0 \quad (2\text{-}2\text{-}2)$$

or else $$SG_{1-(p,q)}=c_{23}(\text{Max}_{(p,q)-1})^{1/2}\cdot\alpha_0 \quad (2\text{-}3\text{-}1)$$

$$SG_{2-(p,q)}=c_{23}(\text{Max}_{(p,q)-2})^{1/2}\cdot\alpha_0 \quad (2\text{-}3\text{-}2)$$

or else $$SG_{1-(p,q)}=c_{24}\{\text{product of } (\mathrm{Min}_{(p,q)-1}/\mathrm{Max}_{(p,q)-1}) \text{ or } (2^n-1) \text{ and } \alpha_0\} \quad (2\text{-}4\text{-}1)$$

$$SG_{2-(p,q)}=c_{24}\{\text{product of } (\mathrm{Min}_{(p,q)-2}/\mathrm{Max}_{(p,q)-2}) \text{ or } (2^n-1) \text{ and } \alpha_0\} \quad (2\text{-}4\text{-}2)$$

or else $$SG_{1-(p,q)}=c_{25}[\text{product of } \{(2^n-1)\cdot\mathrm{Min}_{(p,q)-1}/(\mathrm{Max}_{(p,q)-1}-\mathrm{Min}_{(p,q)-1})\} \text{ or } (2^n-1) \text{ and } \alpha_0] \quad (2\text{-}5\text{-}1)$$

$$SG_{2-(p,q)}=c_{25}[\text{product of } \{(2^n-1)\cdot\mathrm{Min}_{(p,q)-2}/(\mathrm{Max}_{(p,q)-2}-\mathrm{Min}_{(p,q)-2}\} \text{ or } (2^n-1) \text{ and } \alpha_0] \quad (2\text{-}5\text{-}2)$$

or else $$SG_{1-(p,q)}=c_{26}\{\text{product of lower one of values of } (\mathrm{Max}_{(p,q)-1})^{1/2} \text{ and } \mathrm{Min}_{(p,q)-1} \text{ and } \alpha_0\} \quad (2\text{-}6\text{-}1)$$

$$SG_{2-(p,q)}=c_{26}\{\text{product of lower one of values of } (\mathrm{Max}_{(p,q)-2})^{1/2} \text{ and } \mathrm{Min}_{(p,q)-2} \text{ and } \alpha_0\} \quad (2\text{-}6\text{-}2)$$

In the driving methods according to the second and fifth embodiments, $\mathrm{Max}_{(p,q)-1}$ and $\mathrm{Min}_{(p,q)-1}$ in the expressions given above may be re-read as $\mathrm{Max}_{(p,q')}$ and $\mathrm{Min}_{(p,q')}$, respectively.

Meanwhile, in the driving method according to the fourth embodiment, $\mathrm{Max}_{(p,q)-1}$ and $\mathrm{Min}_{(p,q)-1}$ in the expressions given above may be re-read as $\mathrm{Max}_{(p',q)-1}$ and $\mathrm{Min}_{(p',q)-1}$, respectively. Further, the control signal value $SG_{3-(p,q)}$, that is, the third subpixel control signal value, can be obtained by replacing "$SG_{1-(p,q)}$" on the left side in the expression (2-3-1), (2-4-1), (2-5-1) or (2-6-1) with "$SG_{3-(p,q)}$."

Further, in the driving methods according to the second to fifth embodiments, for the (p,q)th pixel, the fifth correction signal value $CS_{5-(p,q)}$ may be determined in accordance with $$CS_{5-(p,q)}=\min(SG_{1-(p,q)},SG_{2-(p,q)}) \quad (2\text{-}7)$$

On in the driving method according to the second, fourth or fifth embodiment, the fifth correction signal value $CS_{5-(p,q)}$ may be determined in accordance with $$CS_{5-(p,q)}=\min(SG_{2-(p,q)},SG_{3-(p,q)}) \quad (2\text{-}8)$$

Or else, the fifth correction signal $CS_{5-(p,q)}$ may be determined not from a minimum value but from an average value or a maximum value.

Further, in the driving method according to the second embodiment, for the (p,q)th pixel:

the first correction signal value $CS_{1-(p,q)}$ is determined based on the expansion coefficient $\alpha_0$, a first subpixel input signal $x_{1-(p,q)}$ to the (p,q)th pixel, a first subpixel input signal $x_{1-(p,q')}$ to an adjacent pixel adjacent to the (p,q)th pixel along the second direction and a first constant $K_1$;

the second correction signal value $CS_{2-(p,q)}$ is determined based on the expansion coefficient $\alpha_0$, a second subpixel input signal $x_{2-(p,q)}$ to the (p,q)th pixel, a second subpixel input signal $x_{2-(p,q')}$ to the adjacent pixel and a second constant $K_2$; and the third correction signal value $CS_{3-(p,q)}$ is determined based on the expansion coefficient $\alpha_0$, a third subpixel input signal $x_{3-(p,q)}$ to the (p,q)th pixel, a third subpixel input signal $x_{3-(p,q')}$ to the adjacent pixel and a third constant $K_3$. However, more particularly, as described hereinabove, a higher one of a value determined by subtracting the first constant $K_1$ from the product of the expansion coefficient $\alpha_0$ and the first subpixel input signal $x_{1-(p,q)}$ to the (p,q)th pixel and another value determined by subtracting the first constant $K_1$ from the product of the expansion coefficient $\alpha_0$ and the first subpixel input signal $x_{1-(p,q')}$ to the adjacent pixel is determined as the first correction signal value $CS_{1-(p,q)}$;

a higher one of a value determined by subtracting the second constant $K_2$ from the product of the expansion coefficient $\alpha_0$ and the second subpixel input signal $x_{2-(p,q)}$ to the (p,q)th pixel and another value determined by subtracting the second constant $K_2$ from the product of the expansion coefficient $\alpha_0$ and the second subpixel input signal $x_{2-(p,q')}$ to the adjacent pixel is determined as the second correction signal value $CS_{2-(p,q)}$; and a higher one of a value determined by subtracting the third constant $K_3$ from the product of the expansion coefficient $\alpha_0$ and the third subpixel input signal $x_{3-(p,q)}$ to the (p,q)th pixel and another value determined by subtracting the third constant $K_3$ from the product of the expansion coefficient $\alpha_0$ and the third subpixel input signal $x_{3-(p,q')}$ to the adjacent pixel is determined as the third correction signal value $CS_{3-(p,q)}$. It is to be noted that, though not limited specifically, for example, the first constant $K_1$ may be a maximum value capable of being taken by the first subpixel input signal; the second constant $K_2$ may be a maximum value capable of being taken by the second subpixel input signal; and the third constant $K_3$ may be a maximum value capable of being taken by the third subpixel input signal as described hereinabove.

$$CS_{1-(p,q)}=\max(x_{1-(p,q)}\cdot\alpha_0-K_1,x_{1-(p,q')}\cdot\alpha_0-K_1) \quad (1\text{-}a_2)$$

$$CS_{2-(p,q)}=\max(x_{2-(p,q)}\cdot\alpha_0-K_2,x_{2-(p,q')}\cdot\alpha_0-K_2) \quad (1\text{-}b_2)$$

$$CS_{3-(p,q)}=\max(x_{3-(p,q)}\cdot\alpha_0-K_3,x_{3-(p,q')}\cdot\alpha_0-K_3) \quad (1\text{-}c_2)$$

Further, also in the driving method according to the second embodiment, for the (p,q)th pixel, a correction signal value having a maximum value from among the first correction signal value $CS_{1-(p,q)}$, second correction signal value $CS_{2-(p,q)}$ and third correction signal value $CS_{3-(p,q)}$ is determined as a fourth correction signal value $CS_{4-(p,q)}$. In particular, the fourth correction signal value $CS_{4-(p,q)}$ is determined in accordance with $$CS_{4-(p,q)}=c_{17}\cdot\max(CS_{1-(p,q)},CS_{2-(p,q)},CS_{3-(p,q)}) \quad (1\text{-}d_2)$$

Then, a fourth subpixel output signal $X_{4-(p,q)}$ is determined from the fourth correction signal value $CS_{4-(p,q)}$ and the fifth correction signal value $CS_{5-(p,q)}$ and output to the fourth subpixel. In particular, as described hereinabove, for example, a correction signal value having a lower value from between the fourth correction signal value $CS_{4-(p,q)}$ and the fifth correction signal value $CS_{5-(p,q)}$ is determined as the fourth subpixel output signal $X_{4-(p,q)}$. More particularly, the fourth subpixel output signal $X_{4-(p,q)}$ may be determined in accordance with $$X_{4-(p,q)}=\min(CS_{4-(p,q)},CS_{5-(p,q)}) \quad (1\text{-}e_2)$$

or an average value of the fourth correction signal value $CS_{4-(p,q)}$ and the fifth correction signal value $CS_{5-(p,q)}$ may be determined as the fourth subpixel output signal $X_{4-(p,q)}$. More particularly, the fourth subpixel output signal $X_{4-(p,q)}$ may be determined in accordance with $$X_{4-(p,q)}=(CS_{4-(p,q)}+CS_{5-(p,q)})/2 \quad (1\text{-}f_2)$$

or the expression (1-$f_2$) may be expanded such that the fourth subpixel output signal $X_{4-(p,q)}$ is determined in accordance with $$X_{4-(p,q)}=(k_4\cdot CS_{4-(p,q)}+k_5\cdot CS_{5-(p,q)})/(k_4+k_5) \quad (1\text{-}g_2)$$

In the driving method according to the first or second embodiment, such a configuration may be adopted that the first subpixel output signal is determined at least based on the first subpixel input signal and an expansion coefficient $\alpha_0$;

the second subpixel output signal is determined at least based on the second subpixel input signal and the expansion coefficient $\alpha_0$; and the third subpixel output signal is determined at least based on the third subpixel input signal and the expansion coefficient $\alpha_0$.

More particularly, in the driving method according to the first or second embodiment, where $\chi$ is a constant which depends upon the image display apparatus, the signal processing section can determine the first subpixel output signal $X_{1-(p,q)}$, second subpixel output signal $X_{2-(p,q)}$ and third subpixel output signal $X_{3-(p,q)}$ to the (p,q)th pixel or the set of a first subpixel, a second subpixel and a third subpixel, in accordance with the following expressions:

[First and Second Embodiments]

$$X_{1-(p,q)}=\alpha_0 \cdot x_{1-(p,q)}-\chi \cdot X_{4-(p,q)} \quad (1\text{-A})$$

$$X_{2-(p,q)}=\alpha_0 \cdot x_{2-(p,q)}-\chi \cdot X_{4-(p,q)} \quad (1\text{-B})$$

$$X_{3-(p,q)}=\alpha_0 \cdot x_{3-(p,q)}-\chi \cdot X_{4-(p,q)} \quad (1\text{-C})$$

Here, where the luminance of a set of first, second and third subpixels which configure a pixel (in the first and second embodiments) or a pixel group (in the third, fourth and fifth embodiments) when a signal having a value corresponding to a maximum signal value of the first subpixel output signal is input to the first subpixel and a signal having a value corresponding to a maximum signal value of the second subpixel output signal is input to the second subpixel and besides a signal having a value corresponding to a maximum signal value of the third subpixel output signal is input to the third subpixel is represented by $BN_{1-3}$ and the luminance of the fourth subpixel when a signal having a value corresponding to a maximum signal value of the fourth subpixel output signal is input to the fourth subpixel which configures the pixel (in the first and second embodiments) or the pixel group (in the third, fourth and fifth embodiments) is represented by $BN_4$, the constant $\chi$ can be represented as $$\chi=BN_4/BN_{1-3}$$

where the constant $\chi$ is a value unique to the image display apparatus or image display apparatus assembly and is determined uniquely by the image display apparatus or image display apparatus assembly.

In the driving method according to the third embodiment, for each pixel group, the fifth correction signal value $CS_{5-(p,q)}$ is determined based on the expansion coefficient $\alpha_0$, the first and second subpixel input signals and third correction signal value to the first pixel and the first and second subpixel input signals and third correction signal value to the second pixel. However, the fifth correction signal value $CS_{5-(p,q)}$ may otherwise be determined based at least on the value of Min of the first pixel, the value of Min of the second pixel and the expansion coefficient $\alpha_0$, or may otherwise be determined based at least on a function of Min of the first pixel, a function of Min of the second pixel and the expansion coefficient $\alpha_0$. In particular, the fifth correction signal value $CS_{5-(p,q)}$ can be determined in accordance with the expressions [(2-1-1), (2-1-2)], [(2-2-1), (2-2-2)], [(2-3-1), (2-3-2)], [(2-4-1), (2-4-2)], [(2-5-1), (2-5-2)], [(2-6-1), (2-6-2)] or (2-7), (2-8) given hereinabove.

Further, in the driving method according to the third embodiment, for each pixel group:

a first correction signal value $CS_{1-(p,q)}$ is determined based on the expansion coefficient $\alpha_0$, the first subpixel input signal $x_{1-(p,q)-1}$ to the first pixel, the first subpixel input signal $x_{1-(p,q)-2}$ to the second pixel and a first constant $K_1$;

a second correction signal value $CS_{2-(p,q)}$ is determined based on the expansion coefficient $\alpha_0$, the second subpixel input signal $x_{2-(p,q)-1}$ to the first pixel, the second subpixel input signal $x_{2-(p,q)-2}$ to the second pixel and a second constant $K_2$; and a third correction signal value $CS_{3-(p,q)}$ is determined based on the expansion coefficient $\alpha_0$, the third subpixel input signal $x_{3-(p,q)-1}$ to the first pixel, the third subpixel input signal $x_{3-(p,q)-2}$ to the second pixel and a third constant $K_3$. More particularly, as described hereinabove, a higher one of a value determined by subtracting the first constant $K_1$ from the product of the expansion coefficient $\alpha_0$ and the first subpixel input signal $x_{1-(p,q)-1}$ to the first pixel and another value determined by subtracting the first constant $K_1$ from the product of the expansion coefficient $\alpha_0$ and the first subpixel input signal $x_{1-(p,q)-2}$ to the second pixel may be determined as the first correction signal value $CS_{1-(p,q)}$;

a higher one of a value determined by subtracting the second constant $K_2$ from the product of the expansion coefficient $\alpha_0$ and the second subpixel input signal $x_{2-(p,q)-1}$ to the first pixel and another value determined by subtracting the second constant $K_2$ from the product of the expansion coefficient $\alpha_0$ and the second subpixel input signal $x_{2-(p,q)-2}$ to the second pixel may be determined as the second correction signal value $CS_{2-(p,q)}$; and a higher one of a value determined by subtracting the third constant $K_3$ from the product of the expansion coefficient $\alpha_0$ and the third subpixel input signal $X_{3-(p,q)-1}$ to the first pixel and another value determined by subtracting the third constant $K_3$ from the product of the expansion coefficient $\alpha_0$ and the third subpixel input signal $x_{3-(p,q)-2}$ to the second pixel may be determined as the third correction signal value $CS_{3-(p,q)}$. It is to be noted that, though not limited specifically, for example, the first constant $K_1$ may be a maximum value capable of being taken by the first subpixel input signal; the second constant $K_2$ may be a maximum value capable of being taken by the second subpixel input signal; and the third constant $K_3$ may be a maximum value capable of being taken by the third subpixel input signal as described hereinabove.

$$CS_{1-(p,q)}=\max(x_{1-(p,q)-1}\cdot\alpha_0-K_1, x_{1-(p,q)-2}\cdot\alpha_0-K_1) \quad (1\text{-a}_3)$$

$$CS_{2-(p,q)}=\max(x_{2-(p,q)-1}\cdot\alpha_0-K_2, x_{2-(p,q)-2}\cdot\alpha_0-K_2) \quad (1\text{-b}_3)$$

$$CS_{3-(p,q)}=\max(x_{3-(p,q)-1}\cdot\alpha_0-K_3, x_{3-(p,q)-2}\cdot\alpha_0-K_3) \quad (1\text{-c}_3)$$

Further, also in the driving method according to the third embodiment, for each pixel group, a correction signal value having a maximum value from among the first correction signal value $CS_{1-(p,q)}$, second correction signal value $CS_{2-(p,q)}$ and third correction signal value $CS_{3-(p,q)}$ is determined as a fourth correction signal value $CS_{4-(p,q)}$. In particular, the fourth correction signal value $CS_{4-(p,q)}$ is determined in accordance with $$CS_{4-(p,q)}=c_{17}\cdot\max(CS_{1-(p,q)}, CS_{2-(p,q)}, CS_{3-(p,q)}) \quad (1\text{-d}_3)$$

Then, a fourth subpixel output signal $X_{4-(p,q)}$ is determined from the fourth correction signal value $CS_{4-(p,q)}$ and the fifth correction signal value $CS_{5-(p,q)}$ and output to the fourth subpixel. In particular, as described hereinabove, for example, a correction signal value having a lower value from between the fourth correction signal value $CS_{4-(p,q)}$ and the fifth correction signal value $CS_{5-(p,q)}$ is determined as the fourth subpixel output signal $X_{4-(p,q)}$. More particularly, the fourth subpixel output signal $X_{4-(p,q)}$ may be determined in accordance with $$X_{4-(p,q)}=\min(CS_{4-(p,q)}, CS_{5-(p,q)}) \quad (1\text{-e}_3)$$

or an average value of the fourth correction signal value $CS_{4-(p,q)}$ and the fifth correction signal value $CS_{5-(p,q)}$ may be determined as the fourth subpixel output signal $X_{4-(p,q)}$. More particularly, the fourth subpixel output signal $X_{4-(p,q)}$ may be determined in accordance with $$X_{4-(p,q)}=(CS_{4-(p,q)}+CS_{5-(p,q)})/2 \quad (1\text{-}f_3)$$

or the expression (1-$f_3$) may be expanded such that the fourth subpixel output signal $X_{4-(p,q)}$ is determined in accordance with $$X_{4-(p,q)}=(k_4 \cdot CS_{4-(p,q)}+k_5 \cdot CS_{5-(p,q)})/(k_4+k_5) \quad (1\text{-}g_3)$$

In the driving method according to the third embodiment, such a configuration may be adopted that, regarding the first pixel:

a first subpixel output signal is determined at least based on a first subpixel input signal and an expansion coefficient $\alpha_0$, particularly the first subpixel output signal having the signal value $X_{1-(p,q)-1}$ is determined at least based on the first subpixel input signal having the signal value $x_{1-(p,q)-1}$ and the expansion coefficient $\alpha_0$ as well as the fourth subpixel output signal $X_{4-(p,q)}$;

a second subpixel output signal is determined at least based on a second subpixel input signal and the expansion coefficient $\alpha_0$, particularly the second subpixel output signal having the signal value $X_{2-(p,q)-1}$ is determined at least based on the second subpixel input signal $x_{2-(p,q)-1}$ and the expansion coefficient $\alpha_0$ as well as the fourth subpixel output signal $X_{4-(p,q)}$; and a third subpixel output signal is determined at least based on a third subpixel input signal and the expansion coefficient $\alpha_0$, particularly the third subpixel output signal having the signal value $X_{3-(p,q)-1}$ is determined at least based on the third subpixel input signal $x_{3-(p,q)-1}$ and the expansion coefficient $\alpha_0$ as well as the fourth subpixel output signal $X_{4-(p,q)}$; and regarding the second pixel:

a first subpixel output signal is determined at least based on a first subpixel input signal and the expansion coefficient $\alpha_0$, particularly the first subpixel output signal having the signal value $X_{1-(p,q)-2}$ is determined at least based on the first subpixel input signal $x_{1-(p,q)-2}$ and the expansion coefficient $\alpha_0$ as well as the fourth subpixel output signal $X_{4-(p,q)}$;

a second subpixel output signal is determined at least based on a second subpixel input signal and the expansion coefficient $\alpha_0$, particularly the second subpixel output signal having the signal value $X_{2-(p,q)-2}$ is determined at least based on the second subpixel input signal $x_{2-(p,q)-2}$ and the expansion coefficient $\alpha_0$ as well as the fourth subpixel output signal $X_{4-(p,q)}$; and a third subpixel output signal is determined at least based on a third subpixel input signal and the expansion coefficient $\alpha_0$, particularly the third subpixel output signal having the signal value $X_{3-(p,q)-2}$ is determined at least based on the third subpixel input signal $x_{3-(p,q)-2}$ and the expansion coefficient $\alpha_0$ as well as the fourth subpixel output signal $X_{4-(p,q)}$.

In the driving method according to the third embodiment, as described above, the first subpixel output signal value $X_{1-(p,q)-1}$ is determined at least based on the first subpixel input signal value $x_{1-(p,q)-1}$ and the expansion coefficient $\alpha_0$ as well as the fourth subpixel output signal $X_{4-(p,q)}$. However, the first subpixel output signal value $X_{1-(p,q)-1}$ can be determined in accordance with $[x_{1-(p,q)-1}, \alpha_0, X_{4-(p,q)}]$ or can be determined in accordance with $[x_{1-(p,q)-1}, x_{1-(p,q)-2}, \alpha_0, X_{4-(p,q)}]$ Similarly, although the second subpixel output signal value $X_{2-(p,q)-1}$ is determined at least based on the second subpixel input signal value $x_{2-(p,q)-1}$ and the expansion coefficient $\alpha_0$ as well as the fourth subpixel output signal $X_{4-(p,q)}$, the second subpixel output signal value $X_{2-(p,q)-1}$ can be determined in accordance with $[x_{2-(p,q)-1}, \alpha_0, X_{4-(p,q)}]$ or can be determined in accordance with $[x_{2-(p,q)-1}, x_{2-(p,q)-2}, \alpha_0, X_{4-(p,q)}]$ Similarly, although the third subpixel output signal $X_{3-(p,q)-1}$ is determined at least based on the third subpixel input signal $x_{3-(p,q)-1}$ and the expansion coefficient $\alpha_0$ as well as the fourth subpixel output signal $X_{4-(p,q)}$, the third subpixel output signal $X_{3-(p,q)-1}$ can be determined in accordance with $[x_{3-(p,q)-1}, \alpha_0, X_{4-(p,q)}]$ or can be determined in accordance with $[x_{3-(p,q)-1}, x_{3-(p,q)-2}, \alpha_0, X_{4-(p,q)}]$. The output signal value $X_{1-(p,q)-2}$, $X_{2-(p,q)-2}$, $X_{3-(p,q)-2}$ can be determined in the same manner.

More particularly, in the driving method according to the third embodiment, the signal processing section can determine the subpixel output signals $X_{1-(p,q)-1}$, $X_{2-(p,q)-1}$, $X_{3-(p,q)-1}$, $X_{1-(p,q)-2}$, $X_{2-(p,q)-2}$ and $X_{3-(p,q)-2}$ can be determined in accordance with the following expressions:

$$X_{1-(p,q)-1}=\alpha_0 \cdot x_{1-(p,q)-1}-\chi \cdot X_{4-(p,q)} \quad (2\text{-A})$$

$$X_{2-(p,q)-1}=\alpha_0 \cdot x_{2-(p,q)-1}-\chi \cdot X_{4-(p,q)} \quad (2\text{-B})$$

$$X_{3-(p,q)-1}=\alpha_0 \cdot x_{3-(p,q)-1}-\chi \cdot X_{4-(p,q)} \quad (2\text{-C})$$

$$X_{1-(p,q)-1}=\alpha_0 \cdot x_{1-(p,q)-1}-\chi \cdot X_{1-(p,q)} \quad (2\text{-D})$$

$$X_{2-(p,q)-1}=\alpha_0 \cdot x_{2-(p,q)-1}-\chi \cdot X_{2-(p,q)} \quad (2\text{-E})$$

$$X_{3-(p,q)-1}=\alpha_0 \cdot x_{3-(p,q)-1}-\chi \cdot X_{3-(p,q)} \quad (2\text{-F})$$

In the driving method according to the fourth embodiment, for the (p,q)th pixel group, a fifth correction signal value $CS_{5-(p,q)}$ is determined based on the expansion coefficient $\alpha_0$, first, second and third subpixel input signals to the second pixel and first, second and third subpixel input signals to an adjacent pixel positioned adjacent the second pixel along the first direction. However, the fifth correction signal value $CS_{5-(p,q)}$ may otherwise be determined based at least on the value of Min of the second pixel of the (p,q)th pixel group, the value of Min of the adjacent pixel and the expansion coefficient $\alpha_0$, or may otherwise be determined based at least on a function of Min of the second pixel of the (p,q)th pixel group, a function of Min of the adjacent pixel and the expansion coefficient $\alpha_0$. In particular, the fifth correction signal value $CS_{5-(p,q)}$ can be determined in accordance with the expressions [(2-1-1), (2-1-2)], [(2-2-1), (2-2-2)], [(2-3-1), (2-3-2)], [(2-4-1), (2-4-2)], [(2-5-1), (2-5-2)], [(2-6-1), (2-6-2)] or (2-7), (2-8) given hereinabove.

Further, in the driving method according to the fourth embodiment, for the (p,q)th pixel group:

a first correction signal $CS_{1-(p,q)}$ is determined based on the expansion coefficient $\alpha_0$, the first subpixel input signal $x_{1-(p,q)-2}$ to the second pixel, a first subpixel input signal $x_{1-(p',q)}$ to an adjacent pixel adjacent to the second pixel along the first direction and a first constant $K_1$;

a second correction signal value $CS_{2-(p,q)}$ is determined based on the expansion coefficient $\alpha_0$, the second subpixel input signal $x_{2-(p,q)-2}$ to the second pixel, a second subpixel input signal $x_{2-(p',q)}$ to the adjacent pixel and a second constant $K_2$; and a third correction signal value $CS_{3-(p,q)}$ is determined based on the expansion coefficient $\alpha_0$, the third subpixel input signal $x_{3-(p,q)-2}$ to the second pixel, a third subpixel input signal $x_{3-(p',q)}$ to the adjacent pixel and a third constant $K_3$. More particularly, as described hereinabove, a higher one of a value determined by subtracting the first constant $K_1$ from the product of the expansion coefficient $\alpha_0$ and the first subpixel input signal $x_{1-(p,q)-2}$ to the second pixel and another value determined by subtracting the first constant $K_1$ from the product of the expansion coefficient $\alpha_0$ and the first subpixel input signal $x_{1-(p',q)}$ to the adjacent pixel may be determined as the first correction signal value $CS_{1-(p,q)}$;

a higher one of a value determined by subtracting the second constant $K_2$ from the product of the expansion coefficient $\alpha_0$ and the second subpixel input signal $x_{2-(p,q)-2}$ to the second pixel and another value determined by subtracting the second constant $K_2$ from the product of the expansion coefficient $\alpha_0$ and the second subpixel input signal $x_{2-(p',q)}$ to the adjacent pixel may be determined as the second correction signal value $CS_{2-(p',q)}$; and a higher one of a value determined by subtracting the third constant $K_3$ from the product of the expansion coefficient $\alpha_0$ and the third subpixel input signal $x_{3-(p,q)-2}$ to the second pixel and another value determined by subtracting the third constant $K_3$ from the product of the expansion coefficient $\alpha_0$ and the third subpixel input signal $x_{3-(p',q)}$ to the adjacent pixel may be determined as the third correction signal value $CS_{3-(p,q)}$. It is to be noted that, though not limited specifically, for example, the first constant $K_1$ may be a maximum value capable of being taken by the first subpixel input signal; the second constant $K_2$ may be a maximum value capable of being taken by the second subpixel input signal; and the third constant $K_3$ may be one half (½) of a maximum value capable of being taken by the third subpixel input signal as described hereinabove.

$$CS_{1-(p,q)}=\max(x_{1-(p,q)-2}\cdot\alpha_0-K_1, x_{1-(p',q)}\cdot\alpha_0-K_1) \quad (1\text{-}a_4)$$

$$CS_{2-(p,q)}=\max(x_{2-(p,q)-2}\cdot\alpha_0-K_2, x_{2-(p',q)}\cdot\alpha_0-K_2) \quad (1\text{-}b_4)$$

$$CS_{3-(p,q)}=\max(x_{3-(p,q)-2}\cdot\alpha_0-K_3, x_{3-(p',q)}\cdot\alpha_0-K_3) \quad (1\text{-}c_4)$$

Further, also in the driving method according to the fourth embodiment, for the (p,q)th pixel group, a correction signal value having a maximum value from among the first correction signal value $CS_{1-(p,q)}$, second correction signal value $CS_{2-(p,q)}$ and third correction signal value $CS_{3-(p,q)}$ is determined as a fourth correction signal value $CS_{4-(p,q)}$. In particular, the fourth correction signal value $CS_{4-(p,q)}$ is determined in accordance with $$CS_{4-(p,q)}=c_{17}\cdot\max(CS_{1-(p,q)}, CS_{2-(p,q)}, CS_{3-(p,q)}) \quad (1\text{-}d_4)$$

Then, a fourth subpixel output signal $X_{4-(p,q)}$ is determined from the fourth correction signal value $CS_{4-(p,q)}$ and the fifth correction signal value $CS_{5-(p,q)}$ and output to the fourth subpixel. In particular, as described hereinabove, for example, a correction signal value having a lower value from between the fourth correction signal value $CS_{4-(p,q)}$ and the fifth correction signal value $CS_{5-(p,q)}$ is determined as the fourth subpixel output signal $X_{4-(p,q)}$. More particularly, the fourth subpixel output signal $X_{4-(p,q)}$ may be determined in accordance with $$X_{4-(p,q)}=\min(CS_{4-(p,q)}, CS_{5-(p,q)}) \quad (1\text{-}e_4)$$

or an average value of the fourth correction signal value $CS_{4-(p,q)}$ and the fifth correction signal value $CS_{5-(p,q)}$ may be determined as the fourth subpixel output signal $X_{4-(p,q)}$. More particularly, the fourth subpixel output signal $X_{4-(p,q)}$ may be determined in accordance with $$X_{4-(p,q)}=(CS_{4-(p,q)}+CS_{5-(p,q)})/2 \quad (1\text{-}f_4)$$

or the expression (1-$f_4$) may be expanded such that the fourth subpixel output signal $X_{4-(p,q)}$ is determined in accordance with $$X_{4-(p,q)}=(k_4\cdot CS_{4-(p,q)}+k_5\cdot CS_{5-(p,q)})/(k_4+k_5) \quad (1\text{-}g_4)$$

In the driving method according to the fifth embodiment, for the (p,q)th pixel group, a fifth correction signal value $CS_{5-(p,q)}$ is determined based on the expansion coefficient $\alpha_0$, first, second and third subpixel input signals to the second pixel, and first, second and third subpixel input signals to an adjacent pixel adjacent to second pixel along the second direction. However, the fifth correction signal value $CS_{5-(p,q)}$ may otherwise be determined based at least on the value of Min of the second pixel of the (p,q)th pixel group, the value of Min of the adjacent pixel and the expansion coefficient $\alpha_0$, or may otherwise be determined based at least on a function of Min of the second pixel of the (p,q)th pixel group, a function of Min of the adjacent pixel and the expansion coefficient $\alpha_0$. In particular, the fifth correction signal value $CS_{5-(p,q)}$ can be determined in accordance with the expressions [(2-1-1), (2-1-2)], [(2-2-1), (2-2-2)], [(2-3-1), (2-3-2)], [(2-4-1), (2-4-2)], [(2-5-1), (2-5-2)], [(2-6-1), (2-6-2)] or (2-7), (2-8) given hereinabove.

Further, in the driving method according to the fifth embodiment, for the (p,q)th pixel group:

a first correction signal value $CS_{1-(p,q)}$ is determined based on the expansion coefficient $\alpha_0$, the first subpixel input signal $X_{1-(p,q)-2}$ to the second pixel, a first subpixel input signal $X_{1-(p,q')}$ to an adjacent pixel adjacent to the second pixel along the second direction and a first constant $K_1$;

a second correction signal value $CS_{2-(p,q)}$ is determined based on the expansion coefficient $\alpha_0$, the second subpixel input signal $X_{2-(p,q)-2}$ to the second pixel, a second subpixel input signal $X_{2-(p,q')}$ to the adjacent pixel and a second constant $K_2$; and a third correction signal value $CS_{3-(p,q)}$ is determined based on the expansion coefficient $\alpha_0$, the third subpixel input signal $X_{3-(p,q)-2}$ to the second pixel, a third subpixel input signal $X_{3-(p,q')}$ to the adjacent pixel and a third constant $K_3$. More particularly, as described hereinabove, a higher one of a value determined by subtracting the first constant $K_1$ from the product of the expansion coefficient $\alpha_0$ and the first subpixel input signal $X_{1-(p,q)-2}$ to the second pixel and another value determined by subtracting the first constant $K_1$ from the product of the expansion coefficient $\alpha_0$ and the first subpixel input signal $X_{1-(p,q')}$ to the adjacent pixel may be determined as the first correction signal value $CS_{1-(p,q)}$;

a higher one of a value determined by subtracting the second constant $K_2$ from the product of the expansion coefficient $\alpha_0$ and the second subpixel input signal $X_{2-(p,q)-2}$ to the second pixel and another value determined by subtracting the second constant $K_2$ from the product of the expansion coefficient $\alpha_0$ and the second subpixel input signal $X_{2-(p,q')}$ to the adjacent pixel may be determined as the second correction signal value $CS_{2-(p,q)}$; and a higher one of a value determined by subtracting the third constant $K_3$ from the product of the expansion coefficient $\alpha_0$ and the third subpixel input signal $X_{3-(p,q)-2}$ to the second pixel and another value determined by subtracting the third constant $K_3$ from the product of the expansion coefficient $\alpha_0$ and the third subpixel input signal $X_{3-(p,q')}$ to the adjacent pixel may be determined as the third correction signal value $CS_{3-(p,q)}$. It is to be noted that, though not limited specifically, for example, the first constant $K_1$ may be a maximum value capable of being taken by the first subpixel input signal; the second constant $K_2$ may be a maximum value capable of being taken by the second subpixel input signal; and the third constant $K_3$ may be one half (½) of a maximum value capable of being taken by the third subpixel input signal as described hereinabove.

$$CS_{1-(p,q)}=\max(x_{1-(p,q)-2}\cdot\alpha_0-K_1,x_{1-(p,q)}\cdot\alpha_0-K_1) \quad (1\text{-}a_5)$$

$$CS_{2-(p,q)}=\max(x_{2-(p,q)-2}\cdot\alpha_0-K_2,x_{2-(p,q)}\cdot\alpha_0-K_2) \quad (1\text{-}b_5)$$

$$CS_{3-(p,q)}=\max(x_{3-(p,q)-2}\cdot\alpha_0-K_3,x_{3-(p,q)}\cdot\alpha_0-K_3) \quad (1\text{-}c_5)$$

Also in the driving method according to the fifth embodiment, for the (p,q)th pixel group, a correction signal value having a maximum value from among the first correction signal value $CS_{1-(p,q)}$, second correction signal value $CS_{2-(p,q)}$ and third correction signal value $CS_{3-(p,q)}$ is determined as a fourth correction signal value $CS_{4-(p,q)}$. In particular, the fourth correction signal value $CS_{4-(p,q)}$ is determined in accordance with $$CS_{4-(p,q)}=c_{17}\cdot\max(CS_{1-(p,q)},CS_{2-(p,q)},CS_{3-(p,q)}) \quad (1\text{-}d_5)$$

Then, a fourth subpixel output signal $X_{4-(p,q)}$ is determined from the fourth correction signal value $CS_{4-(p,q)}$ and the fifth correction signal value $CS_{5-(p,q)}$ and output to the fourth subpixel. In particular, as described hereinabove, for example, a correction signal value having a lower value from between the fourth correction signal value $CS_{4-(p,q)}$ and the fifth correction signal value $CS_{5-(p,q)}$ is determined as the fourth subpixel output signal $X_{4-(p,q)}$. More particularly, the fourth subpixel output signal $X_{4-(p,q)}$ may be determined in accordance with $$X_{4-(p,q)}=\min(CS_{4-(p,q)},CS_{5-(p,q)}) \quad (1\text{-}e_5)$$

or an average value of the fourth correction signal value $CS_{4-(p,q)}$ and the fifth correction signal value $CS_{5-(p,q)}$ may be determined as the fourth subpixel output signal $X_{4-(p,q)}$. More particularly, the fourth subpixel output signal $X_{4-(p,q)}$ may be determined in accordance with $$X_{4-(p,q)}=(CS_{4-(p,q)}+CS_{5-(p,q)})/2 \quad (1\text{-}f_5)$$

or the expression (1-$f_5$) may be expanded such that the fourth subpixel output signal $X_{4-(p,q)}$ is determined in accordance with $$X_{4-(p,q)}=(k_4\cdot CS_{4-(p,q)}+k_5\cdot CS_{5-(p,q)})/(k_4+k_5) \quad (1\text{-}g_5)$$

Regarding the second pixel, in the driving method according to the fourth or fifth embodiment, such a configuration may be adopted that, while a first subpixel output signal is determined at least based on a first subpixel input signal and the expansion coefficient $\alpha_0$, the first subpixel output signal having the signal value $X_{1-(p,q)-2}$ is determined at least based on the first subpixel input signal value $x_{1-(p,q)-2}$ and the expansion coefficient $\alpha_0$ as well as the fourth subpixel output signal $X_{4-(p,q)}$, and, while a second subpixel output signal is determined at least based on a second subpixel input signal and the expansion coefficient $\alpha_0$, the second subpixel output signal having the signal value $X_{2-(p,q)-2}$ is determined at least based on the second subpixel input signal $x_{2-(p,q)-2}$ and the expansion coefficient $\alpha_0$ as well as the fourth subpixel output signal $X_{4-(p,q)}$.

Meanwhile, regarding the first pixel, in the driving method according to the fourth or fifth embodiment, such a configuration may be adopted that, while a first subpixel output signal is determined at least based on a first subpixel input signal and the expansion coefficient $\alpha_0$, the first subpixel output signal having the signal value $X_{1-(p,q)-1}$ is determined at least based on the first subpixel input signal value $x_{1-(p,q)-1}$ and the expansion coefficient $\alpha_0$ as well as the fourth subpixel output signal $X_{4-(p,q)}$, or at least based on the first subpixel input signal value $x_{1-(p,q)-1}$ and the expansion coefficient $\alpha_0$ as well as the third subpixel control signal value $SG_{3-(p,q)}$, and while a second subpixel output signal is determined at least based on a second subpixel input signal and the expansion coefficient $\alpha_0$, the second subpixel output signal having the signal value $X_{2-(p,q)-1}$ is determined at least based on the second subpixel input signal value $x_{2-(p,q)-1}$ and the expansion coefficient $\alpha_0$ as well as the fourth subpixel output signal $X_{4-(p,q)}$, or at least based on the second subpixel input signal value $x_{2-(p,q)-1}$ and the expansion coefficient $\alpha_0$ as well as the third subpixel control signal value $SG_{3-(p,q)}$.

More particularly, in the driving method according to the fourth or fifth embodiment, the signal processing section can determine the output signal values $X_{1-(p,q)-2}$, $X_{2-(p,q)-2}$, $X_{1-(p,q)-1}$ and $X_{2-(p,q)-1}$ can be determined in accordance with the following expressions:

$$X_{1-(p,q)-2}=\alpha_0\cdot x_{1-(p,q)-2}-\chi\cdot X_{4-(p,q)} \quad (3\text{-A})$$

$$X_{2-(p,q)-2}=\alpha_0\cdot x_{2-(p,q)-2}-\chi\cdot X_{4-(p,q)} \quad (3\text{-B})$$

$$X_{1-(p,q)-1}=\alpha_0\cdot x_{1-(p,q)-1}-\chi\cdot X_{4-(p,q)} \quad (3\text{-C})$$

$$X_{2-(p,q)-1}=\alpha_0\cdot x_{2-(p,q)-1}-\chi\cdot X_{4-(p,q)} \quad (3\text{-D})$$

or $$X_{1-(p,q)-1}=\alpha_0\cdot x_{1-(p,q)-1}-\chi\cdot SG_{3-(p,q)} \quad (3\text{-E})$$

$$X_{2-(p,q)-1}=\alpha_0\cdot x_{2-(p,q)-1}-\chi\cdot SG_{3-(p,q)} \quad (3\text{-F})$$

Further, the third subpixel output signal of the first pixel, that is, the third subpixel output signal value $X_{3-(p,q)-1}$, can be determined, where $C_{11}$ and $C_{12}$ are constants, for example, in accordance with the following expressions:

$$X_{3-(p,q)-1}=(C_{11}\cdot X'_{3-(p,q)-1}+C_{12}\cdot X'_{3-(p,q)-2})/(C_{11}+C_{12}) \quad (3\text{-a})$$

or $$X_{3-(p,q)-1}=C_{11}\cdot X'_{3-(p,q)-1}+C_{12}\cdot X'_{3-(p,q)-2} \quad (3\text{-b})$$

or else $$X_{3-(p,q)-1}=C_{11}\cdot(X'_{3-(p,q)-1}-X'_{3-(p,q)-2})+C_{12}\cdot X'_{3-(p,q)-2} \quad (3\text{-c})$$

where $$X'_{3-(p,q)-1}=\alpha_0\cdot x_{3-(p,q)-1}-\chi\cdot X_{4-(p,q)} \quad (3\text{-d})$$

$$X'_{3-(p,q)-2}=\alpha_0\cdot x_{3-(p,q)-2}-\chi\cdot X_{4-(p,q)} \quad (3\text{-e})$$

or $$X'_{3-(p,q)-1}=\alpha_0\cdot x_{3-(p,q)-1}-\chi\cdot SG_{3-(p,q)} \quad (3\text{-f})$$

$$X'_{3-(p,q)-2}=\alpha_0\cdot x_{3-(p,q)-2}-\chi\cdot SG_{2-(p,q)} \quad (3\text{-g})$$

In the driving method according to the third or fourth embodiment, where the number of pixels which configure each pixel group is represented by $p_0$, $p_0=2$. Here, the pixel number is not limited to $p_0=2$ but may otherwise be $p_0\geq 3$.

While, in the driving method according to the fourth embodiment, the adjacent pixel is positioned adjacent the (p,q)th second pixel along the first direction, the adjacent pixel may otherwise be the (p,q)th first pixel or else be the (p+1,q)th first pixel.

In the driving method according to the fourth embodiment, such a configuration may be adopted that a first pixel and another first pixel are disposed adjacent each other and a second pixel and another second pixel are disposed adjacent each other in the second direction, or such a configuration may be adopted that a first pixel and a second pixel are disposed adjacent each other in the second direction. Further, preferably the first pixel includes a first subpixel for displaying a first primary color, a second subpixel for displaying a second primary color and a third subpixel for displaying a third primary color, arrayed successively along the first direction, and the second pixel includes a first subpixel for displaying the first primary color, a second subpixel for displaying the second primary color and a fourth subpixel for displaying a fourth primary color, arrayed successively along the first direction. In other words, preferably the fourth subpixel is disposed at a downstream end portion of the pixel group along the first direction. However, the disposition of the fourth subpixel is not limited to this. In particular, any of totaling 6×6=36 different combinations may be selected such as a configuration that the first pixel includes a first subpixel for displaying a first primary color, a third subpixel for displaying a third primary color and a second subpixel for displaying a second primary color, arrayed successively along the first direction, and the second pixel includes a first subpixel for displaying the first primary color, a fourth subpixel for displaying a fourth primary color and a second subpixel for displaying the second primary color, arrayed successively along the first direction. In other words, six combinations are available as arrays of the first, second and third subpixels of the first pixel, and six combinations are available as arrays of the first, second and fourth subpixels of the second pixel. The shape of each subpixel usually is a rectangular shape, preferably each subpixel is disposed such that the major side thereof extends in parallel to the second direction and the minor side thereof extends in parallel to the first direction.

In the driving method according to the second or fifth embodiment, the adjacent pixel positioned adjacent the (p,q) th pixel or the adjacent pixel positioned adjacent the (p,q)th second pixel may be the (p,q−1)th pixel or may be the (p,q+1)th pixel, or may be both of the (p,q−1)th pixel and the (p,q+1)th pixel.

Although the shape of each subpixel usually is a rectangular shape, preferably each subpixel is disposed such that the major side thereof extends in parallel to the second direction and the minor side thereof extends in parallel to the first direction. However, the disposition of the subpixel is not limited to this.

Further, in the embodiments including the preferred configurations and modes described above, such a mode may be adopted that the fourth color is white. However, the fourth color is not limited to this but may be, for example, yellow, cyan or magenta. In those cases, in the case where the image display apparatus is formed from a color liquid crystal display apparatus, it may be configured such that it further includes a first color filter disposed between the first subpixel and an image observer for passing the first primary color therethrough, a second color filter disposed between the second subpixel and the image observer for passing the second primary color therethrough, and a third color filter disposed between the third subpixel and the image observer for passing the third primary color therethrough.

As a light source for configuring a planar light source apparatus, a light emitting element, particularly a light emitting diode (LED), can be used. A light emitting element formed from a light emitting diode has a comparatively small occupying volume, and it is suitable to dispose a plurality of light emitting elements. As the light emitting diode as a light emitting element, a white light emitting diode, for example, a light emitting diode configured from a combination of a purple or blue light emitting diode and light emitting particles so that white light is emitted can be used.

Here, as the light emitting particles, red light emitting phosphor particles, green light emitting phosphor particles and blue light emitting phosphor particles can be used. As a material for configuring the red light emitting phosphor particles, $Y_2O_3$:Eu, $YVO_4$:Eu, Y(P, V)$O_4$:Eu, 3.5MgO.0.5$MgF_2$.$Ge_2$:Mn, $CaSiO_3$:Pb, Mn, $Mg_6AsO_{11}$:Mn, (Sr, Mg)$_3$($PO_4$)$_3$:Sn, $La_2O_2S$:Eu, $Y_2O_2S$:Eu, (ME:EU)S (where "ME" signifies at least one kind of atom selected from a group including Ca, Sr and Ba, and this similarly applies also to the following description), $(M:Sm)_x(Si, Al)_{12}(O, N)_{16}$ (where "M" signifies at least one kind of atom selected from a group including Li, Mg and Ca, and this similarly applies also to the following description), $ME_2Si_5N_8$:Eu, (Ca:Eu)$SiN_2$, and (Ca:Eu)$AlSiN_3$ can be applied. Meanwhile, as a material for configuring the green light emitting phosphor particles, $LaPO_4$:Ce, Tb, $BaMgAl_{10}O_{17}$:Eu, Mn, $Zn_2SiO_4$:Mn, $MgAl_{11}O_{19}$:Ce, Tb, $Y_2SiO_5$:Ce, Tb, $MgAl_{11}O_{19}$:CE, Tb and Mn can be used. Further, (ME:EU)$Ga_2S_4$, $(M:RE)_x(Si, Al)_{12}(O, N)_{16}$ (where "RE" signifies Tb and Yb), $(M:Tb)_x(Si, Al)_{12}(O, N)_{16}$, and $(M:Yb)_x(Si, Al)_{12}(O, N)_{16}$ can be used. Furthermore, as a material for configuring the blue light emitting phosphor particles, $BaMgAl_{10}O_{17}$:Eu, $BaMg_2Al_{16}O_{27}$:Eu, $Sr_2P_2O_7$: Eu, $Sr_5(PO_4)_3Cl$:Eu, (Sr, Ca, Ba, Mg)$_5$($PO_4$)$_3$Cl:Eu, $CaWO_4$ and $CaWO_4$:Pb can be used. However, the light emitting particles are not limited to phosphor particles, and, for example, for a silicon type material of the indirect transition type, light emitting particles can be applied to which a quantum well structure such as a two-dimensional quantum well structure, a one-dimensional quantum well structure (quantum thin line) or zero-dimensional quantum well structure (quantum dot) which uses a quantum effect by localizing a wave function of carriers is applied in order to convert the carries into light efficiently like a material of the direct transition type. Or, it is known that rare earth atoms added to a semiconductor material emit light sharply by transition in a shell, and also light emitting particles which apply such a technique as just described can be used.

Or else, a light source for configuring a planar light source apparatus may be configured from a combination of a red light emitting element such as, for example, a light emitting diode for emitting light of red of a dominant emitted light wavelength of, for example, 640 nm, a green light emitting element such as, for example, a GaN-based light emitting diode for emitting light of green of a dominant emitted light wavelength of, for example, 530 nm, and a blue light emitting element such as, for example, a GaN-based light emitting diode for emitting light of blue of a dominant emitted light wavelength of, for example, 450 nm. A light emitting element which emit fourth color, fifth color . . . that is other than red, green, and blue may be added.

The light emitting diode may have a face-up structure or a flip chip structure. In particular, the light emitting diode is configured from a substrate and a light emitting layer formed on the substrate and may be configured such that light is emitted to the outside from the light emitting layer or light from the light emitting layer is emitted to the outside through the substrate. More particularly, the light emitting diode (LED) has a laminate structure, for example, of a first compound semiconductor layer formed on a substrate and having a first conduction type such as, for example, the n type, an active layer formed on the first compound semiconductor layer, and a second compound semiconductor layer formed on the active layer and having a second conduction type such as, for example, the p type. The light emitting diode includes a first electrode electrically connected to the first compound semiconductor layer, and a second electrode electrically connected to the second compound semiconductor layer. The layers which configure the light emitting diode may be made of known compound semiconductor materials relying upon the emitted light wavelength.

The planar light source apparatus may be formed as any of two different types of planar light apparatus or backlights including a direct planar light source apparatus disclosed, for example, in Japanese Utility Model Laid-Open No. Sho 63-187120 or Japanese Patent Laid-Open No. 2002-277870 and an edge light type or side light type planar light source apparatus disclosed, for example, in Japanese Patent Laid-Open No. 2002-131552.

The direct planar light source apparatus can be configured such that a plurality of light emitting elements each serving as a light source are disposed and arrayed in a housing. However, the direct planar light source apparatus is not limited to this. Here, in the case where a plurality of red light emitting elements, a plurality of green light emitting elements and a plurality of blue light emitting elements are disposed and arrayed in a housing, the following array state of the light emitting elements is available. In particular, a plurality of light emitting element groups each including a red light emitting element, a green light emitting element and a blue light emitting element are disposed continuously in a horizontal direction of a screen of an image display panel such as, for example, a liquid crystal display apparatus to form a light emitting element group array. Further, a plurality of such light emitting element group arrays are juxtaposed continuously in a vertical direction of the screen of the image display panel. It is to be noted that the light emitting element group can be formed in several combinations including a combination of one red light emitting element, one green light emitting element and one blue light emitting element, another combination of one red light emitting element, two green light emitting elements and one blue light emitting element, a further combination of two red light emitting elements, two green light emitting elements and one blue light emitting element, and so forth. It is to be noted that, to each light emitting element, such a light extraction lens as disclosed, for example, in *Nikkei Electronics*, No. 889, Dec. 20, 2004, p. 128 may be attached.

Further, where the direct planar light source apparatus is configured from a plurality of planar light source units, one planer light source unit may be configured from one light emitting element group or from two or more light emitting element groups. Or else, one planar light source unit may be configured from a single white light emitting diode or from two or more white light emitting diodes.

In the case where a direct planar light source apparatus is configured from a plurality of planar light source units, a partition wall may be disposed between the planar light source units. As the material for configuring the partition wall, an impenetrable material by light emitted from a light emitting element provided in the planar light source unit particularly such as an acrylic-based resin, a polycarbonate resin or an ABS resin is applicable. Or, as a material penetrable by light emitted from a light emitting element provided in the planar light source unit, a polymethyl methacrylate resin (PMMA), a polycarbonate resin (PC), a polyarylate resin (PAR), a polyethylene terephthalate resin (PET) or glass can be used. A light diffusing reflecting function may be applied to the surface of the partition wall, or a mirror surface reflecting function may be applied. In order to apply the light diffusing reflecting function to the surface of the partition wall, projections and recesses may be formed on the partition wall surface by sand blasting or a film having projections and recesses, that is, a light diffusing film, may be adhered to the partition wall surface. In order to apply the mirror surface reflecting function to the partition wall surface, a light diffusing film may be adhered to the partition wall surface or a light reflecting layer may be formed on the partition wall surface, for example, by plating.

The direct planar light source apparatus can be configured including a light diffusing plate, an optical function sheet group including a light diffusing sheet, a prism sheet or a light polarization conversion sheet, and a light reflecting sheet. For the light diffusing plate, light diffusing sheet, prism sheet, light polarization conversion sheet and light reflecting sheet, known materials can be used widely. The optical function sheet group may be formed from various sheets disposed in a spaced relationship from each other or laminated in an integrated relationship with each other. For example, a light diffusing sheet, a prism sheet, a light polarization conversion sheet and so forth may be laminated in an integrated relationship with each other. The light diffusing plate and the optical function sheet group are disposed between the planar light source apparatus and the image display panel.

Meanwhile, in the edge light type planar light source apparatus, a light guide plate is disposed in an opposing relationship to an image display panel, particularly, for example, a liquid crystal display apparatus, and light emitting elements are disposed on a side face, a first side face hereinafter described, of the light guide plate. The light guide plate has a first face or bottom face, a second face or top face opposing to the first face, a first side face, a second side face, a third side face opposing to the first side face, and a fourth side face opposing to the second side face. As a more particular shape of the light guide plate, a generally wedge-shaped truncated quadrangular pyramid shape may be applied. In this instance, two opposing side faces of the truncated quadrangular pyramid correspond to the first and second faces, and the bottom face of the truncated quadrangular pyramid corresponds to the first side face. Preferably, projected portions and/or recessed portions are provided on a surface portion of the first face or bottom face. Light is introduced into the light guide plate through the first side face and is emitted from the second face or top face toward the image display panel. The second face of the light guide play may be in a smoothened state, or as a mirror surface, or may be provided with blast embosses which exhibit a light diffusing effect, that is, as a finely roughened face.

Preferably, projected portions and/or recessed portions are provided on the first face or bottom face. In particular, it is preferable to provide the first face of the light guide plate with projected portions or recessed portions or else with projected portions and recessed portions. Where the recessed portions and projected portions are provided, they may be formed continuously or not continuously. The projected portions and/or the recessed portions provided on the first face of the light guide plate may be configured as successive projected portions or recessed portions extending in a direction inclined by a predetermined angle with respect to the incidence direction of light to the light guide plate. With the configuration just described, as a cross sectional shape of the successive projected portions or recessed portions when the light guide plate is cut along a virtual plane extending in the incidence direction of light to the light guide plate and perpendicular to the first face, a triangular shape, an arbitrary quadrangular shape including a square shape, a rectangular shape and a trapezoidal shape, an arbitrary polygon, or an arbitrary smooth curve including a circular shape, an elliptic shape, a parabola, a hyperbola, a catenary and so forth can be applied. It is to be noted that the direction inclined by a predetermined angle with respect to the incidence direction of light to the light guide plate signifies a direction within a range from 60 to 120 degrees in the case where the incidence direction of light to the light guide plate is 0 degree. This similarly applies also in the following description. Or the projected portions and/or the recessed portions provided on the first face of the light guide plate may be configured as non-continuous projected portions and/or recessed portions extending along a direction inclined by a predetermined angle with respect to the incidence direction of light to the light guide plate. In such a configuration as just described, as a shape of the non-continuous projected portions or recessed portions, such various curved faces as a pyramid, a cone, a circular cylinder, a polygonal prism including a triangular prism and a quadrangular prism, part of a sphere, part of a spheroid, part of a paraboloid and part of a hyperboloid can be applied. It is to be noted that, as occasion demands, projected portions or recessed portions may not be formed at peripheral edge portions of the first face of the light guide plate. Further, while light emitted from the light source and introduced into the light guide plate collides with and is diffused by the projected portions or the recessed portions formed on the first face, the height or depth, pitch and shape of the projected portions or recessed portions formed on the first face of the light guide plate may be fixed or may be varied as the distance from the light source increases. In the latter case, for example, the pitch of the projected portions or the recessed portions may be made finer as the distance from the light source increases. Here, the pitch of the projected portions or the pitch of the recessed portions signifies the pitch of the projected portions or the pitch of the recessed portions along the incidence direction of light to the light guide plate.

In a planar light source apparatus which includes a light guide plate, preferably a light reflecting member is disposed in an opposing relationship to the first face of the light guide plate. An image display panel, particularly, for example, a liquid crystal display apparatus, is disposed in a opposing relationship to the second face of the light guide plate. Light emitted from the light source enters the light guide plate through the first side face which corresponds, for example, to the bottom face of the truncated quadrangular pyramid. Thereupon, the light collides with and is scattered by the projected portions or the recessed portions of the first face and then goes out from the first face of the light guide plate, whereafter it is reflected by the light reflecting member and enters the light guide plate through the first face. Thereafter, the light emerges from the second face of the light guide plate and irradiates the image display panel. For example, a light diffusing sheet or a prism sheet may be disposed between the image display panel and the second face of the light guide plate. Or, light emitted from the light source may be introduced directly to the light guide plate or may be introduced indirectly to the light guide plate. In the latter case, for example, an optical fiber may be used.

Preferably, the light guide plate is produced from a material which does not absorb light emitted from the light source very much. In particular, as a material for configuring the light guide plate, for example, glass, a plastic material such as, for example, PMMA, a polycarbonate resin, an acrylic-based resin, an amorphous polypropylene-based resin and a styrene-based resin including an AS resin can be used.

In the present disclosure, the driving method and the driving conditions of a planar light source apparatus are not limited particularly, and the light sources may be controlled collectively. In particular, for example, a plurality of light emitting elements may be driven at the same time. Or, a plurality of light emitting elements may be driven partially or divisionally. In particular, where a planar light source apparatus is configured from a plurality of planar light source units, the planar light source may be configured from S×T planar light source units corresponding to S×T display region units when it is assumed that the display region of the image display panel is virtually divided into the S×T display region units. In this instance, the light emitting state of the S×T planar light source units may be controlled individually.

A driving circuit for driving a planar light source apparatus and an image display panel includes, for example, a planar light source apparatus control circuit configured form a light emitting diode (LED) driving circuit, a determination circuit, a storage device or memory and so forth, and an image display panel driving circuit configured from a known circuit. It is to be noted that a temperature control circuit can be included in the planar light source apparatus control circuit. Control of the luminance of the display region, that is, the display luminance, and the luminance of the planar light source unit, that is, the light source luminance, is carried out for every one image display frame. It is to be noted that the number of image information to be sent for one second as an electric signal to the drive circuit, that is, the number of images per second, is a frame frequency or frame rate, and the reciprocal number of the frame frequency is frame time whose unit is second.

A liquid crystal display apparatus of the transmission type includes, for example, a front panel including a transparent first electrode, a rear panel including a transparent second electrode, and a liquid crystal material disposed between the front panel and the rear panel.

The front panel is configured more particularly from a first substrate formed, for example, from a glass substrate or a silicon substrate, a transparent first electrode also called common electrode provided on an inner face of the first substrate and made of, for example, ITO, and a polarizing film provided on an outer face of the first substrate. Further, the color liquid crystal display apparatus of the transmission type includes a color filter provided on the inner face of the first substrate and coated with an overcoat layer made of an acrylic resin or an epoxy resin. The front panel is further configured such that the transparent first electrode is formed on the overcoat layer. It is to be noted that an orientation film is formed on the transparent first electrode. Meanwhile, the rear panel is configured more particularly from a second substrate formed, for example, from a glass substrate or a silicon substrate, a switching element formed on an inner face of the second substrate, a transparent second electrode also called pixel electrode made of, for example, ITO and controlled between conduction and non-conduction by the switching element, and a polarizing film provided on an outer face of the second substrate. An orientation film is formed over an overall area including the transparent second electrode. Such various members and liquid crystal material which configure liquid crystal display apparatus including a color liquid crystal display apparatus of the transmission type may be configured using known members and materials. As the switching element, for example, such three-terminal elements as a MOS type FET or a thin film transistor (TFT) and two-terminal elements such as a MIM element, a varistor element and a diode formed on a single crystal silicon semiconductor substrate can be used. As a disposition pattern of the color filters, for example, an array similar to a delta array, an array similar to a stripe array, an array similar to a diagonal array and an array similar to a rectangle array are applicable.

In the case where the number $P_0 \times Q_0$ of pixels arrayed in a two-dimensional matrix is represented as $(P_0, Q_0)$, as the value of $(P_0, Q_0)$, several resolutions for image display can be used. Particularly, VGA (640, 480), S-VGA (800, 600), XGA (1,024, 768), APRC (1,152, 900), S-XGA (1,280, 1,024), U-XGA (1,600, 1,200), HD-TV (1,920, 1,080) and Q-XGA (2,048, 1,536) as well as (1,920, 1,035), (720, 480) and (1,280, 960) are available. However, the number of pixels is not limited to those numbers. Further, as the relationship between the value of $(P_0, Q_0)$ and the value of (S, T), such relationships as listed in Table 1 below are available although the relationship is not limited to them. As the number of pixels for configuring one display region unit, 20×20 to 320×240, preferably 50×50 to 200×200, can be used. The numbers of pixels in different display region units may be equal to each other or may be different from each other.

TABLE 1

| | value of S | value of T |
|---|---|---|
| VGA (640, 480) | 2~32 | 2~24 |
| S-VGA (800, 600) | 3~40 | 2~30 |
| XGA (1024, 768) | 4~50 | 3~39 |
| APRC (1152, 900) | 4~58 | 3~45 |
| S-XGA (1280, 1024) | 4~64 | 4~51 |
| U-XGA (1600, 1200) | 6~80 | 4~60 |
| HD-TV (1920, 1080) | 6~86 | 4~54 |
| Q-XGA (2048, 1536) | 7~102 | 5~77 |
| (1920, 1035) | 7~64 | 4~52 |
| (720, 480) | 3~34 | 2~24 |
| (1280, 960) | 4~64 | 3~48 |

As a disposition state of the subpixels, for example, an array similar to a delta array or triangle array, an array similar to a stripe array, an array similar to a diagonal array or mosaic array and an array similar to a rectangle array are applicable. Generally, an array similar to a stripe array is suitable to display data and character strings on a personal computer and so forth. In contrast, an array similar to a mosaic array is suitable to display a natural picture in a video camera recorder, a digital still camera and so forth.

In the driving method of the disclosed technology, a color image display apparatus of the direct type or the projection type and a color image display apparatus of the field sequential type which may be the direct type or the projection type can be used as the image display apparatus. It is to be noted that the number of light emitting elements which configure the image display apparatus may be determined based on specifications demanded for the image display apparatus. Further, the image display apparatus may be configured including a light valve based on specifications demanded for the image display apparatus.

The image display apparatus is not limited to a color liquid crystal display apparatus but may be formed as an organic electroluminescence display apparatus, that is, an organic EL display apparatus, an inorganic electroluminescence display apparatus, that is, an inorganic EL display apparatus, a cold cathode field electron emission display apparatus (FED), a surface conduction type electron emission display apparatus (SED), a plasma display apparatus (PDP), a diffraction grating-light modulation apparatus including a diffraction grating-light modulation element (GLV), a digital micromirror device (DMD), a CRT or the like. Also the color liquid crystal display apparatus is not limited to a liquid crystal display apparatus of the transmission type but may be a liquid crystal display apparatus of the reflection type or a semi-transmission type liquid crystal display apparatus.

WORKING EXAMPLE 1

The working example 1 relates to the driving method according to the first embodiment and the driving method for an image display apparatus assembly according to the first embodiment.

Figure 2A:
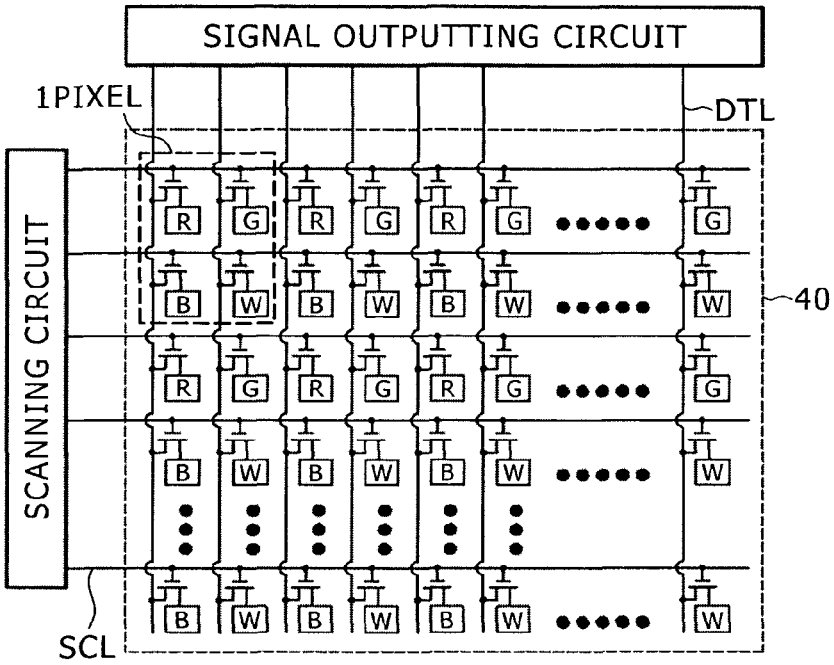
FIGS. 2A and 2B are block diagrams showing different examples of an image display panel and an image display panel driving circuit of the image display apparatus of FIG. 1.
Figure 2B:
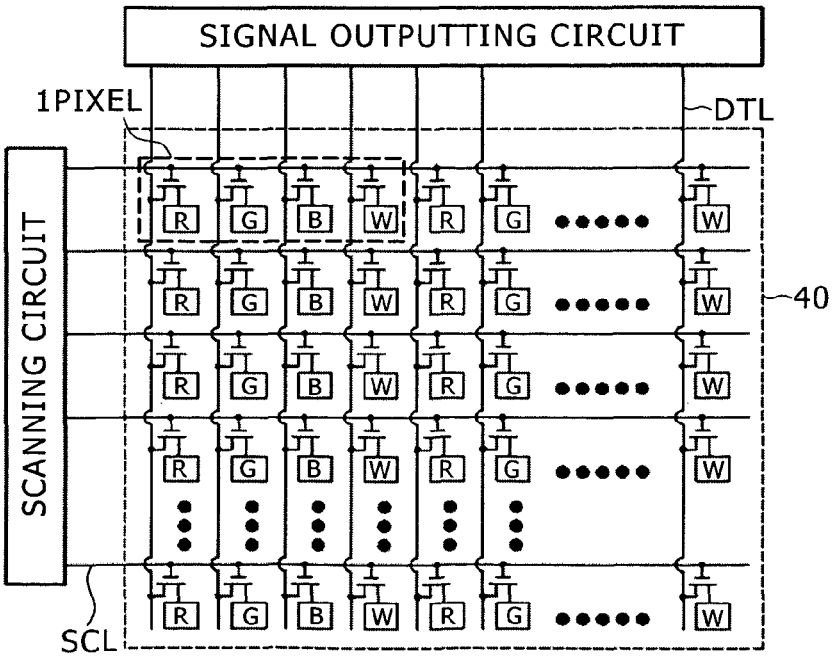

Referring to FIG. 1, the image display apparatus 10 of the working example 1 includes an image display panel 30 and a signal processing section 20. Meanwhile, the image display apparatus assembly of the working example 1 includes the image display apparatus 10, and a planar light source apparatus 50 for illuminating the image display apparatus 10, particularly the image display panel 30, from the rear face side. Referring now to FIGS. 2A and 2B, the image display panel 30 of the working example 1 includes totaling $P_0 \times Q_0$ pixels arrayed in a two-dimensional matrix including $P_0$ pixels arrayed in a first direction, particularly a horizontal direction, and $Q_0$ pixels arrayed in a second direction, particularly a vertical direction. Each of the pixels includes a first subpixel denoted by R for displaying a first primary color such as red, a second subpixel denoted by G for displaying a second primary color such as green, a third subpixel denoted by B for displaying a third primary color such as blue, and a fourth subpixel denoted by W for displaying a fourth color, particularly, white. It is to be noted that, also in the working examples hereinafter described, the first, second, third and fourth colors similarly are red, green, blue and white, respectively.

The image display apparatus of the working example 1 is formed more particularly from a color liquid crystal display apparatus of the transmission type, and the image display panel 30 is formed from a color liquid crystal display panel. The image display panel 30 includes a first color filter disposed between the first subpixels R and an image observer for transmitting the first primary color therethrough, a second color filter disposed between the second subpixels G and the image observer for transmitting the second primary color therethrough, and a third color filter disposed between the third subpixels B and the image observer for transmitting the third primary color therethrough. It is to be noted that no color filter is provided for the fourth subpixels W. Here, the fourth subpixels W may include a transparent resin layer in place of a color filter so that it can be prevented that provision of no color filter gives rise to formation of a large offset on the fourth subpixels W. This similarly applies also to the various working examples hereinafter described.

Further, in the working example 1, in the example shown in FIG. 2A, the first subpixels R, second subpixels G, third subpixels B and fourth subpixels W are arrayed in an array similar to a diagonal array or mosaic array. Meanwhile, in the example shown in FIG. 2B, the first subpixels R, second subpixels G, third subpixels B and fourth subpixels W are arrayed in an array similar to a stripe array.

Referring back to FIG. 1, the signal processing section 20 includes an image display panel driving circuit 40 for driving an image display panel, more particularly a color liquid crystal display panel, and a planar light source apparatus control circuit 60 for driving the planar light source apparatus 50. The image display panel driving circuit 40 includes a signal outputting circuit 41 and a scanning circuit 42. It is to be noted that a switching element such as a TFT (thin film transistor) for controlling operation, that is, the light transmission factor, of each subpixel of the image display panel 30 is controlled between on and off by the scanning circuit 42. Meanwhile, image signals are retained in the signal outputting circuit 41 and successively output to the image display panel 30. The signal outputting circuit 41 and the image display panel 30 are electrically connected to each other by wiring lines DTL, and the scanning circuit 42 and the image display panel 30 are electrically connected to each other by wiring lines SCL. This similarly applies also to the various working examples hereinafter described.

Here, to the signal processing section 20 in the working example 1, regarding a (p,q)th pixel where $1 \le p \le P_0$ and $1 \le q \le Q_0$, a first subpixel input signal having a signal value of $x_{1-(p,q)}$, a second subpixel input signal having a signal value of $x_{2-(p,q)}$ and a third subpixel input signal having a signal value of $x_{3-(p,q)}$ are input. Further, the signal processing section 20 outputs, regarding the pixel $Px_{(p,q)}$, a first subpixel output signal having a signal value $X_{1-(p,q)}$ for determining a display gradation of a first subpixel R, a second subpixel output signal having a signal value $X_{2-(p,q)}$ for determining a display gradation of a second subpixel G, a third subpixel output signal having a signal value $X_{3-(p,q)}$ for determining a display gradation of a third subpixel B, and a fourth subpixel output signal having a signal value $X_{4-(p,q)}$ for determining a display gradation of a fourth subpixel W. This similar applies also to the working example 4.

And, in the working example 1 or the various working examples hereinafter described, the maximum value $V_{max}(S)$ of the brightness which includes, as a variable, the saturation S in the HSV color space expanded by addition of a fourth color, which is white, is stored in the signal processing section 20. In other words, as a result of the addition of the fourth color, which is white, the dynamic range of the brightness in the HSV color space is expanded.

Further, the signal processing section 20 in the working example 1:

determines a first subpixel output signal having the signal value $X_{1-(p,q)}$ at least based on a first subpixel input signal having the signal value $X_{1-(p,q)}$ and an expansion coefficient $\alpha_0$ and outputs the determined signal to the first subpixel R;

determines a second subpixel output signal having the signal value $X_{2-(p,q)}$ at least based on a second subpixel input signal having the signal value $X_{2-(p,q)}$ and the expansion coefficient $\alpha_0$ and outputs the determined signal to the second subpixel G; and determines a third subpixel output signal having the signal value $X_{3-(p,q)}$ at least based on a third subpixel input signal having the signal value $X_{3-(p,q)}$ and the expansion coefficient $\alpha_0$ and outputs the determined signal to the third subpixel B. This similarly applies also to the working example 4.

Particularly, in the working example 1 or the working example 4 hereinafter described, the signal processing section 20 determines the first subpixel output signal at least based on the first subpixel input signal and the expansion coefficient $\alpha_0$ as well as the fourth subpixel output signal;

determines the second subpixel output signal at least based on the second subpixel input signal and the expansion coefficient $\alpha_0$ as well as the fourth subpixel output signal; and determines the third subpixel output signal at least based on the third subpixel input signal and the expansion coefficient $\alpha_0$ as well as the fourth subpixel output signal.

More particularly, in the working example 1 or the working example 4 hereinafter described, where $\chi$ is a constant which depends upon the image display apparatus, the signal processing section 20 can determine the first subpixel output signal value $X_{1-(p,q)}$, second subpixel output signal value $X_{2-(p,q)}$ and third subpixel output signal value $X_{3-(p,q)}$ to the (p,q)th pixel or the set of a first subpixel R, a second subpixel G and a third subpixel B, in accordance with the following expressions:

$$X_{1-(p,q)}=\alpha_0 \cdot x_{1-(p,q)}-\chi \cdot X_{4-(p,q)} \quad (1\text{-A})$$

$$X_{2-(p,q)}=\alpha_0 \cdot x_{2-(p,q)}-\chi \cdot X_{4-(p,q)} \quad (1\text{-B})$$

$$X_{3-(p,q)}=\alpha_0 \cdot x_{3-(p,q)}-\chi \cdot X_{4-(p,q)} \quad (1\text{-C})$$

In the working example 1 or the working examples 2 to 10 hereinafter described, the signal processing section 20 further (a) determines a maximum value $V_{max}(S)$ of brightness taking a saturation S in an HSV color space enlarged by adding the fourth color as a variable;

(b) determines the saturation S and the brightness V(S) of a plurality of pixels based on subpixel input signal values to the plural pixels; and (c) determines the expansion coefficient $\alpha_0$ based on at least one of values of $V_{max}(S)/V(S)$ determined with regard to the plural pixels;

Here, the saturation S and the brightness V(S) are represented respectively by $$S=(\text{Max}-\text{Min})/\text{Max}$$

$$V(S)=\text{Max}$$

and the saturation S can assume a value ranging from 0 to 1, and the brightness V(S) can assume a value ranging from 0 to $2^n-1$. Further, n is a display gradation bit number. Further, Max: a maximum value of three subpixel input signal values including the first, second and third subpixel input signal values to the pixel, and Min: a minimum value of three subpixel input signal values including the first, second and third subpixel input signal values to the pixel.

This similarly applies also in the following description.

It is to be noted that, although, in the working example 1, a minimum value $\alpha_{min}$ from among values of $V_{max}(S)/V(S)$ [$\equiv\alpha(S)$] determined with regard to a plurality of pixels is determined as the expansion coefficient $\alpha_0$, the expansion coefficient $\alpha_0$ is not limited to this.

And, in the working example 1, for each of the pixels:

a first correction signal value $CS_{1-(p,q)}$ is determined based on the expansion coefficient $\alpha_0$, the first subpixel input signal $x_{1-(p,q)}$ and a first constant $K_1$;

a second correction signal value $CS_{2-(p,q)}$ is determined based on the expansion coefficient $\alpha_0$, the second subpixel input signal $x_{2-(p,q)}$ and a second constant $K_2$; and a third correction signal value $CS_{3-(p,q)}$ is determined based on the expansion coefficient $\alpha_0$, the third subpixel input signal $x_{3-(p,q)}$ and a third constant $K_3$.

Particularly, the first correction signal value $CS_{1-(p,q)}$ is determined by subtracting the first constant $K_1$ from the product of the expansion coefficient $\alpha_0$ and the first subpixel input signal $x_{1-(p,q)}$;

the second correction signal value $CS_{2-(p,q)}$ is determined by subtracting the second constant $K_2$ from the product of the expansion coefficient $\alpha_0$ and the second subpixel input signal $x_{2-(p,q)}$; and the third correction signal value $CS_{3-(p,q)}$ is determined by subtracting the third constant $K_3$ from the product of the expansion coefficient $\alpha_0$ and the third subpixel input signal $x_{3-(p,q)}$. It is to be noted that the first constant $K_1$ is a maximum value capable of being taken by the first subpixel input signal; the second constant $K_2$ is a maximum value capable of being taken by the second subpixel input signal; and the third constant $K_3$ is a maximum value capable of being taken by the third subpixel input signal.

$$CS_{1-(p,q)}=x_{1-(p,q)}\cdot\alpha_0-K_1 \quad (1\text{-}a_1)$$

$$CS_{2-(p,q)}=x_{2-(p,q)}\cdot\alpha_0-K_2 \quad (1\text{-}b_1)$$

$$CS_{3-(p,q)}=x_{3-(p,q)}\cdot\alpha_0-K_3 \quad (1\text{-}c_1)$$

Then, for each pixel, a correction signal value having a maximum value from among the first correction signal value $CS_{1-(p,q)}$, second correction signal value $CS_{2-(p,q)}$ and third correction signal value $CS_{3-(p,q)}$ is determined as a fourth correction signal value $CS_{4-(p,q)}$. In particular, the fourth correction value is determined in accordance with $$CS_{4-(p,q)}=c_{17}\cdot\max(CS_{1-(p,q)},CS_{2-(p,q)},CS_{3-(p,q)}) \quad (1\text{-}d_1)$$

Further, for each pixel, the fifth correction signal value $CS_{5-(p,q)}$ is determined based on the expansion coefficient $\alpha_0$, first subpixel input signal, second subpixel input signal and third correction signal value. Particularly, the fifth correction signal value $CS_{5-(p,q)}$ is determined at least based on the value of Min and the expansion coefficient $\alpha_0$. More particularly, the fifth correction signal value $CS_{5-(p,q)}$ is determined, for example, in accordance with the expression given below. It is to be noted that $c_{11}$ is determined to be $c_{11}=1$.

$$CS_{5-(p,q)}=c_{11}(\mathrm{Min}_{(p,q)})\cdot\alpha_0 \quad (1\text{-}1)$$

Then, for each of the pixels, a fourth subpixel output signal $X_{4-(p,q)}$ is determined from the fourth correction signal value $CS_{4-(p,q)}$ and the fifth correction signal value $CS_{5-(p,q)}$ and output to the fourth subpixel W. Particularly, the fourth subpixel output signal $X_{4-(p,q)}$ is determined in accordance with the expression (11) given below. It is to be noted that, while, in the expression (11), the right side of the expression (1-$e_1$) includes division of $[\min(CS_{4-(p,q)}, CS_{5-(p,q)})$ by $\chi$, the right side is not limited to this. Further, the expansion coefficient $\alpha_0$ is determined for each one image display frame. This similarly applies also to the various embodiments hereinafter described.

$$X_{4-(p,q)}=[\min(CS_{4-(p,q)},CS_{5-(p,q)})]/\chi \quad (11)$$

The following description is given in this regard.

Figure 3A:
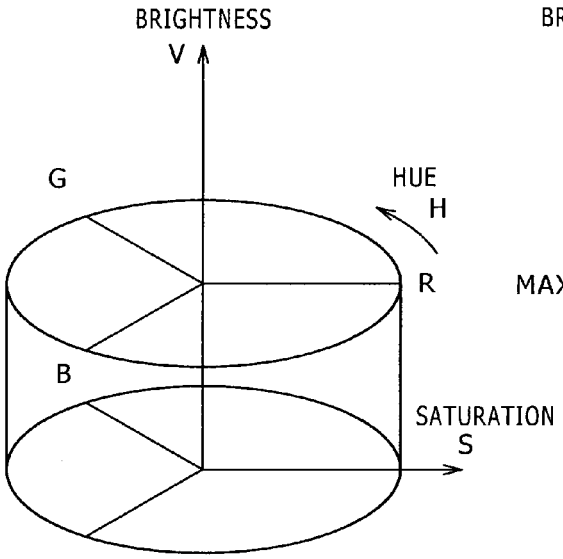
FIGS. 3A and 3B are diagrammatic views of a popular HSV color space of a circular cylinder schematically illustrating a relationship between the saturation S and the brightness V(S) and FIGS. 3C and 3D are diagrammatic views of an expanded HSV color space of a circular cylinder in the working example 1 schematically illustrating a relationship between the saturation S and the brightness V(S)
Figure 3B:
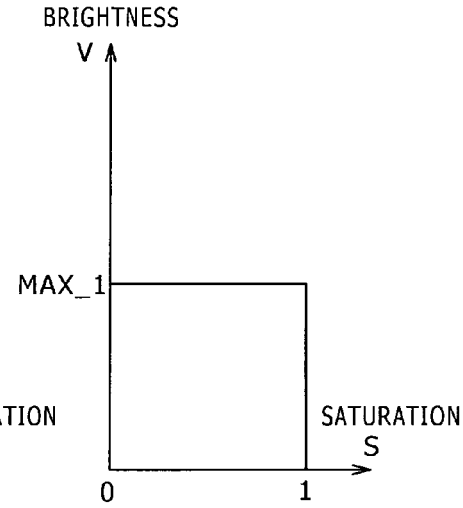

Generally, in regard to the (p,q)th pixel, the saturation $S_{(p,q)}$ and the brightness $V(S)_{(p,q)}$ in an HSV color space of a circular cylinder can be determined from the expressions (12-1) and (12-2) based on the first subpixel input signal having the signal value $x_{1-(p,q)}$, second subpixel input signal having the signal value $x_{2-(p,q)}$ and third subpixel input signal having the signal value $x_{3-(p,q)}$. It is to be noted that the HSV color space of a circular cylinder is schematically illustrated in FIG. 3A, and a relationship between the saturation S and the brightness V(S) is schematically illustrated in FIG. 3B. It is to be noted that, in FIG. 3B, and FIGS. 3D, 4A and 4B hereinafter referred to, the value of the brightness $(2^n-1)$ is represented by "MAX_1," and the value of the brightness $(2^n-1)\times(\chi+1)$ is represented by "MAX_2."

$$S_{(p,q)}=(\mathrm{Max}_{(p,q)}-\mathrm{Min}_{(p,q)})/\mathrm{Max}_{(p,q)} \quad (12\text{-}1)$$

$$V(S)_{(p,q)}=\mathrm{Max}_{(p,q)} \quad (12\text{-}2)$$

where $\mathrm{Max}_{(p,q)}$ is a maximum value among three subpixel input signal values of $x_{1-(p,q)}$, $x_{2-(p,q)}$ and $x_{3-(p,q)}$, and $\mathrm{Min}_{(p,q)}$ is a minimum value among the three subpixel input signal values of $x_{1-(p,q)}$, $x_{2-(p,q)}$ and $x_{3-(p,q)}$. In the working example 1, n is determined to be n=8. In other words, the display gradation bit number is 8 bits, and consequently, the value of the display gradation ranges particularly from 0 to 255. This similarly applies also to the working examples hereinafter described.

Figure 3C:
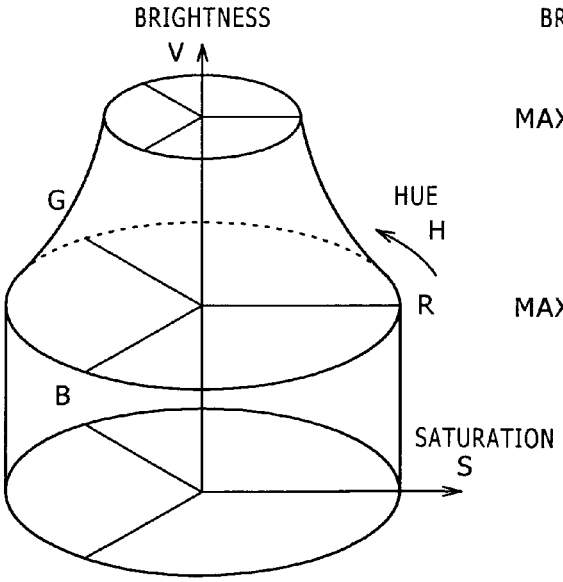
Figure 3D:
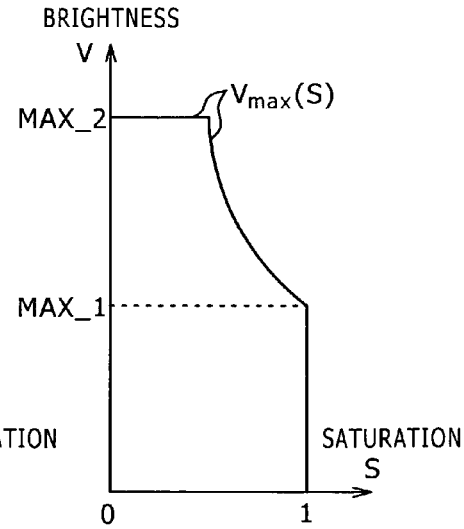

FIGS. 3C and 3D schematically illustrate an expanded HSV color space of a circular cylinder expanded by addition of a fourth color, which is white, in the first example 1 and a relationship between the saturation S and the brightness V(S), respectively. Here, The fourth subpixel W for displaying white does not have a color filter disposed therefor. Here, it is assumed that the luminance of a set of a first pixel R, a second subpixel G and a third subpixel B which configure a pixel (in the working examples 1 to 4) or a pixel group (in the working examples 5 to 10) when a signal having a value corresponding to a maximum signal value of the first subpixel output signal is input to the first subpixel R and a signal having a value corresponding to a maximum signal value of the second subpixel output signal is input to the second subpixel G and besides a signal having a value corresponding to a maximum signal value of the third subpixel output signal is input to the third subpixel B is represented by $BN_{1-3}$ and the luminance of the fourth subpixel W when a signal having a value corresponding to a maximum signal value of the fourth subpixel output signal is input to the fourth subpixel W which configures the pixel (in the working examples 1 to 4) or the pixel group (in the working examples 5 to 10) is represented by $BN_4$. In other words, white of the maximum luminance is displayed by the set of the first subpixel R, second subpixel G and third subpixel B, and the luminance of this white is $BN_{1-3}$. In this instance, when $\chi$ is a constant which relies upon the image display apparatus, the constant $\chi$ can be represented as below.

$$\chi=BN_4/BN_{1-3}$$

In particular, the luminance $BN_4$ when it is assumed that an input signal having the value 255 of the display gradation is input to the fourth subpixel W is, for example, as high as 1.5 times the luminance $BN_{1-3}$ of white when input signals having values of the display gradation given as $$x_{1-(p,q)}=255(=K_1)$$

$$x_{2-(p,q)}=255(=K_2)$$

$$x_{3-(p,q)}=255(=K_3)$$

are input to the set of the first subpixel R, second subpixel G and third subpixel B. In particular, in the working example 1, the constant $\chi$ is determined as below.

$$\chi=1.5$$

Incidentally, in the case where the signal value $X_{4-(p,q)}$ is represented by the expression (11) given hereinabove, $V_{max}$ (S) can be represented by the following expression.

In the case where $S\leq S_0$, $$V_{max}(S)=(\chi+1)\cdot(2^n-1) \quad (13\text{-}1)$$

while, in the case where $S_0<S\leq 0$, $$V_{max}(S)=(2^n-1)\cdot(1/S) \quad (13\text{-}2)$$

where $$S_0=1/(\chi+1)$$

The maximum value $V_{max}(S)$ of the brightness obtained in this manner and using the saturation S in the HSV color space expanded by the addition of a fourth color as a variable is stored, for example, as a kind of lookup table in the signal processing section 20 or is determined every time by the signal processing section 20.

In the following, a method of determining the output signal values $X_{1-(p,q)}$, $X_{2-(p,q)}$, $X_{3-(p,q)}$ and $X_{4-(p,q)}$ of the (p,q)th pixel, that is, an expansion process, is described. It is to be noted that the following process is carried out so as to keep the ratio among the luminance of the first primary color displayed by the first subpixel R+fourth subpixel W, the luminance of the second primary color displayed by the second subpixel G+fourth subpixel W and the luminance of the third primary color displayed by the third subpixel B+fourth subpixel W. Besides, the process is carried out so as to keep or maintain the color tone as far as possible. Furthermore, the process is carried out so as to keep or maintain the gradation-luminance characteristic, that is, the gamma characteristic or γ characteristic.

Further, in the case where all of the input signal values in some pixel or some pixel group are equal to "0" or very low, such pixel or pixel group may be excluded to determine the expansion coefficient $\alpha_0$. This similarly applies also to the working examples hereinafter described.

Step 100

First, the signal processing section 20 determines the saturation S and the brightness V(S) of a plurality of pixels based on subpixel input signal values to the plural pixels. In particular, the signal processing section 20 determines the saturations $S_{(p,q)}$ and $V(S)_{(p,q)}$ from the expressions (12-1) and (12-2), respectively, based on the first subpixel input signal value $x_{1-(p,q)}$, second subpixel input signal value $x_{2-(p,q)}$ and third subpixel input signal value $x_{3-(p,q)}$ to the (p,q)th pixel. This process is carried out for all pixels.

Step 110

Then, the signal processing section 20 determines the expansion coefficient α(S) based at least on one of the values of $V_{max}(S)/V(S)$ determined with regard to the plural pixels.

$$\alpha(S)=V_{max}(S)/V(S) \tag{14}$$

Then, the signal processing section 20 determines a minimum value of the expansion coefficient α(S) determined with regard to the plural pixels, in the working example 1, all of the $P_0 \times Q_0$ pixels, as the expansion coefficient $\alpha_0$. However, the expansion coefficient $\alpha_0$ is not limited to this, but various examinations may be carried out to determine an optimum expansion coefficient $\alpha_0$.

Figure 4A:
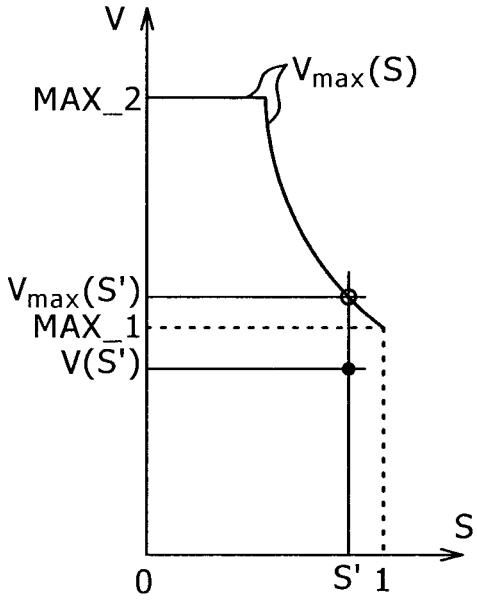
FIGS. 4A and 4B are diagrammatic views schematically illustrating a relationship of the saturation S and the brightness V(S) in an HSV color space of a circular cylinder expanded by adding a fourth color, which is, white, in the working example 1.
Figure 4B:
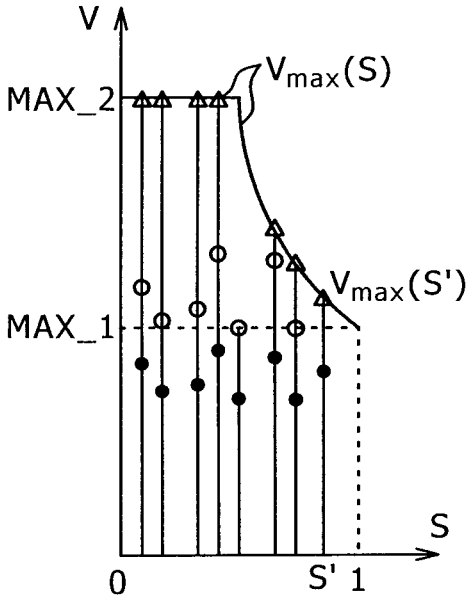

In FIGS. 4A and 4B which schematically illustrate a relationship between the saturation S and the brightness V(S) in the HSV color space of a circular cylinder expanded by the addition of the fourth color or white in the working example 1, the value of the saturation S at which $\alpha_0$ is provided is indicated by "S'," and the brightness V(S) at the saturation S' is indicated by "V(S')" while $V_{max}(S)$ at the saturation S' is indicated by "$V_{max}(S')$." Further, in FIG. 4B, V(S) is indicated by a solid round mark and $V(S)\times\alpha_0$ is indicated by a blank round mark, and $V_{max}(S)$ of the saturation S is indicated by a blank triangular mark.

It is to be noted that the processes at step 100 to step 110 are executed similarly also in the working examples 2 to 10 hereinafter described.

Step 120

Then, the signal processing section 20 determines the signal value $X_{4-(p,q)}$ of the (p,q)th pixel. In particular, the signal processing section 20 determines the signal value $X_{4-(p,q)}$ of the (p,q)th pixel in accordance with the expressions (1-$a_1$), (1-$b_1$), (1-$c_1$), (1-$d_1$), (1-1) and (11). It is to be noted that the signal value $X_{4-(p,q)}$ is determined with regard to all of the $P_0 \times Q_0$ pixels. Further, the signal value $X_{1-(p,q)}$ of the (p,q)th pixel is determined based on the signal value $x_{1-(p,q)}$, expansion coefficient $\alpha_0$ and signal value $X_{4-(p,q)}$; the signal value $X_{2-(p,q)}$ of the (p,q)th pixel is determined based on the signal value $x_{2-(p,q)}$, expansion coefficient $\alpha_0$ and signal value $X_{4-(p,q)}$; and the signal value $X_{3-(p,q)}$ of the (p,q)th pixel is determined based on the signal value $x_{3-(p,q)}$, expansion coefficient $\alpha_0$ and signal value $X_{4-(p,q)}$. In particular, the signal value $X_{1-(p,q)}$, signal value $X_{2-(p,q)}$ and signal value $X_{3-(p,q)}$ of the (p,q)th pixel are determined in accordance with the following expressions:

$$CS_{1-(p,q)}=x_{1-(p,q)}\cdot\alpha_0-K_1 \tag{1-a$_1$}$$

$$CS_{2-(p,q)}=x_{2-(p,q)}\cdot\alpha_0-K_2 \tag{1-b$_1$}$$

$$CS_{3-(p,q)}=x_{3-(p,q)}\cdot\alpha_0-K_3 \tag{1-c$_1$}$$

$$CS_{4-(p,q)}=c_{17}\cdot\max(CS_{1-(p,q)},CS_{2-(p,q)},CS_{3-(p,q)}) \tag{1-d$_1$}$$

$$CS_{5-(p,q)}=c_{11}(\mathrm{Min}_{(p,q)})\cdot\alpha_0 \tag{1-1}$$

$$X_{4-(p,q)}=[\min(CS_{4-(p,q)},CS_{5-(p,q)})]/\chi \tag{11}$$

$$X_{1-(p,q)}=\alpha_0\cdot x_{1-(p,q)}-\chi\cdot X_{4-(p,q)} \tag{1-A}$$

$$X_{2-(p,q)}=\alpha_0\cdot x_{2-(p,q)}-\chi\cdot X_{4-(p,q)} \tag{1-B}$$

$$X_{3-(p,q)}=\alpha_0\cdot x_{3-(p,q)}-\chi\cdot X_{4-(p,q)} \tag{1-C}$$

Figure 24A:
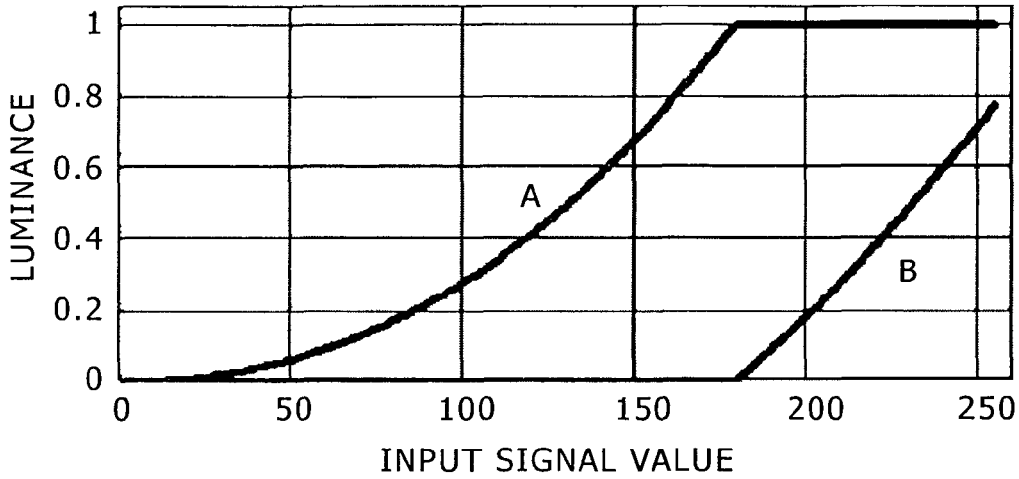
FIGS. 24A and 24B are graphs illustrating different examples of a function for determining a fourth sub pixel output signal in the working example 1.

A graph of FIG. 24A illustrates a relationship among a maximum luminance indicated by "A" from among the first, second and third subpixels when the fourth subpixel output signal $X_{4-(p,q)}$ is determined in accordance with the expression (11), the luminance of the fourth subpixel indicated by "B" and the input signal value. It is to be noted that the axis of ordinate in FIGS. 24A and 24B indicates the normalized value of the luminance, and the axis of abscissa indicates the input signal value. In the case where the maximum value from among the input signal value to the first, second or third subpixel is equal to or lower than a certain value, since the right side of the expression (11) is zero, the luminance of the fourth subpixel is zero. Then, if the maximum value of the input signal value of the first, second or third subpixel exceeds the certain value, then since the right side of the expression (11) exhibits a value higher than zero, the luminance of the fourth subpixel exhibits a value higher than zero.

Figure 24B:
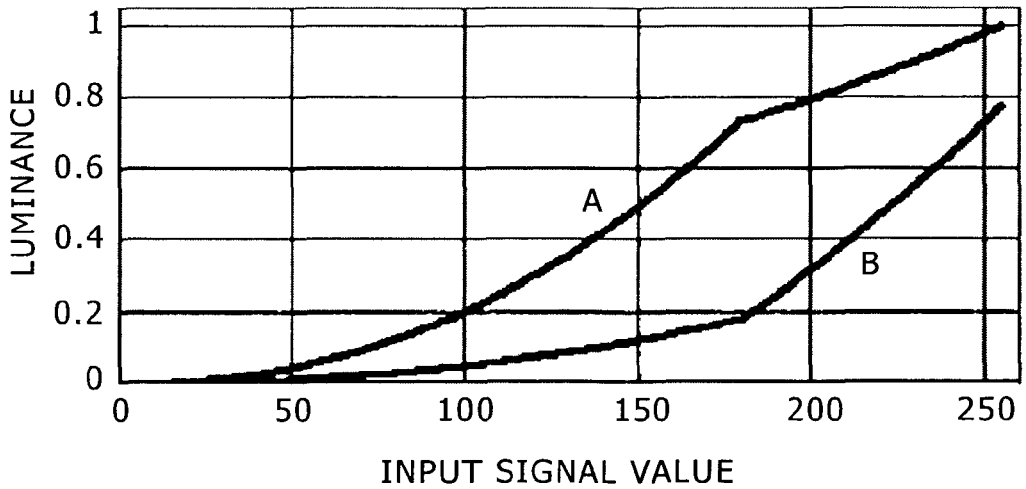

In the case where the signal value $X_{4-(p,q)}$ is based on $$X_{4-(p,q)}=(CS_{4-(p,q)}+CS_{5-(p,q)})/2 \tag{1-f$_1$}$$

a graph of FIG. 24B illustrates a relationship among a maximum luminance indicated by "A" from among the first, second and third subpixels when the fourth subpixel output signal $X_{4-(p,q)}$ is determined in accordance with the expression (1-$f_1$), the luminance of the fourth subpixel indicated by "B" and the input signal value. In the graph of FIG. 24B, different from the graph of FIG. 24A, since the right side of the expression (11) is always different from 0, the luminance of the fourth subpixel exhibits a value higher than zero.

Figure 5:
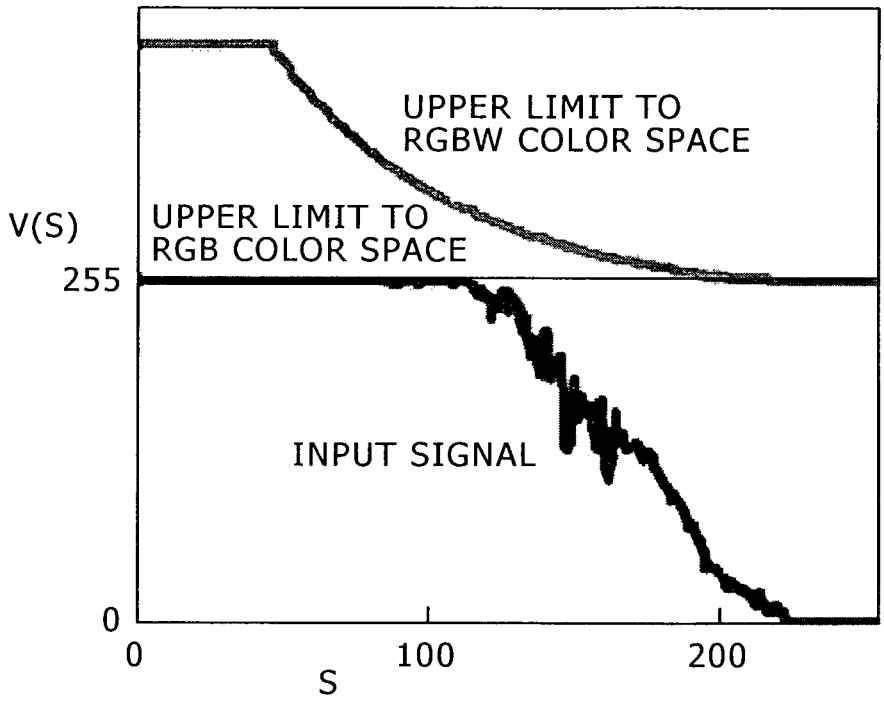
FIG. 5 is a view illustrating an existing HSV color space before the fourth color of white is added in the working example 1, an HSV color space expanded by addition of the fourth color of white and a relationship between the saturation S and the brightness V(S) of an input signal.
Figure 6:
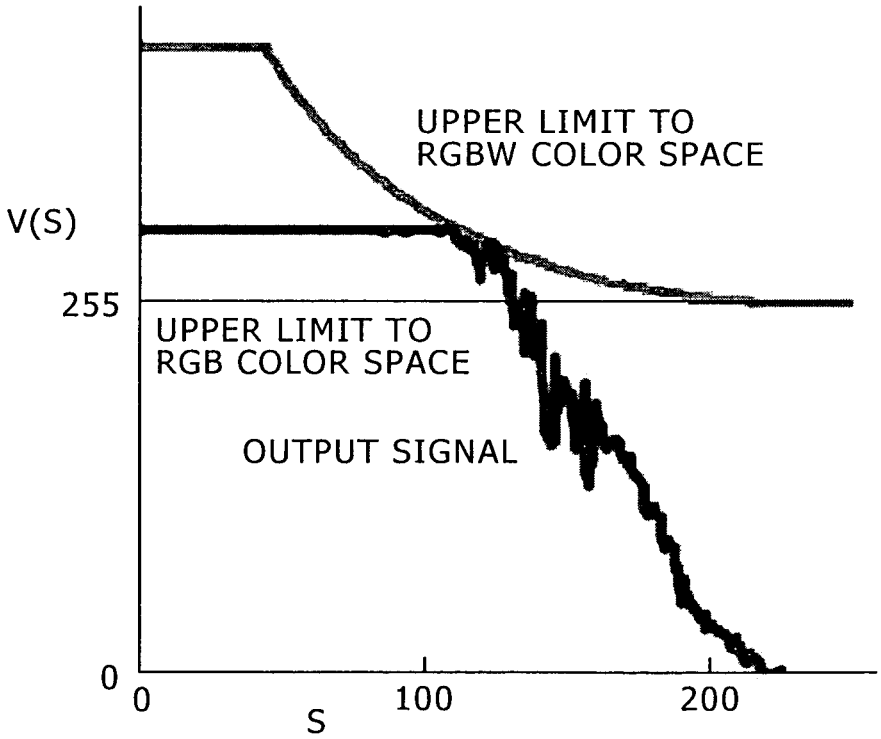
FIG. 6 is a view illustrating an existing HSV color space before the fourth color of white is added in the working example 1, an HSV color space expanded by addition of the fourth color of white and a relationship between the saturation S and the brightness V(S) of an output signal which is in a decompressed form.

FIG. 5 illustrates an example of an existing HSV color space before the fourth color or white is added in the working example 1, an HSV color space expanded by addition of the fourth color or white and a relationship of the saturation S and the brightness V(S) of an input signal. Further, FIG. 6 illustrates an example of the existing HSV color space before the fourth color or white is added in the working example 1, the HSV color space expanded by addition of the fourth color or white and a relationship of the saturation S and the brightness V(S) of an output signal in a state in which an expansion process is applied. It is to be noted that, although the value of the saturation S on the axis of abscissa in FIGS. 5 and 6 originally remains within the range from 0 to 1, in FIGS. 5 and 6, they are indicated in a form multiplied by 255.

What is significant here resides in that the value of the subpixel input signal value of the first term of the right side is expanded by $\alpha_0$ as seen from the expressions $(1-a_1)$, $(1-b_1)$ and $(1-C_1)$. In particular, in comparison with that in an alternative case in which the value of the subpixel input signals is not expanded, the luminance is increased to $\alpha_0$ times by the expansion of the value of the subpixel input signals by $\alpha_0$. By the expansion of the value of the subpixel input signals by $\alpha_0$ in this manner, the luminance of the red displaying subpixel, green displaying subpixel and blue displaying subpixel, that is, the first subpixel R, second subpixel G and blue subpixel B, increases. However, the value of the red displaying subpixel, green displaying subpixel and blue displaying subpixel cannot exceed a maximum value which can be taken by the subpixel input signals. Accordingly, as seen from the expressions $(1-a_1)$, $(1-b_1)$ and $(1-c_1)$, the maximum value capable being taken by the subpixel input signals is subtracted from the product of the value of the subpixel input signal value and the expansion coefficient $\alpha_0$. If the value of the right side of the expressions $(1-a_1)$, $(1-b_1)$ and $(1-c_1)$ assumes a positive value, then it is necessary for such a subpixel to display with luminance of a value higher than that of the maximum luminance. However, since the subpixel cannot display with luminance of a value higher than that of the maximum luminance, it is possible for the subpixel to cooperate with the fourth subpixel to display with luminance of a value higher than that of the maximum luminance.

Then, from the expressions $(1-a_1)$, $(1-b_1)$ and $(1-c_1)$, the fourth correction signal value $CS_{4-(p,q)}$ is determined based on the expression $(1-d_1)$. Further, the fifth correction signal, value $CS_{5-(p,q)}$ is determined, for example, in accordance with the expression (1-1).

In other words, the fourth correction signal value $CS_{4-(p,q)}$ is a maximum value from among the values of the red displaying subpixel, green displaying subpixel and blue displaying subpixel having a value exceeding a maximum value which can be taken by the subpixel input signals. By setting the fourth correction signal value $CS_{4-(p,q)}$ to a maximum value in this manner, the luminance of the subpixel which is the brightest from among the red displaying subpixel, green displaying subpixel and blue displaying subpixel can be replaced by the luminance of the fourth subpixel. It is to be noted that, in the case where none of the red displaying subpixel, green displaying subpixel and blue displaying subpixel exceeds a maximum value which can be taken by the subpixel input signals, the fourth correction signal value $CS_{4-(p,q)}$ exhibits a negative value. On the other hand, the fifth correction signal value $CS_{5-(p,q)}$ is equal to a value obtained by multiplying the value of the luminance of the subpixel which is darkest from among the red displaying subpixel, green displaying subpixel and blue displaying subpixel by $\alpha_0$.

Further, the fourth subpixel output signal value $X_{4-(p,q)}$ is determined in accordance with the expression (11).

In particular, a lower one of two values including the value of the luminance of the fourth subpixel to be replaced by the luminance of the subpixel which is brightest from among the red displaying subpixel, green displaying subpixel and blue displaying subpixel and the value obtained by multiplexing the luminance of the subpixel which is darkest from among the red displaying subpixel, green displaying subpixel and blue displaying subpixel by $\alpha_0$ is adopted as the fourth subpixel output signal value $X_{4-(p,q)}$. Accordingly, such a case sometimes occurs that the value of the fourth subpixel output signal value $X_{4-(p,q)}$ is lower than a value obtained by multiplying the value of the luminance of the subpixel which is darkest from among the red displaying subpixel, green displaying subpixel and blue displaying subpixel by $\alpha_0$. Therefore, the luminance of the fourth subpixel is suppressed as low as possible so that the luminance of the first, second and third subpixels can be increased.

The output signal values $X_{1-(p,q)}$, $X_{2-(p,q)}$, $X_{3-(p,q)}$ and $X_{4-(p,q)}$ output when values indicated in Table 3, Table 5 and Table 7 given below are input as input signal values $x_{1-(p,q)}$, $x_{2-(p,q)}$ and $x_{3-(p,q)}$ where $\chi=1.5$ and $2^n-1=255$, are indicated below. Further, where the values of $\alpha_0$, $x_{1-(p,q)}$, $x_{1-(p,q)}$ and $x_{1-(p,q)}$ are such as those in Table 2, Table 4 and Table 6 given below, the values of the terms of the expressions $(1-a_1)$ $(1-b_1)$ and $(1-c_1)$ are such as indicated in Table 3, Table 5 and Table 7 given below.

TABLE 2

| |
|---|
| $\alpha_0 = 1.5$ |
| $(x_{1-(p,q)}, x_{1-(p,q)}, x_{1-(p,q)}) = (200, 200, 200)$ |

TABLE 3

| | $x_{(p,q)}$ | $x_{(p,q)} \cdot \alpha_0$ | $CS_{(p,q)}$ |
|---|---|---|---|
| First subpixel | 200 | 300 | 45 |
| Second subpixel | 200 | 300 | 45 |
| Third subpixel | 200 | 300 | 45 |

Accordingly, from Table 2 and Table 3

$$CS_{4-(p,q)}=\max(45,45,45)=45$$

where $c_{17}=1$. Meanwhile, $$CS_{5-(p,q)}=200\times1.5=300$$

Therefore, $$\min(CS_{4-(p,q)},CS_{5-(p,q)})=\min(45,300)=45$$

and the value of $X_{4-(p,q)}$ is given as $$X_{4-(p,q)}=45/\chi$$

On the other hand, $$X_{1-(p,q)}=1.5\cdot200-45=255$$

$$X_{2-(p,q)}=1.5\cdot200-45=255$$

$$X_{3-(p,q)}1.5\cdot200-45=255$$

TABLE 4

| |
|---|
| $\alpha_0 = 1.5$ |
| $(x_{1-(p,q)}, x_{1-(p,q)}, x_{1-(p,q)}) = (200, 160, 80)$ |

TABLE 5

| | $x_{(p,q)}$ | $x_{(p,q)} \cdot \alpha_0$ | $CS_{(p,q)}$ |
|---|---|---|---|
| First subpixel | 200 | 300 | 45 |
| Second subpixel | 160 | 240 | −15 |
| Third subpixel | 80 | 120 | −135 |

Accordingly, from Table 4 and Table 5

$$CS_{4-(p,q)}=\max(45,-15,-135)=45$$

Meanwhile, $$CS_{5-(p,q)}=80\times1.5=120$$

Therefore, $$\min(CS_{4-(p,q)},CS_{5-(p,q)})=\min(45,120)=45$$

and the value of $X_{4-(p,q)}$ is given as $$X_{4-(p,q)}=45/\chi$$

On the other hand, $$X_{1-(p,q)}=1.5\cdot 200-45=255$$

$$X_{2-(p,q)}=1.5\cdot 160-45=195$$

$$X_{3-(p,q)}=1.5\cdot 80-45=75$$

TABLE 6

| |
|---|
| $\alpha_0 = 1.5$ |
| $(x_{1-(p,q)}, x_{1-(p,q)}, x_{1-(p,q)}) = (100, 80, 50)$ |

TABLE 7

| | $x_{(p,q)}$ | $x_{(p,q)} \cdot \alpha_0$ | $CS_{(p,q)}$ |
|---|---|---|---|
| First subpixel | 100 | 150 | −105 |
| Second subpixel | 80 | 120 | −135 |
| Third subpixel | 60 | 90 | −165 |

Accordingly, from Table 6 and Table 7, because the maximum value of $CS_{4-(p,q)}$ is negative value, $$CS_{4-(p,q)}=\min(-105,-135,-165)=0$$

Meanwhile, $$CS_{5-(p,q)}=60\times 1.5=90$$

Therefore, $$\min(CS_{4-(p,q)},CS_{5-(p,q)})=\min(0,90)=0$$

and the value of $X_{4-(p,q)}$ is given as $$X_{4-(p,q)}=0$$

On the other hand, $$X_{1-(p,q)}=1.5\cdot 100-0=150$$

$$X_{2-(p,q)}=1.5\cdot 80-0=120$$

$$X_{3-(p,q)}=1.5\cdot 60-0=90$$

In this manner, in the image display apparatus assembly and the driving method for the image display apparatus assembly of the working example 1, the luminance of the fourth subpixel can be suppressed as low as possible to increase the luminance of the first, second and third subpixels. Therefore, the image display apparatus becomes less likely to be influenced by the color of emitted light of the planar light source and less likely to suffer from color displacement. Or, occurrence of such a problem that, when the gradation becomes low, the color purity degrades can be suppressed.

Besides, in the image display apparatus assembly and the driving method for the image display apparatus assembly of the working example 1, the signal values $X_{1-(p,q)}$, $X_{2-(p,q)}$ and $X_{3-(p,q)}$ of the (p,q) th pixel are expanded to $\alpha_0$ times, and besides, increase of the luminance is achieved by the signal value $X_{4-(p,q)}$. Therefore, in order to obtain a luminance of an image equal to the luminance of an image which is not in an expanded state, the luminance of the planar light source apparatus 50 may be decreased based on the expansion coefficient $\alpha_0$. In particular, the luminance of the planar light source 50 may be decreased to $1/\alpha_0$ time. By the decrease, reduction of the power consumption of the planar light source apparatus can be achieved.

Figure 7A:
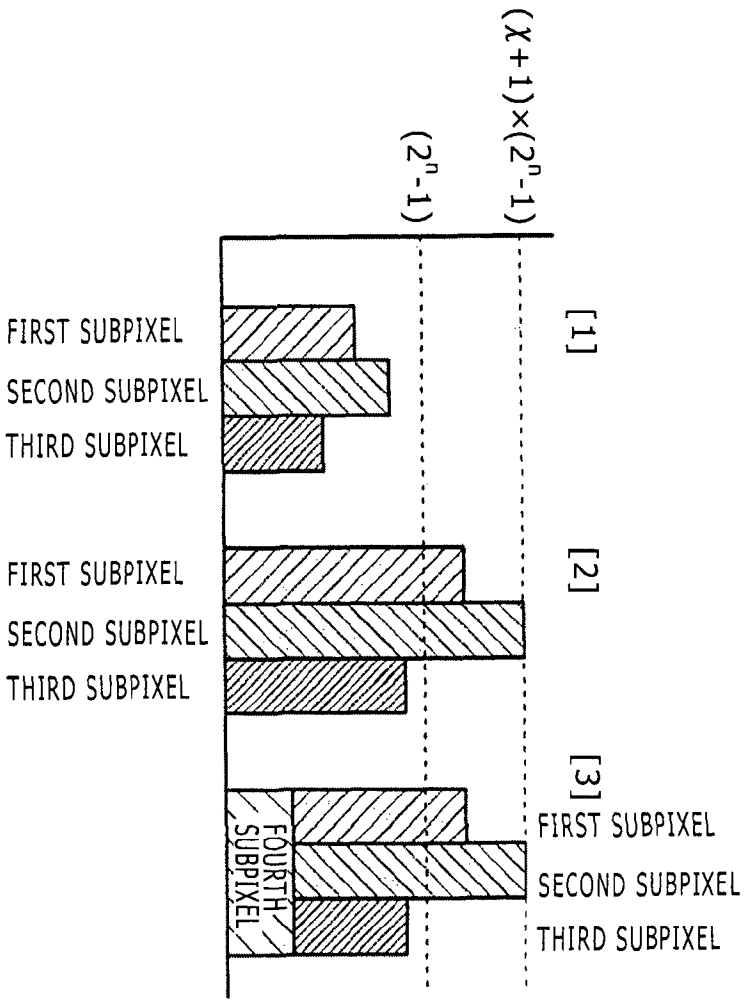
FIGS. 7A and 7B are diagrammatic views schematically illustrating input signal values and output signal values and illustrating a difference between an expansion process in a driving method of the image display apparatus of the working example 1 and a driving method of an image display apparatus assembly and the processing method disclosed in Japanese Patent No. 3805150.
Figure 7B:
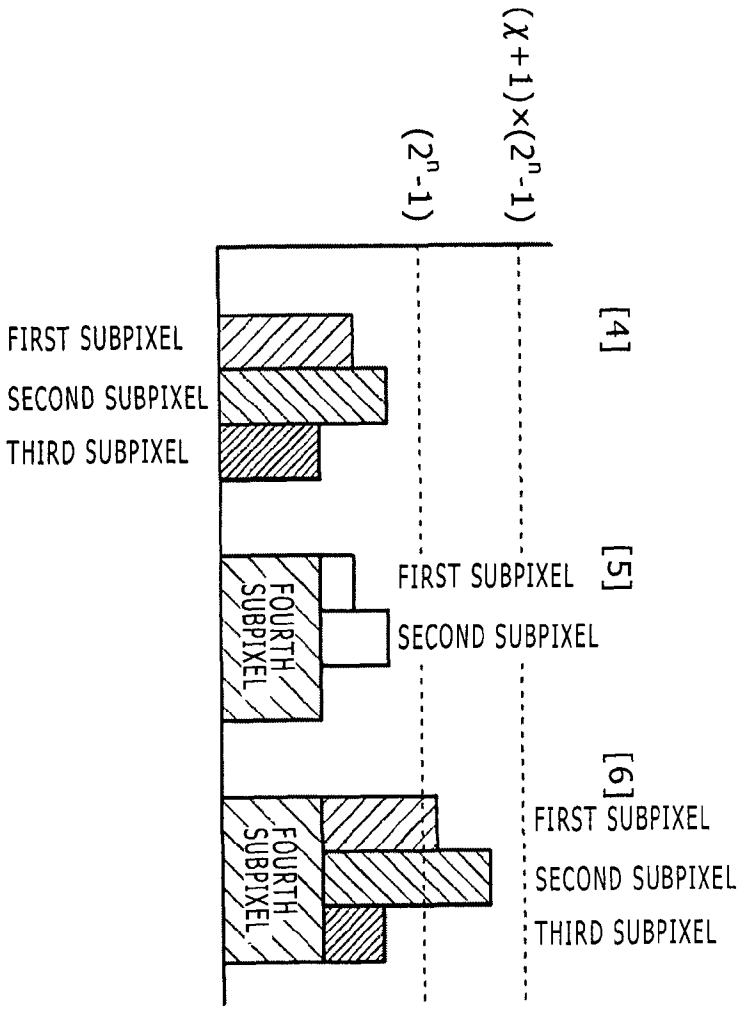

Here, a difference between the expansion process in the driving method of the image display apparatus and driving method of the image display apparatus assembly of the working example 1 and the processing method disclosed in Japanese Patent No. 3805150 mentioned hereinabove is described with reference to FIGS. 7A and 7B. FIGS. 7A and 7B schematically illustrate input signal values and output signal values in the driving method of the image display apparatus and driving method of the image display apparatus assembly of the working example 1 and the processing method disclosed in Japanese Patent No. 3805150. In the example of FIG. 7A, the input signal values to the set of the first subpixel R, second subpixel G and third subpixel B are indicated by [1]. Meanwhile, those values in a state in which an expansion process, that is, an operation of determining the product of an input signal value and the expansion coefficient $\alpha_0$, is being carried out are indicated by [2]. Further, those in a state after an expansion process is carried out, that is, in a state in which the output signal values $X_{1-(p,q)}$, $X_{2-(p,q)}$, $X_{3-(p,q)}$ and $X_{4-(p,q)}$ are obtained, are indicated by [3]. On the other hand, the input signal values to the set of the first subpixel R, second subpixel G and third subpixel B in the processing method disclosed in Japanese Patent No. 3805150 are indicated by [4]. It is to be noted that the input signal values mentioned are same as those indicated in [1] of FIG. 7A. Further, the digital values Ri, Gi and Bi of the red displaying subpixel, green displaying subpixel and blue displaying subpixel and the digital value W for driving the luminance subpixel are indicated in [5]. Furthermore, results of determination of the values of Ro, Go, Bo and W are indicated by [6]. From FIGS. 7A and 7B, in the driving method of the image display apparatus and driving method of the image display apparatus assembly of the working example 1, a maximum luminance which can be implemented is obtained by the second subpixel G. On the other hand, it can be seen that, in the processing method disclosed in Japanese Patent No. 3805150, a maximum luminance which can be implemented is not reached by the second subpixel G. In this manner, the driving method of the image display apparatus and driving method of the image display apparatus assembly of the working example 1 can implement image display of a higher luminance in comparison with the processing method disclosed in Japanese Patent No. 3805150.

It is to be noted that basically the driving method itself according to the first embodiment described in connection with the working example 1 can be applied also to the working examples described below. Accordingly, in the description of the working examples given below, description of the driving method according to the first embodiment described in connection with the working example 1 is omitted. Thus, the description given below is directed only to subpixels which configure a pixel, a relationship between an input signal and an output signal to a subpixel, and differences from the working example 1.

WORKING EXAMPLE 2

The working example 2 is a modification to the working example 1. For the planar light source apparatus, although an existing planar light source apparatus of the direct type may be adopted, in the working example 2, a planar light source apparatus 150 of the divisional driving type, that is, of the partial driving type, described hereinbelow is adopted. It is to be noted that the expansion process itself may be similar to that described hereinabove in connection with the working example 1.

Figure 8:
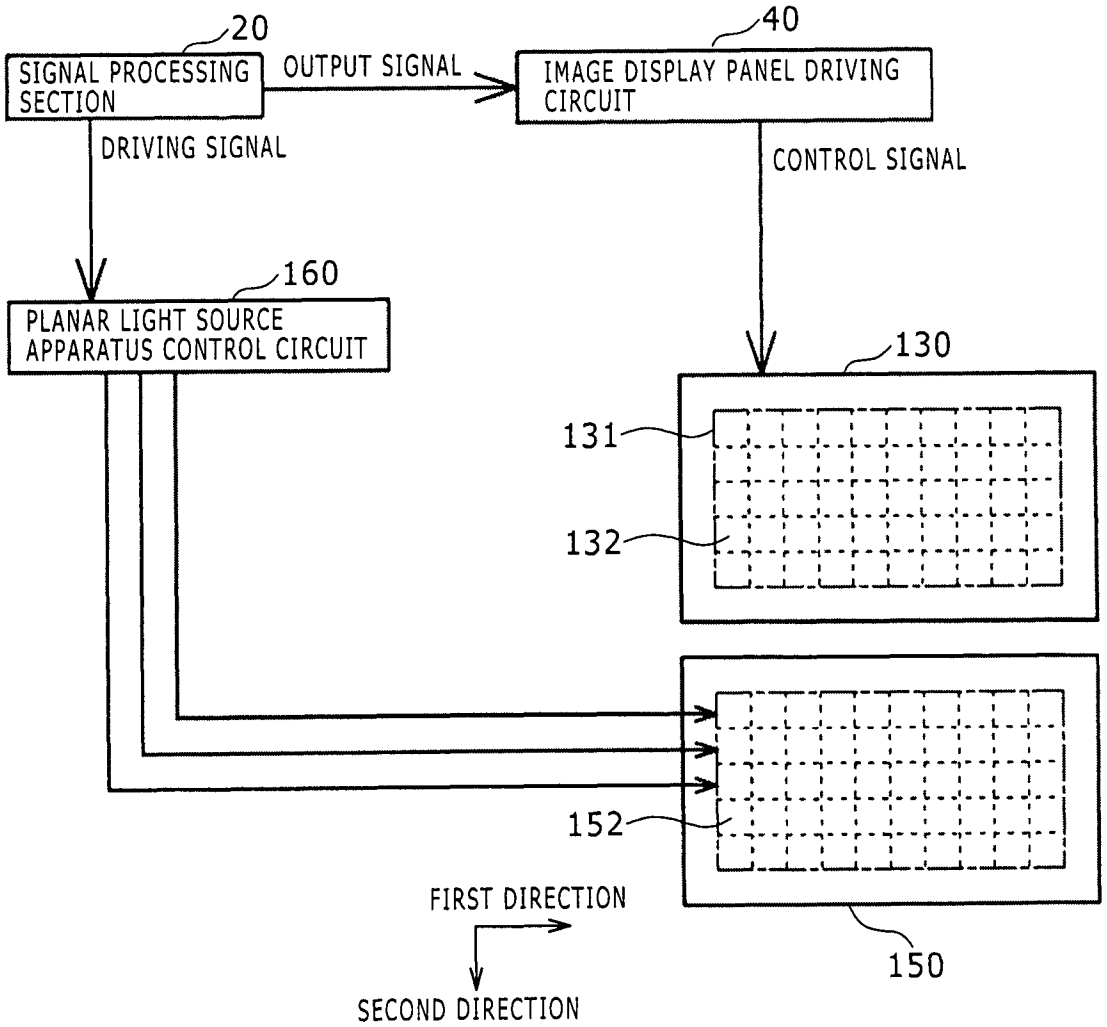
FIG. 8 is a block diagram of an image display panel and a planar light source apparatus which configure an image display apparatus assembly according to a working example 2 of the present disclosure.
Figure 9:
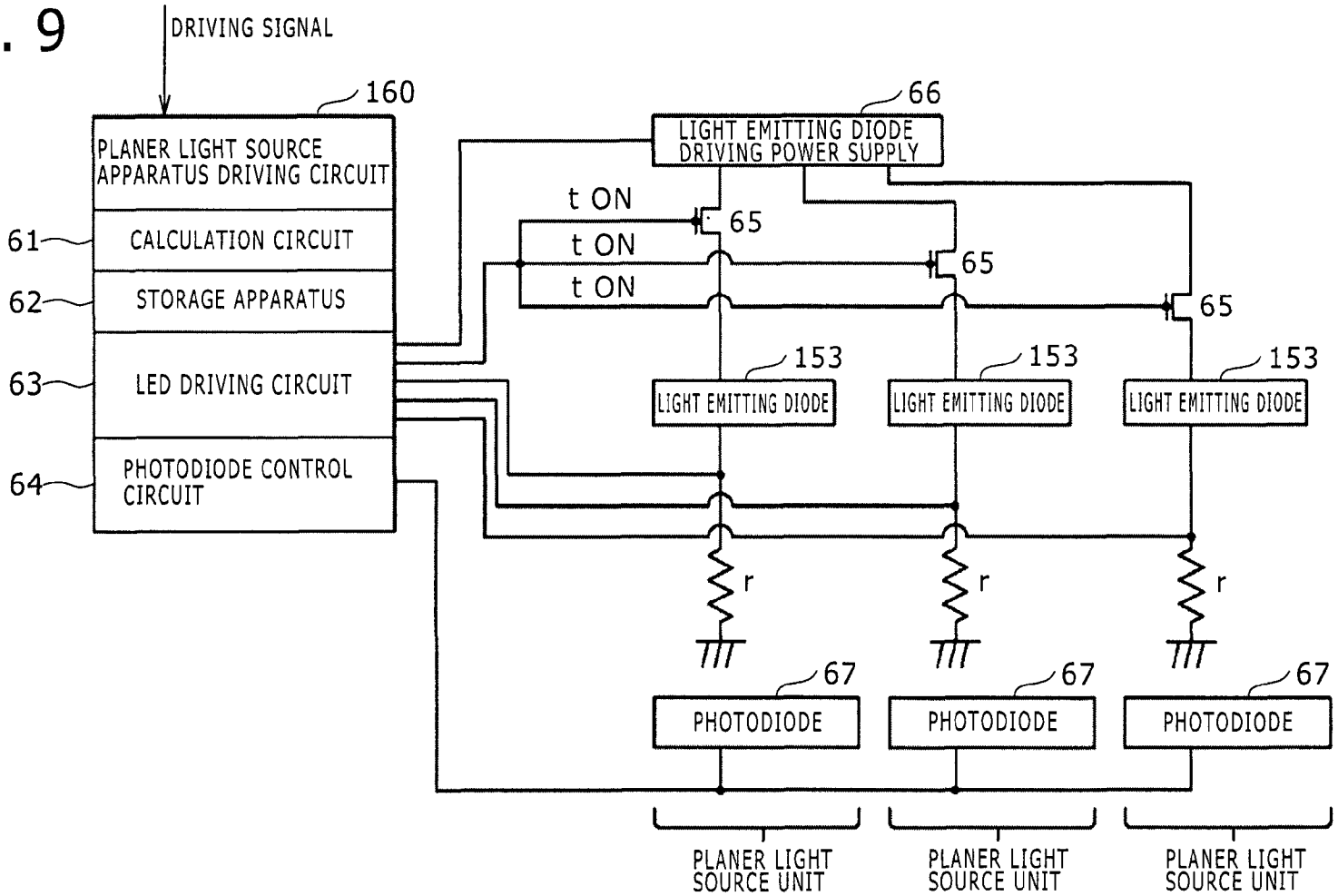
FIG. 9 is a block circuit diagram of a planar light source apparatus control circuit of the planar light source apparatus of the image display apparatus assembly of the working example 2.
Figure 10:
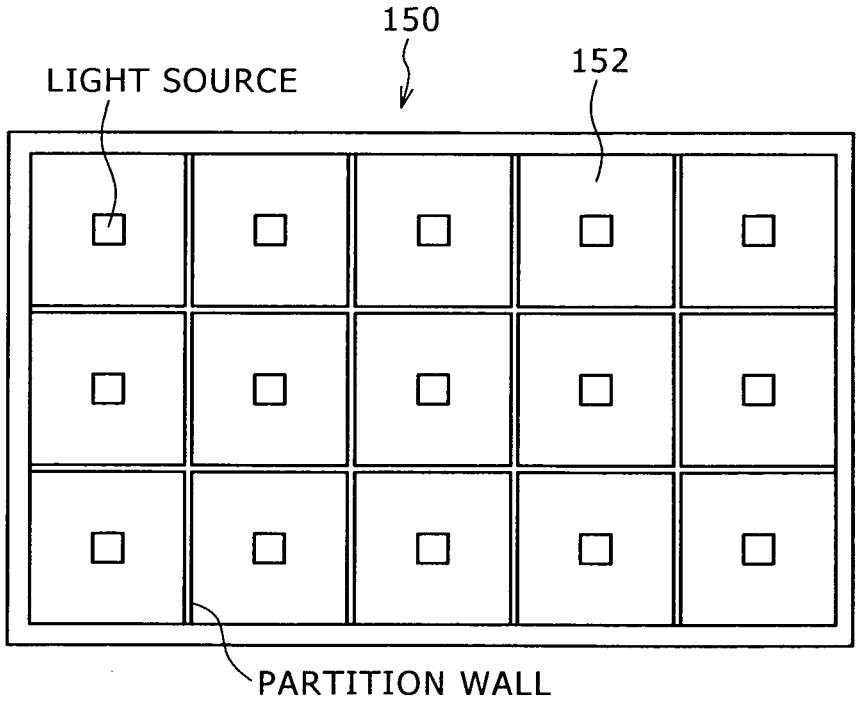
FIG. 10 is a view schematically illustrating an arrangement and array state of planar light source units and so forth of the planar light source apparatus of the image display apparatus assembly of the working example 2.

An image display panel and a planar light source apparatus which configure the image display apparatus assembly of the working example 2 are schematically shown in FIG. 8, and a circuit diagram of a planar light source apparatus control circuit of the planar light source apparatus which configures the image display apparatus assembly is shown in FIG. 9. Further, an arrangement and array state of a planar light source unit and so forth of the planar light source apparatus which configures the image display apparatus assembly is schematically illustrated in FIG. 10.

The planar light source apparatus 150 of the divisional driving type is formed from S×T planar light source units 152 which correspond, in the case where it is assumed that a display region 131 of an image display panel 130 which configures a color liquid crystal display apparatus is divided into S×T virtual display region units 132, to the S×T display region units 132. The light emission state of the S×T planar light source units 152 is controlled individually.

Referring to FIG. 8, the image display panel 130 which is a color liquid crystal display panel includes the display region 131 in which totaling P×Q pixels are arrayed in a two-dimensional matrix including P pixels disposed along the first direction and Q pixels disposed along the second direction. Here, it is assumed that the display region 131 is divided into S×T virtual display region units 132. Each of the display region units 132 includes a plurality of pixels. In particular, if the image displaying resolution satisfies the HD-TV standard and the number P×Q of pixels arrayed in a two-dimensional matrix is represented by (P, Q), then the number of pixels is (1920, 1080). Further, the display region 131 configured from pixels arrayed in a two-dimensional matrix and indicated by an alternate long and short dash line in FIG. 8 is divided into S×T virtual display region units 132 boundaries between which are indicated by broken lines. The value of (S, T) is, for example, (19, 12). However, for simplified illustration, the number of display region units 132, and also of planar light source units 152 hereinafter described, in FIG. 8 is different from this value. Each of the display region units 132 includes a plurality of pixels, and the number of pixels which configure one display region unit 132 is, for example, approximately 10,000. Usually, the image display panel 130 is line-sequentially driven. More particularly, the image display panel 130 has scanning electrodes extending along the first direction and data electrodes extending along the second direction such that they cross with each other like a matrix. A scanning signal is input from a scanning circuit to the scanning electrodes to select and scan the scanning electrodes while data signals or output signals are input to the data electrodes from a signal outputting circuit so that the image display panel 130 displays an image based on the data signal to form a screen image.

The planar light source apparatus or backlight 50 of the direct type includes S×T planar light source units 152 corresponding to the S×T virtual display region unit 132, and the planar light source units 152 illuminates the display region units 132 corresponding thereto from the rear face side. Light sources provided in the planar light source units 152 are controlled individually. It is to be noted that, while the planar light source apparatus 150 is positioned below the image display panel 130, in FIG. 8, the image display panel 130 and the planar light source apparatus 150 are shown separately from each other.

While the display region 131 configured from pixels arrayed in a two-dimensional matrix is divided in to the S×T display region units 132, this state can be regarded such that, if it is represented with "row" and "column," then it is considered that the display region 131 is divided into the display region units 132 disposed in T rows×S columns. Further, although the display region unit 132 is configured from a plurality of ($M_0$×$N_0$) pixels, if this state is represented with "row" and "column," then it is considered that the display region unit 132 is configured from the pixels disposed in $N_0$ rows×$M_0$ columns.

An arrangement and disposition array state of the planar light source units 152 and so forth of the planar light source apparatus 150 is illustrated in FIG. 10. Each light source is formed from a light emitting diode 153 which is driven based on a pulse width modulation (PWM) controlling method. Increase or decrease of the luminance of the planar light source unit 152 is carried out by increasing or decreasing control of the duty ratio in pulse width modulation control of the light emitting diode 153 which configures each planar light source unit 152. Illuminating light emitted from the light emitting diode 153 goes out from the planar light source unit 152 through a light diffusion plate and successively passes through an optical functioning sheet group including a light diffusion plate, a prism sheet and a polarized light conversion sheet (all not shown) until it illuminates the image display panel 130 from the rear side. One light sensor which is a photodiode 67 is disposed in each planar light source unit 152. The photodiode 67 measures the luminance and the chromaticity of the light emitting diode 153.

Referring to FIGS. 8 and 9, a planar light source apparatus driving circuit 160 for driving the planar light source units 152 based on a planar light source apparatus control signal or driving signal from the signal processing section 20 carries out on/off control of the light emitting diode 153 which configures each planar light source unit 152. The planar light source apparatus driving circuit 160 includes a calculation circuit 61, a storage device or memory 62, an LED driving circuit 63, a photodiode control circuit 64, a switching element 65 formed from an FET, and a light emitting diode driving power supply 66 which is a constant current source. The circuit elements which configure the planar light source apparatus driving circuit 160 may be known circuit elements.

The light emission state of each light emitting diode 153 in a certain image displaying frame is measured by the corresponding photodiode 67, and an output of the photodiode 67 is input to the photodiode control circuit 64 and is converted into data or a signal representative of, for example, a luminance and a chromaticity of the light emitting diode 153 by the photodiode control circuit 64 and the calculation circuit 61. The data is sent to the LED driving circuit 63, by which the light emission state of the light emitting diode 153 in a next image displaying frame is controlled with the data. In this manner, a feedback mechanism is formed.

A resistor r for current detection is inserted in series to the light emitting diode 153 on the downstream of the light emitting diode 153, and current flowing through the resistor r is converted into a voltage. Then, operation of the light emitting diode driving power supply 66 is controlled under the control of the LED driving circuit 63 so that the voltage drop across the resistor r may exhibit a predetermined value. While FIG. 9 shows that one light emitting diode driving power supply 66 serving as a constant current source is shown provided, actually such light emitting diode driving power supplies 66 are disposed for driving individual ones of the light emitting diodes 153. It is to be noted that three planar light source units 152 are shown in FIG. 9. While FIG. 9 shows the configuration wherein one light emitting diode 153 is provided in one planar light source unit 152, the number of light emitting diodes 153 which configure one planar light source unit 152 is not limited to one.

Each pixel is configured from four kinds of subpixels including a first subpixel R, a second subpixel G, a third subpixel B and a fourth subpixel W. Here, control of the luminance, that is, luminance control, of each subpixel is carried out by 8-bit control so that the luminance is controlled among $2^8$ stages of 0 to 255. In addition, also a value PS of pulse modulation output signal for controlling the light emission time period of each light emitting diode 153 which configures the planar light source unit 152 is controlled among $2^8$ stages of 0 to 255. However, the number of stages of the luminance is not limited to this, and the luminance control may be carried out by 10-bit control such that the luminance is controlled among $2^{10}$ of 0 to 1,023. In this instance, the representation of a numerical value of 8 bits may be, for example, multiplied by four.

Following definitions are applied to the light transmission factor (also called numerical aperture) $L_t$ of a subpixel, the luminance y, that is, display luminance, of a portion of the display region which corresponds to the subpixel and the luminance Y of the planar light source unit 152, that is, the light source luminance. $Y_1$: for example, a maximum luminance of the light source luminance, and this luminance is hereinafter referred to sometimes as light source luminance first prescribed value.

$Lt_1$: for example, a maximum value of the light transmission factor or numerical aperture of a subpixel of the display region unit 132, and this value is hereinafter referred to sometimes as light transmission factor first prescribed value.

$Lt_2$: a transmission factor or numerical aperture of a subpixel when it is assumed that a control signal corresponding to the display region unit signal maximum value $X_{max-(s,t)}$ which is a maximum value among values of an output signal of the signal processing section 20 input to the image display panel driving circuit 40 in order to drive all subpixels of the display region unit 132 is supplied to the subpixel, and the transmission factor or numerical aperture is hereinafter referred to sometimes as light transmission factor second prescribed value. It is to be noted that the transmission factor second prescribed value $Lt_2$ satisfies $0 \leq Lt_2 \leq Lt_1$.

$y_2$: a display luminance obtained when it is assumed that the light source luminance is the light source luminance first prescribed value $Y_1$ and the light transmission factor or numerical aperture of a subpixel is the light transmission factor second prescribed value $Lt_2$, and the display luminance is hereinafter referred to sometimes as display luminance second prescribed value.

$Y_2$: a light source luminance of the planar light source unit 152 for making the luminance of a subpixel equal to the display luminance second prescribed value $y_2$ when it is assumed that a control signal corresponding to the display region unit signal maximum value $X_{max-(s,t)}$ is supplied to the subpixel and besides it is assumed that the light transmission factor or numerical aperture of the subpixel at this time is corrected to the light transmission factor first prescribed value $Lt_1$. However, the light source luminance $Y_2$ may be corrected taking an influence of the light source luminance of each planar light source unit 152 upon the light source luminance of any other planar light source unit 152 into consideration.

Figure 11A:
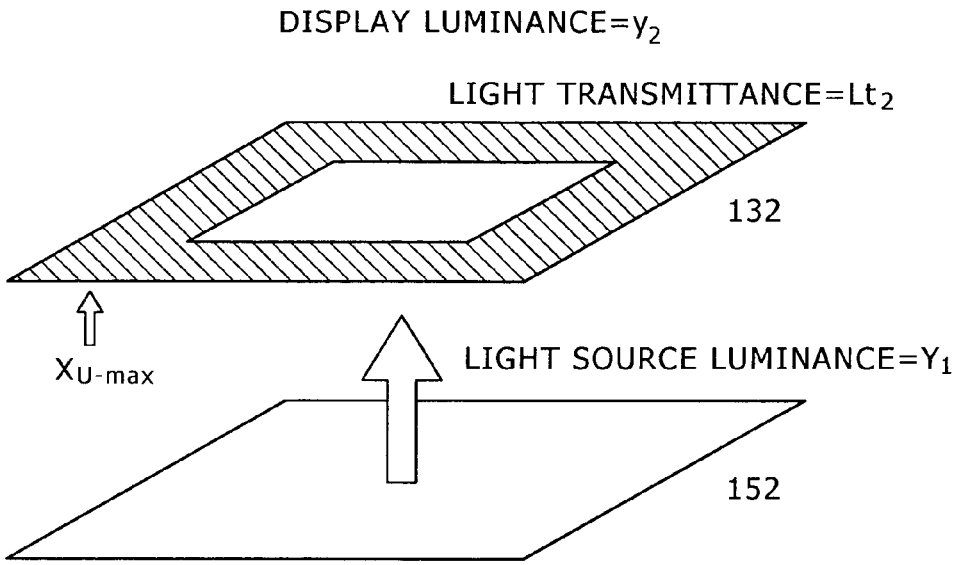
FIGS. 11A and 11B are schematic views illustrating states of increasing or decreasing, under the control of a planar light source apparatus driving circuit, the light source luminance of the planar light source unit so that a display luminance second prescribed value when it is assumed that a control signal corresponding to a display region unit signal maximum value is supplied to a subpixel may be obtained by the planar light source unit.
Figure 11B:
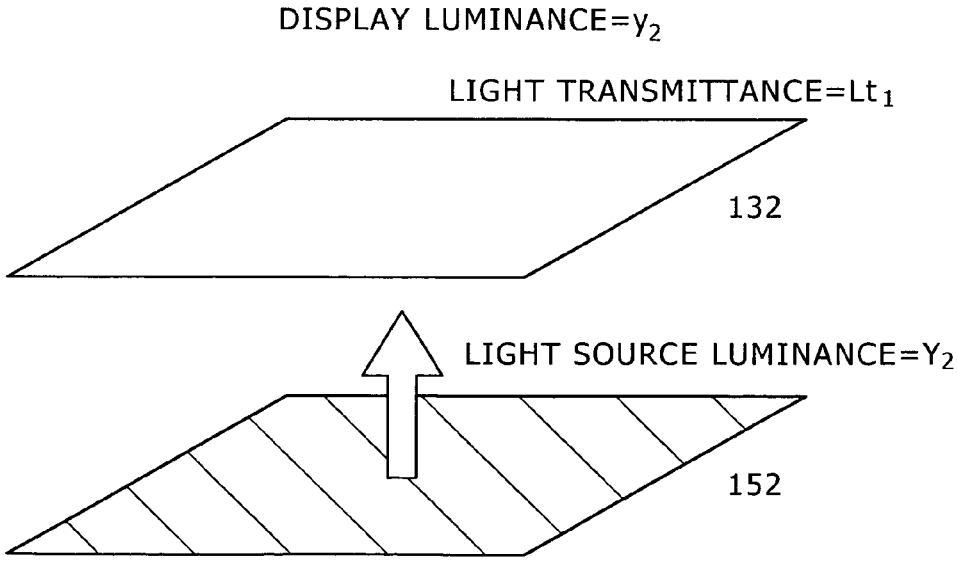

Upon partial driving or divisional driving of the planar light source apparatus, the luminance of a light emitting element which configures a planar light source unit 152 corresponding to a display region unit 132 is controlled by the planar light source apparatus driving circuit 160 so that the luminance of a subpixel when it is assumed that a control signal corresponding to the display region unit signal maximum value $X_{max-(s,t)}$ is supplied to the subpixel, that is, the display luminance second prescribed value $y_2$ at the light transmission factor first prescribed value $Lt_1$, may be obtained. In particular, for example, the light source luminance $Y_2$ may be controlled, for example, reduced, so that the display luminance $y_2$ may be obtained when the light transmission factor or numerical aperture of the subpixel is set, for example, to the light transmission factor first prescribed value $Lt_1$. In particular, the light source luminance $Y_2$ of the planar light source unit 152 may be controlled for each image display frame so that, for example, the following expression (A) may be satisfied. It is to be noted that the light source luminance $Y_2$ and the light source luminance first prescribed value $Y_1$ have a relationship of $Y_2 \leq Y_1$. Such control is schematically illustrated in FIGS. 11A and 11B.

$$Y_2 \cdot Lt_1 = Y_1 \cdot Lt_2 \tag{A}$$

In order to individually control the subpixels, the output signals $X_{1-(p,q)}$, $X_{2-(p,q)}$, $X_{3-(p,q)}$ and $X_{4-(p,q)}$ for controlling the light transmission factor Lt of the individual subpixels are signaled from the signal processing section 20 to the image display panel driving circuit 40. In the image display panel driving circuit 40, control signals are produced from the output signals and supplied or output to the subpixels. Then, a switching element which configures each subpixel is driven based on a pertaining one of the control signals and a desired voltage is applied to a transparent first electrode and a transparent second electrode not shown which configure a liquid crystal cell to control the light transmission factor Lt or numerical aperture of the subpixel. Here, as the magnitude of the control signal increases, the light transmission factor Lt or numerical aperture of the subpixel increases and the luminance, that is, the display luminance y, of a portion of the display region corresponding to the subpixel increases. In particular, an image configured from light passing through the subpixel and normally a kind of a point is bright.

Control of the display luminance y and the light source luminance $Y_2$ is carried out for each one image display frame, for each display region unit and for each planar light source unit in image display of the image display panel 130. Further, operation of the image display panel 130 and operation of the planar light source apparatus 150 within one image display frame are synchronized with each other. It is to be noted that the number of image information sent as an electric signal to the driving circuit for one second, that is, the number of images per one second, is a frame frequency or frame rate, and the reciprocal number to the frame frequency is frame time whose unit is second.

In the working example 1, an expansion process of expanding an input signal to obtain an output signal is carried out for all pixels based on one expansion coefficient $\alpha_0$. On the other hand, in the working example 2, an expansion coefficient $\alpha_0$ is determined for each of the S×T display region units 132, and an expansion process based on the expansion coefficient $\alpha_0$ is carried out for each display region unit 132.

Then, in the (s,t)th planar light source unit 152 which corresponds to the (s,t)th display region unit 132 whose determined expansion coefficient is $\alpha_{0-(s,t)}$, the luminance of the light source is set to $1/\alpha_{0-(s,t)}$.

Or, the luminance of a light source which configures the planar light source unit 152 corresponding to each display region unit 132 is controlled by the planar light source apparatus driving circuit 160 so that a luminance of a subpixel when it is assumed that a control signal corresponding to the display region unit signal maximum value $X_{max-(s,t)}$ which is a maximum value among output signal values $X_{1-(s,t)}$, $X_{2-(s,t)}$, $X_{3-(s,t)}$ and $X_{4-(s,t)}$ of the signal processing section 20 input to drive all subpixels which configure the display region unit 132 is supplied to the subpixel, that is, the display luminance second prescribed value $y_2$ at the light transmission factor first prescribed value $Lt_1$, may be obtained. In particular, the light source luminance $Y_2$ may be controlled, for example, reduced, so that the display luminance $y_2$ may be obtained when the light transmission factor or numerical aperture of the subpixel is set to the light transmission factor first prescribed value $Lt_1$. In other words, particularly the light source luminance $Y_2$ of the planar light source unit 152 may be controlled for each image display frame so that the expression (A) given hereinabove may be satisfied.

Incidentally, in the planar light source apparatus 150, in the case where luminance control of the planar light source unit 152 of, for example, (s,t)=(1,1) is assumed, there are instances where it is necessary to take an influence from the other S×T planar light source units 152 into consideration. Since the influence upon the planar light source unit 152 from the other planar light source units 152 is known in advance from a light emission profile of each of the planar light source unit 152, the difference can be determined by backward determination, and as a result, correction of the influence is possible. A basic form of the determination is described below.

The luminance, that is, the light source luminance $Y_2$, demanded for the S×T planar light source units 152 based on the requirement of the expression (A) is represented by a matrix $[L_{P\times Q}]$. Further, the luminance of a certain planar light source unit which is obtained when only the certain planar light source unit is driven while the other planar light source units are not driven is determined with regard to the S×T planar light source units 152 in advance. The luminance in this instance is represented by a matrix $[L'_{P\times Q}]$. Further, correction coefficients are represented by a matrix $[\alpha_{P\times Q}]$. Consequently, a relationship among the matrices can be represented by the following expression (B-1). The matrix $[\alpha_{P\times Q}]$ of the correction coefficients can be determined in advance.

$$[L_{P\times Q}]=[L'_{P\times Q}]\cdot[\alpha_{P\times Q}] \quad \text{(B-1)}$$

Therefore, the matrix $[L'_{P\times Q}]$ may be determined from the expression (B-1). The matrix $[L'_{P\times Q}]$ can be determined by determination of an inverse matrix. In particular, $$[L'_{P\times Q}]=[L_{P\times Q}]\cdot[\alpha_{P\times Q}]^{-1} \quad \text{(B-2)}$$

may be determined. Then, the light source, that is, the light emitting diode 153, provided in each planar light source unit 152 may be controlled so that the luminance represented by the matrix $[L'_{P\times Q}]$ may be obtained. In particular, such operation or processing may be carried out using information or a data table stored in the storage device or memory 62 provided in the planar light source apparatus driving circuit 160. It is to be noted that, in the control of the light emitting diodes 153, since the value of the matrix $[L'_{P\times Q}]$ cannot assume a negative value, it is a matter of course that it is necessary for a result of the determination to remain within a positive region. Accordingly, the solution of the expression (B-2) sometimes becomes an approximate solution but not an exact solution.

In this manner, a matrix $[L'_{P\times Q}]$ of luminance when it is assumed that each planar light source unit is driven solely is determined as described above based on a matrix $[L_{P\times Q}]$ obtained based on values of the expression (A) obtained by the planar light source apparatus driving circuit 160 and a matrix $[\alpha_{P\times Q}]$ of correction coefficients, and the matrix $[L'_{P\times Q}]$ is converted into corresponding integers, that is, values of a pulse width modulation output signal, within the range of 0 to 255 based on the conversion table stored in the storage device 62. In this manner, the calculation circuit 61 which configures the planar light source apparatus driving circuit 160 can obtain a value of a pulse width modulation output signal for controlling the light emission time period of the light emitting diode 153 of the planar light source unit 152. Then, based on the value of the pulse width modulation output signal, the on time $t_{ON}$ and the off time $t_{OFF}$ of the light emitting diode 153 which configures the planar light source unit 152 may be determined by the planar light source apparatus driving circuit 160. It is to be noted that $$t_{ON}+t_{OFF}=\text{fixed value } t_{const}$$

Further, the duty ratio in driving based on pulse width modulation of the light emitting diode can be represented as $$t_{ON}/(t_{ON}+t_{OFF})=t_{ON}/t_{Const}$$

Then, a signal corresponding to the on time $t_{ON}$ of the light emitting diode 153 which configures the planar light source unit 152 is sent to the LED driving circuit 63, and the switching element 65 is controlled to an on state only within the on time $t_{ON}$ based on the value of the signal corresponding to the on time $t_{ON}$ from the LED driving circuit 63. Consequently, LED driving current from the light emitting diode driving power supply 66 is supplied to the light emitting diode 153. As a result, each light emitting diode 153 emits light only for the on time $t_{ON}$ within one image display frame. In this manner, each display region unit 132 is illuminated with a predetermined illuminance.

It is to be noted that the planar light source apparatus 150 of the divisional driving type or partial driving type described hereinabove in connection with the working example 2 may be applied also to the other working examples.

WORKING EXAMPLE 3

Figure 12:
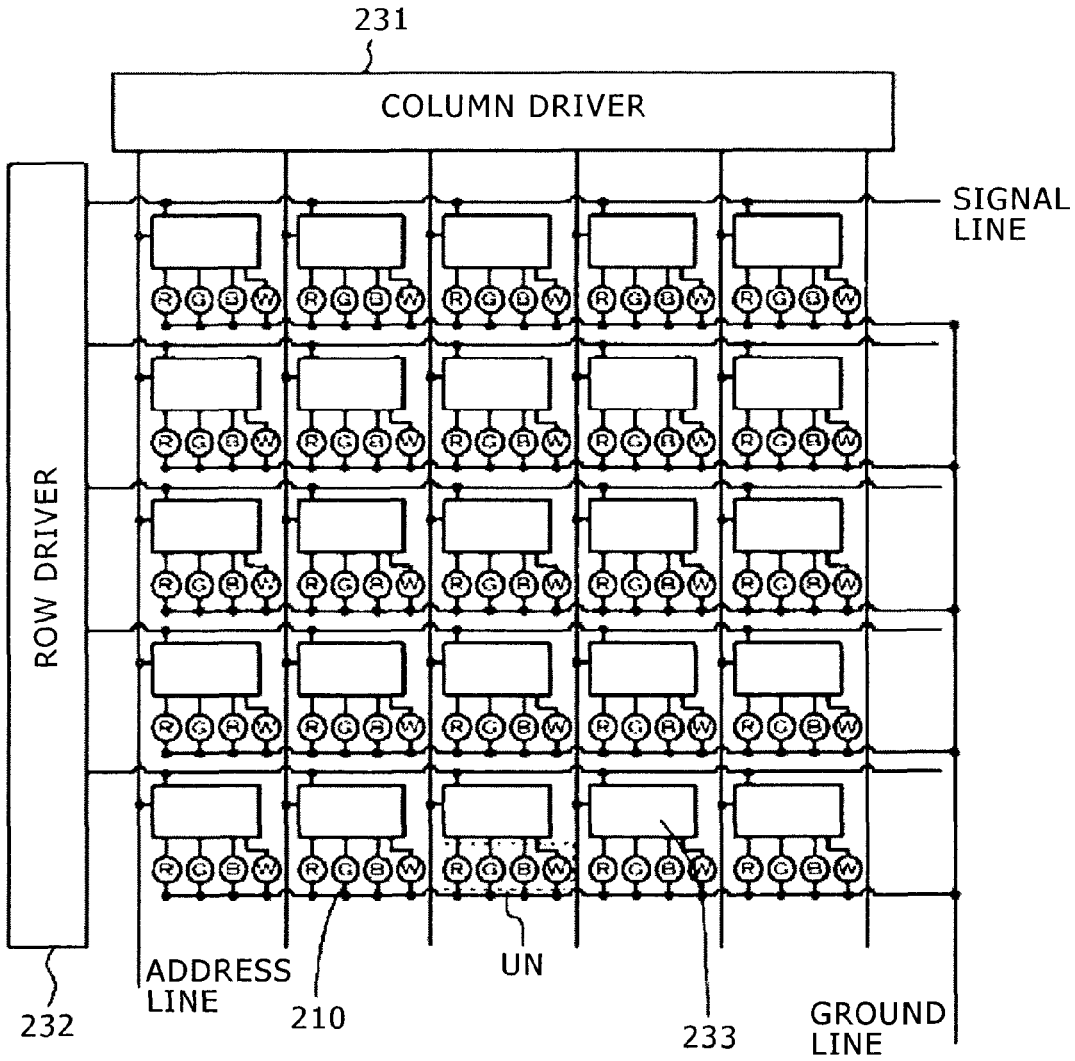
FIG. 12 is an equivalent circuit diagram of an image display apparatus of a working example 3 of the present disclosure.
Figure 13:
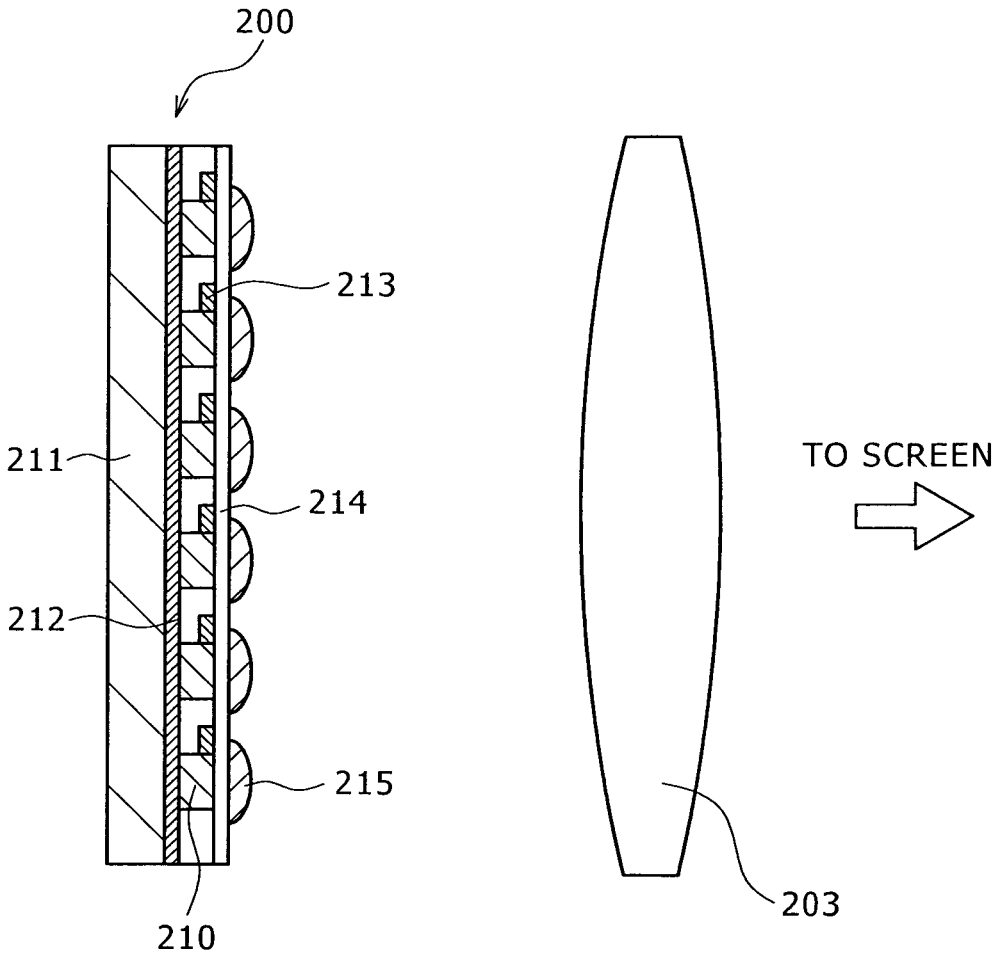
FIG. 13 is a schematic view of an image display panel which composes the image display apparatus of the working example 3.

Also the working example 3 is a modification to the working example 1. An equivalent circuit diagram of an image display apparatus of the working example 3 is shown in FIG. 12, and a general configuration of an image display panel which configures the image display apparatus is shown in FIG. 13. In the working example 3, the image display apparatus described below is used. In particular, the image display apparatus of the working example 3 includes an image display panel wherein a plurality of light emitting element units UN for displaying a color image, which are each configured from a first light emitting element which corresponds to a first subpixel R for emitting red light, a second light emitting element which corresponds to a second subpixel G for emitting green light, a third light emitting element which corresponds to a third subpixel B for emitting blue light and a fourth light emitting element which corresponds to a fourth subpixel W for emitting white light are arrayed in a two-dimensional matrix. Here, the image display panel which configures the image display apparatus of the working example 3 may be, for example, an image display panel having a configuration and structure described below. It is to be noted that the number of light emitting element units UN may be determined based on specifications demanded for the image display apparatus.

In particular, the image display panel which configures the image display apparatus of the working example 3 is a direct-vision color image display panel of the passive matrix type or the active matrix type wherein the light emitting/no-light emitting states of the first, second, third and fourth light emitting elements are controlled so that the light emission states of the light emitting elements may be directly visually observed to display an image. Or, the image display panel is a color image display panel of the passive matrix projection type or the active matrix projection type wherein the light emitting/no-light emitting states of the first, second, third and fourth light emitting elements are controlled such that light is projected on a screen to display an image.

For example, a light emitting element panel which configures a direct-vision color image display panel of the active matrix type is shown in FIG. 12. Referring to FIG. 12, a light emitting element for emitting red light, that is, a first subpixel, is denoted by "R"; a light emitting element for emitting green light, that is, a second subpixel, by "G"; a light emitting element for emitting blue light, that is, a third subpixel, by "B"; and a light emitting element for emitting white light, that is, a fourth subpixel, by "W." Each of light emitting elements 210 is connected at one electrode thereof, that is, at the p side electrode or the n side electrode thereof, to a driver 233. Such drivers 233 are connected to a column driver 231 and a row driver 232. Each light emitting element 210 is connected at the other electrode thereof, that is, at the n side electrode or the p side electrode thereof, to a ground line. Control of each light emitting element 210 between the light emitting state and the no-light emitting state is carried out, for example, by selection of the driver 233 by the row driver 232, and a luminance signal for driving each light emitting element 210 is supplied from the column driver 231 to the driver 233. Selection of any of the first subpixel R for emitting red light, that is, the first light emitting element or first subpixel R, the second subpixel G for emitting green light, that is, the second light emitting element or second subpixel G, the third subpixel B for emitting blue light, that is, the third light emitting element or third subpixel B and the light emitting element W for emitting white light, that is, the fourth light emitting element or fourth subpixel W, is carried out by the driver 233. The light emitting and no-light emitting states of the first subpixel R for emitting red light, the second subpixel G for emitting green light, the third subpixel B for emitting blue light and the light emitting element W for emitting white light may be controlled by time division control or may be controlled simultaneously. It is to be noted that, in the case where the image display apparatus is of the direct vision type, an image is viewed directly, but where the image display apparatus is of the projection type, an image is projected on a screen through a projection lens.

It is to be noted that an image display panel which configures such an image display apparatus as described above is schematically shown in FIG. 13. In the case where the image display apparatus is of the direct-vision type, the image display panel is viewed directly, but where the image display apparatus is of the projection type, an image is projected from the display panel to the screen through a projection lens 203.

Or, the image display panel which configures the image display apparatus of the working example 3 may be formed as an image display panel of the direct vision type or the projection type for color display. In this instance, the image display panel includes a light passage control apparatus for controlling whether or not light emitted from light emitting device units arrayed in a two-dimensional matrix is to be passed. The light passage control apparatus is a light valve apparatus and particularly is a liquid crystal display apparatus which includes thin film transistors of, for example, a high-temperature polycrystalline silicon type. This similar applies also to the working examples hereinafter described. The light emitting/no-light emitting states of first, second, third and fourth light emitting devices of each light emitting device unit are time-divisionally controlled, and passage/non-passage of light emitted from the first, second, third and fourth light emitting elements is controlled by the light passage control apparatus to display an image.

In the working example 3, an output signal for controlling the light emitting state of each of the first light emitting element or first subpixel R, second light emitting element or second subpixel G, third light emitting element or third subpixel B and fourth light emitting element or fourth subpixel W may be obtained based on the expansion process described hereinabove in connection with the working example 1. Then, if the image display apparatus is driven based on the values $X_{1-(p,q)}$, $X_{2-(p,q)}$, $X_{3-(p,q)}$ and $X_{4-(p,q)}$ of the output signals obtained by the expansion process, then the luminance of the entire image display apparatus can be increased to $\alpha_0$ times. Or, if the luminance of emitted light of the first light emitting element or first subpixel R, second light emitting element or second subpixel G, third light emitting element or third subpixel B and fourth light emitting element or fourth subpixel W are reduced to $1/\alpha_0$ time based on the values $X_{1-(p,q)}$, $X_{2-(p,q)}$, $X_{3-(p,q)}$ and $X_{4-(p,q)}$ of the output signals, then reduction of the power consumption of the entire image display apparatus can be achieved without suffering from degradation of the image quality.

WORKING EXAMPLE 4

The working example 4 relates to the driving method according to the second embodiment and the driving method for an image display apparatus assembly according to the second embodiment.

Figure 14:
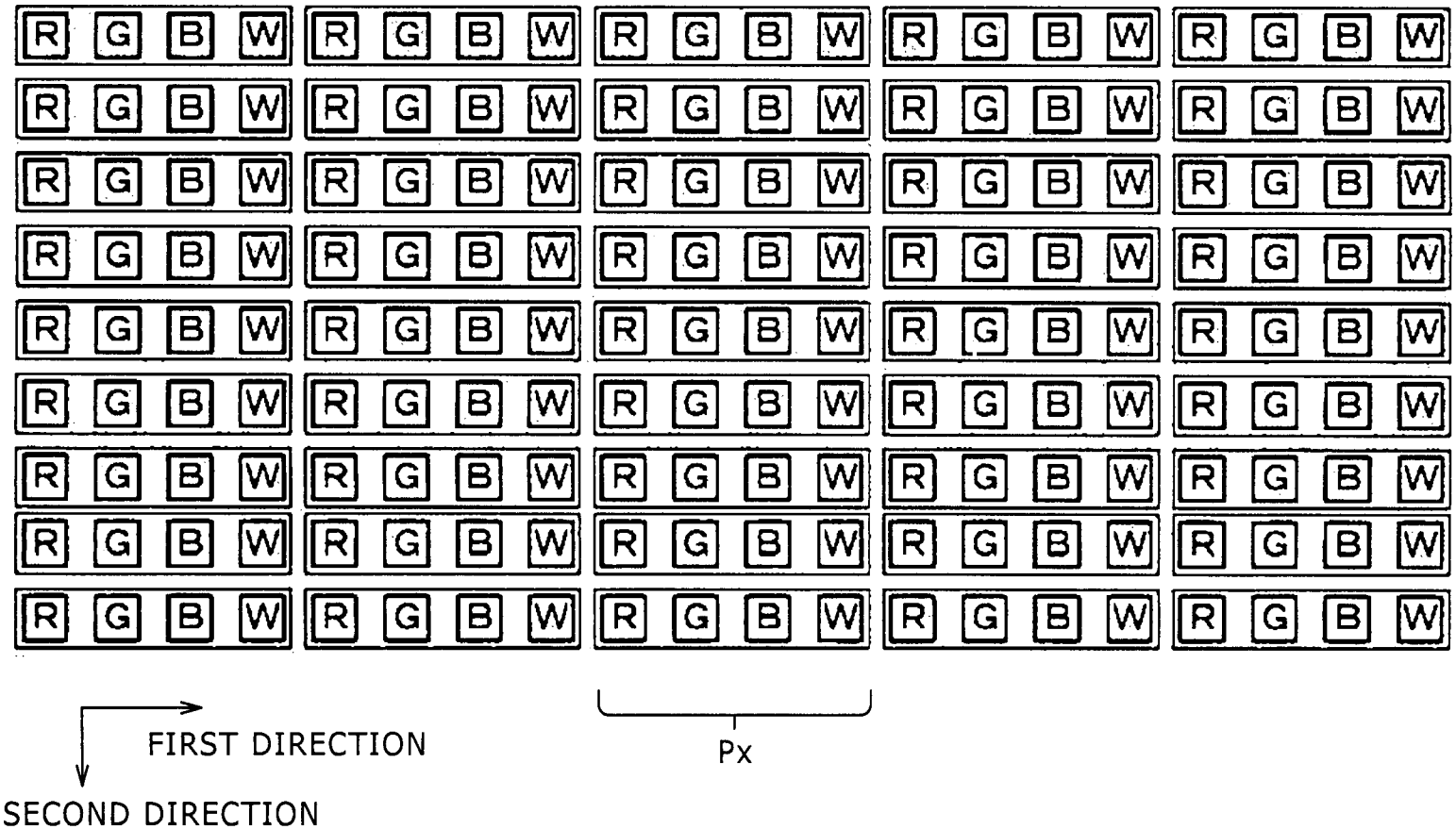
FIG. 14 is a view schematically illustrating an example of arrangements of pixels on an image display apparatus of a working example 4.

FIG. 14 schematically shows arrangement of pixels. Referring to FIG. 14, the image display panel 30 of the working example 4 includes totaling $P_0 \times Q_0$ pixels arrayed in a two-dimensional matrix including $P_0$ pixels arrayed in a first direction and $Q_0$ pixels arrayed in a second direction. It is to be noted that, in FIG. 14, a first subpixel R, a second subpixel G, a third subpixel B and a fourth subpixel W are surrounded by a solid line rectangle. Each of the pixels Px includes a first subpixel R for displaying a first primary color such as red, a second subpixel G for displaying a second primary color such as green, a third subpixel B for displaying a third primary color such as blue, and a fourth subpixel W for displaying a fourth color such as white. The subpixels mentioned of each pixel Px are arrayed in the first direction. Each subpixel has a rectangular shape and is disposed such that the major side of the rectangle extends in parallel to the second direction and the minor side of the rectangle extends in parallel to the first direction.

The image display apparatus and the image display apparatus assembly in the working example 4 may be any of the image display apparatus and the image display apparatus assembly described hereinabove in connection with the working examples 1 to 3. In other words, also the image display apparatus 10 of the working example 4 includes an image display panel and a signal processing section 20. Further, the image display apparatus assembly of the working example 4 includes the image display apparatus 10 and a planar light source apparatus 50 which illuminates the image display apparatus 10, particularly the image display panel, from the rear face side. The signal processing section 20 and the planar light source apparatus 50 in the working example 4 may be similar to those described hereinabove in connection with the working example 1. This similarly applies also to the various working examples hereinafter described.

Further, regarding an adjacent pixel positioned adjacent a (p,q)th pixel, to the signal processing section 20, a first subpixel input signal having a signal value $X_{1-(p,q')}$, a second subpixel input signal having a signal value $X_{2-(p,q')}$, and a third subpixel input signal having a signal value $X_{3-(p,q')}$ are input.

It is to be noted that, in the working example 4, the adjacent pixel positioned adjacent the (p,q)th pixel is the (p,q−1)th pixel. However, the adjacent pixel is not limited to this but may be the (p,q+1)th pixel, or may be both of the (p,q−1)th pixel and the (p,q+1)th pixel.

Then, similarly as in the foregoing description of the working example 1, the signal processing section 20

(a) determines a maximum value $V_{max}(S)$ of brightness taking a saturation S in an HSV color space enlarged by adding the fourth color as a variable;

(b) determines the saturation S and the brightness V(S) of a plurality of pixels based on subpixel input signal values to the plural pixels; and (c) determines the expansion coefficient $\alpha_0$ based on at least one of values of $V_{max}(S)/V(S)$ determined with regard to the plural pixels.

Further, for a (p,q)th pixel where p=1, 2 . . . $P_0$ and q=1, 2 . . . , $Q_0$ when the pixels are counted along the second direction, the signal processing section 20:

determines a first correction signal value based on the expansion coefficient $\alpha_0$, a first subpixel input signal to the (p,q)th pixel, a first subpixel input signal to an adjacent pixel adjacent to the (p,q)th pixel and a first constant $K_1$;

determines a second correction signal value based on the expansion coefficient $\alpha_0$, a second subpixel input signal to the (p,q)th pixel, a second subpixel input signal to the adjacent pixel and a second constant $K_2$;

determines a third correction signal value based on the expansion coefficient $\alpha_0$, a third subpixel input signal to the (p,q)th pixel, a third subpixel input signal to the adjacent pixel and a third constant $K_3$;

determines a correction signal value having a maximum value from among the first, second and third correction signal values as a fourth correction signal value; and determines a fifth correction signal value based on the expansion coefficient $\alpha_0$, the first subpixel input signal, second subpixel input signal and third correction signal value to the (p,q)th pixel and the first subpixel input signal, second subpixel input signal and third correction signal value to the adjacent pixel.

Then, the signal processing section 20 determines, for the (p,q)th pixel, a fourth subpixel output signal of the (p,q)th pixel from the fourth and fifth correction signal values and outputs the fourth subpixel output signal to the fourth subpixel in the (p,q)th pixel.

In particular, in the working example 4, the first constant $K_1$ is determined as a maximum value capable of being taken by the first subpixel input signal and the second constant $K_2$ is determined as a maximum value capable of being taken by the second subpixel input signal while the third constant $K_3$ is determined as a maximum value capable of being taken by the third subpixel input signal; and the first correction signal value $CS_{1-(p,q)}$ is determined based on the expansion coefficient $\alpha_0$, the first subpixel input signal $x_{1-(p,q)}$ to the (p,q)th pixel when counted along the second direction, the first subpixel input signal $x_{1-(p,q')}$ to the pixel adjacent the (p,q)th pixel and the first constant $K_1$;

the second correction signal value $CS_{2-(p,q)}$ is determined based on the expansion coefficient $\alpha_0$, the second subpixel input signal $x_{2-(p,q)}$ to the (p,q)th pixel, the second subpixel input signal $x_{2-(p,q')}$ to the adjacent pixel and the second constant $K_2$; and the third correction signal value $CS_{3-(p,q)}$ is determined based on the expansion coefficient $\alpha_0$, the third subpixel input signal $x_{3-(p,q)}$ to the (p,q)th pixel, the third subpixel input signal $x_{3-(p,q')}$ to the adjacent pixel and the third constant $K_3$.

More particularly, a higher one of a value determined by subtracting the first constant $K_1$ from the product of the expansion coefficient $\alpha_0$ and the first subpixel input signal $x_{1-(p,q)}$ to the (p,q)th pixel and another value determined by subtracting the first constant $K_1$ from the product of the expansion coefficient $\alpha_0$ and the first subpixel input signal $x_{1-(p,q')}$ to the adjacent pixel is determined as the first correction signal value $CS_{1-(p,q)}$;

a higher one of a value determined by subtracting the second constant $K_2$ from the product of the expansion coefficient $\alpha_0$ and the second subpixel input signal $x_{2-(p,q)}$ to the (p,q)th pixel and another value determined by subtracting the second constant $K_2$ from the product of the expansion coefficient $\alpha_0$ and the second subpixel input signal $x_{2-(p,q')}$ to the adjacent pixel is determined as the second correction signal value $CS_{2-(p,q)}$; and a higher one of a value determined by subtracting the third constant $K_3$ from the product of the expansion coefficient $\alpha_0$ and the third subpixel input signal $x_{3-(p,q)}$ to the (p,q)th pixel and another value determined by subtracting the third constant $K_3$ from the product of the expansion coefficient $\alpha_0$ and the third subpixel input signal $x_{3-(p,q')}$ to the adjacent pixel is determined as the third correction signal value $CS_{3-(p,q)}$.

$$CS_{1-(p,q)}=\max(x_{1-(p,q)}\cdot\alpha_0-K_1, x_{1-(p,q')}\cdot\alpha_0-K_1) \quad (1\text{-}a_2)$$

$$CS_{2-(p,q)}=\max(x_{2-(p,q)}\cdot\alpha_0-K_2, x_{2-(p,q')}\cdot\alpha_0-K_2) \quad (1\text{-}b_2)$$

$$CS_{3-(p,q)}=\max(x_{3-(p,q)}\cdot\alpha_0-K_3, x_{3-(p,q')}\cdot\alpha_0-K_3) \quad (1\text{-}c_2)$$

Further, for the (p,q)th pixel along the second direction, a fifth correction signal value $CS_{5-(p,q)}$ is determined based on the expansion coefficient $\alpha_0$, the first subpixel input signal $x_{1-(p,q)}$, second subpixel input signal $x_{2-(p,q)}$ and third correction signal value $CS_{3-(p,q)}$ to the (p,q)th pixel and the first subpixel input signal $x_{1-(p,q')}$, second subpixel input signal $x_{2-(p,q')}$ and third correction signal value $CS_{3-(p,q')}$ to the adjacent pixel. In particular, in the working example 4, the fifth correction signal value $CS_{5-(p,q)}$ is determined at least based on the value of Min of the (p,q)th pixel, the value of Min of the adjacent pixel and the expansion coefficient $\alpha_0$. More particularly, the fifth correction signal value $CS_{5-(p,q)}$ is determined, for example, in accordance with the expressions (2-1-1), (2-1-2) and (2-8). Then, a correction signal value having a lower value from between the fourth correction signal value $CS_{4-(p,q)}$ and the fifth correction signal value $CS_{5-(p,q)}$ is determined as the fourth subpixel output signal $X_{4-(p,q)}$. It is to be noted that $c_{21}$ is determined to be $c_{21}=1$.

$$SG_{3-(p,q)}=c_{21}(\mathrm{Min}_{(p,q)})\cdot\alpha_0 \quad (2\text{-}1\text{-}1)$$

$$SG_{2-(p,q)}=c_{21}(\mathrm{Min}_{(p,q')})\cdot\alpha_0 \quad (2\text{-}1\text{-}2)$$

$$CS_{5-(p,q)}=\min(SG_{2-(p,q)}, SG_{3-(p,q)}) \quad (2\text{-}8)$$

$$CS_{4-(p,q)}=c_{17}\cdot\max(CS_{1-(p,q)}, CS_{2-(p,q)}, CS_{3-(p,q)}) \quad (1\text{-}d_2)$$

$$X_{4-(p,q)}=(CS_{4-(p,q)}+CS_{5-(p,q)})/2 \quad (1\text{-}f_2)$$

Further, the output signal values $X_{1-(p,q)}$, $X_{2-(p,q)}$ and $X_{3-(p,q)}$ of the first subpixel R, second subpixel G and third subpixel B can be determined based on the expansion coefficient $\alpha_0$ and the constant $\chi$ by the signal processing section 20. More particularly, the output signal values $X_{1-(p,q)}$, $X_{2-(p,q)}$ and $X_{3-(p,q)}$ can be determined in accordance with the following expressions (1-A) to (1-C), respectively:

$$X_{1-(p,q)}=\alpha_0 \cdot x_{1-(p,q)}-\chi \cdot X_{4-(p,q)} \quad (1\text{-A})$$

$$X_{2-(p,q)}=\alpha_0 \cdot x_{2-(p,q)}-\chi \cdot X_{4-(p,q)} \quad (1\text{-B})$$

$$X_{3-(p,q)}=\alpha_0 \cdot x_{3-(p,q)}-\chi \cdot X_{4-(p,q)} \quad (1\text{-C})$$

In the following, a method of determining the output signal values $X_{1-(p,q)}$, $X_{2-(p,q)}$, $X_{3-(p,q)}$ and $X_{4-(p,q)}$ of the (p,q)th pixel group $PG_{(p,q)}$, that is, an expansion process, is described. It is to be noted that the following process is carried out so as to keep, in both of a first pixel and a second pixel, or in other words, in each of the pixel groups, the ratio among the luminance of the first primary color displayed by the first subpixel R+fourth subpixel W, the luminance of the second primary color displayed by the second subpixel G+fourth subpixel W and the luminance of the third primary color displayed by the third subpixel B+fourth subpixel W. Besides, the process is carried out so as to keep or maintain the color tone as far as possible. Furthermore, the process is carried out so as to keep or maintain the gradation-luminance characteristic, that is, the gamma characteristic or γ characteristic.

Step 400

First, processes similar to those at steps 100 to 110 in the working example 1 are executed.

Step 410

Then, the signal processing section 20 determines the fourth subpixel output signal value $X_{4-(p,q)}$ to the (p,q)th pixel $P_{x(p,q)}$ in accordance with the expressions (1-$a_2$), (1-$b_2$), (1-$c_2$), (2-1-1), (2-1-2), (2-8), (1-$d_2$) and (1-$f_2$). Then, the signal processing section 20 determines the first subpixel output signal value $X_{1-(p,q)}$, second subpixel output signal value $X_{2-(p,q)}$ and third subpixel output signal value $X_{3-(p,q)}$ to the (p,q)th pixel $Px_{(p,q)}$ in accordance with the expressions (1-A), (1-B) and (1-C), respectively.

What is significant here resides in that the values of the expressions are expanded by $\alpha_0$. Where the values of the expressions are expanded by $\alpha_0$ in this manner, not only the luminance of the white displaying subpixel, that is, the fourth subpixel W, increases, but also the luminance of the red displaying subpixel, green displaying subpixel and blue displaying subpixel, that is, the first subpixel R, second subpixel G and third subpixel B, increases as seen from the expressions (1-A) to (1-C). In particular, in comparison with an alternative case in which the values of the subpixel output signals are not expanded, the luminance of the entire image increases to $\alpha_0$ times as a result of the expansion of the values of the subpixel output signal values by $\alpha_0$. Accordingly, image display of, for example, still pictures can be carried out with a high luminance optimally. Or in order to obtain a luminance of an image equal to the luminance of an image which is not in an expanded state, the luminance of the planar light source apparatus 50 may be reduced based on the expansion coefficient $\alpha_0$. In particular, the luminance of the planar light source apparatus 50 may be reduced to $1/\alpha_0$ time. By this, reduction of the power consumption of the planar light source apparatus can be anticipated.

Besides, the fourth subpixel output signal to the (p,q)th pixel is determined based on the subpixel input signals to the (p,q)th pixel and subpixel input signals to an adjacent pixel positioned adjacent the (p,q)th pixel along the second direction. In other words, the fourth subpixel output signal to a certain pixel is determined based on the input signals to the certain pixel and also to the adjacent pixel adjacent the certain pixel. Therefore, optimization of the output signal to the fourth subpixel is achieved. Further, since the fourth subpixel is provided, increase of the luminance can be achieved with certainty, and enhancement of the display quality can be anticipated.

WORKING EXAMPLE 5

The working example 5 relates to the driving method according to the third embodiment and the driving method for an image display apparatus assembly according to the third embodiment.

Figure 15:
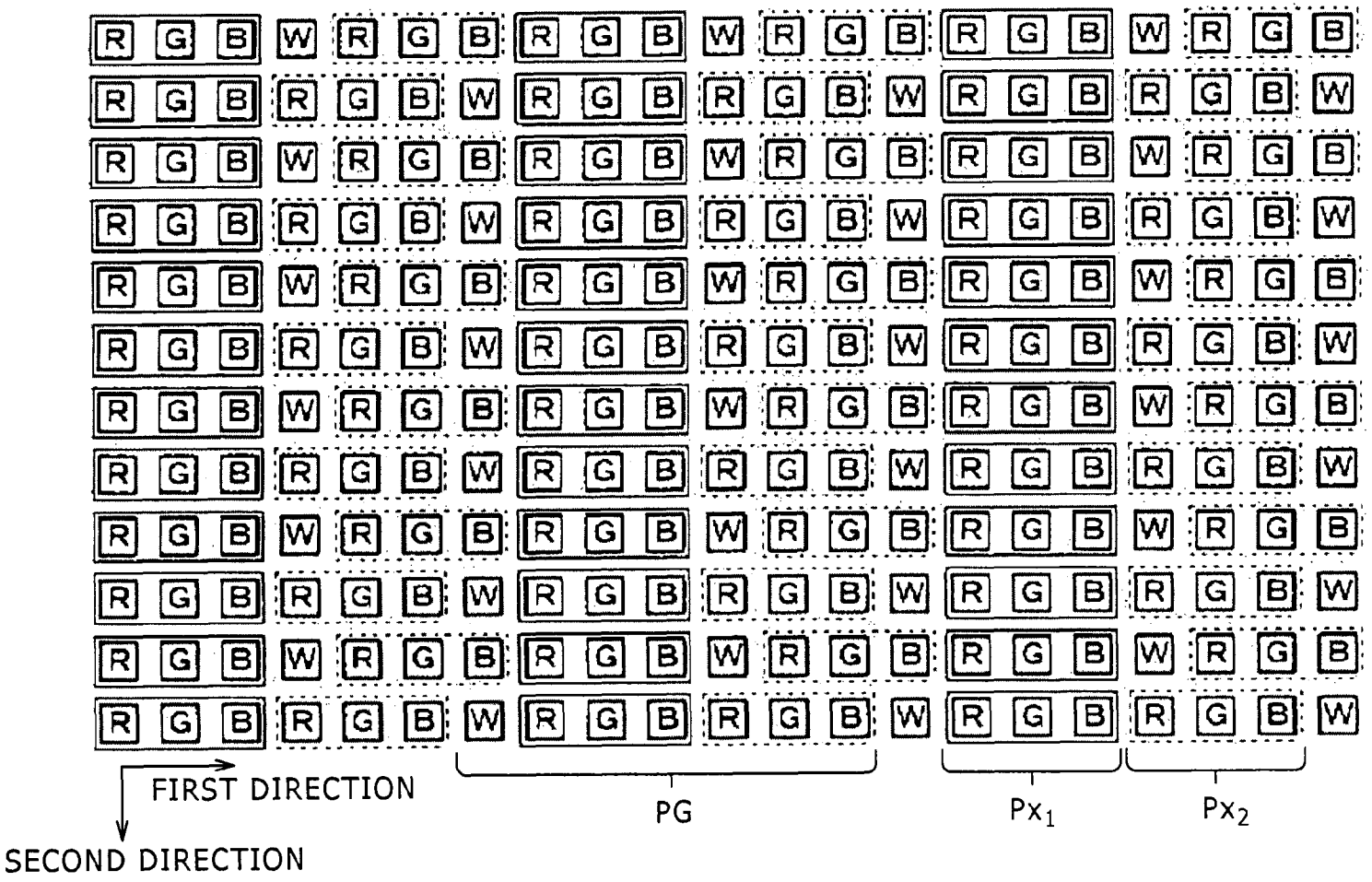
FIGS. 15, 16 and 17 are diagrammatic views illustrating arrangement of pixels and pixel groups on an image display panel of working examples 5, 6 and 7, respectively.
Figure 16:
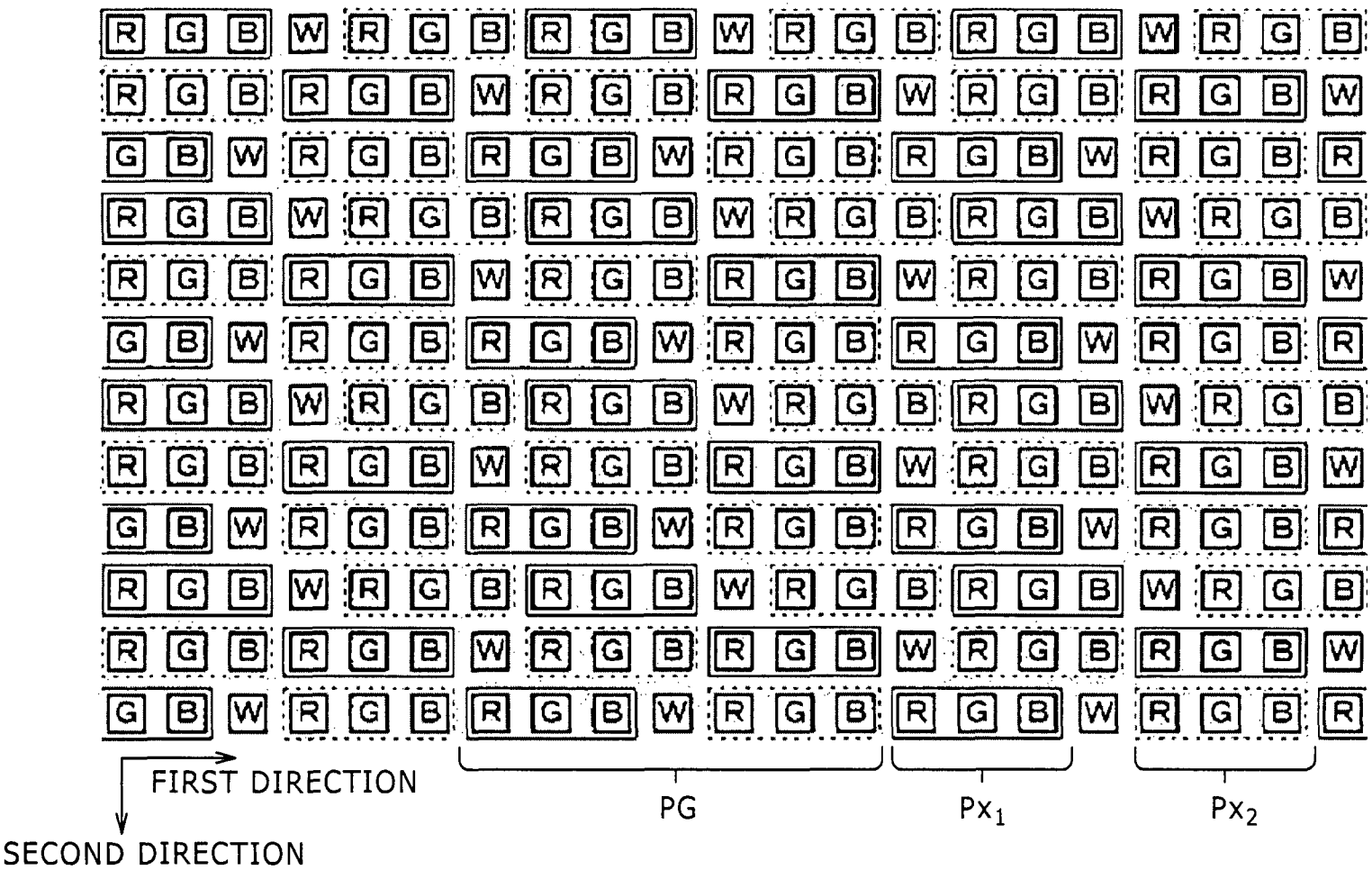
Figure 17:
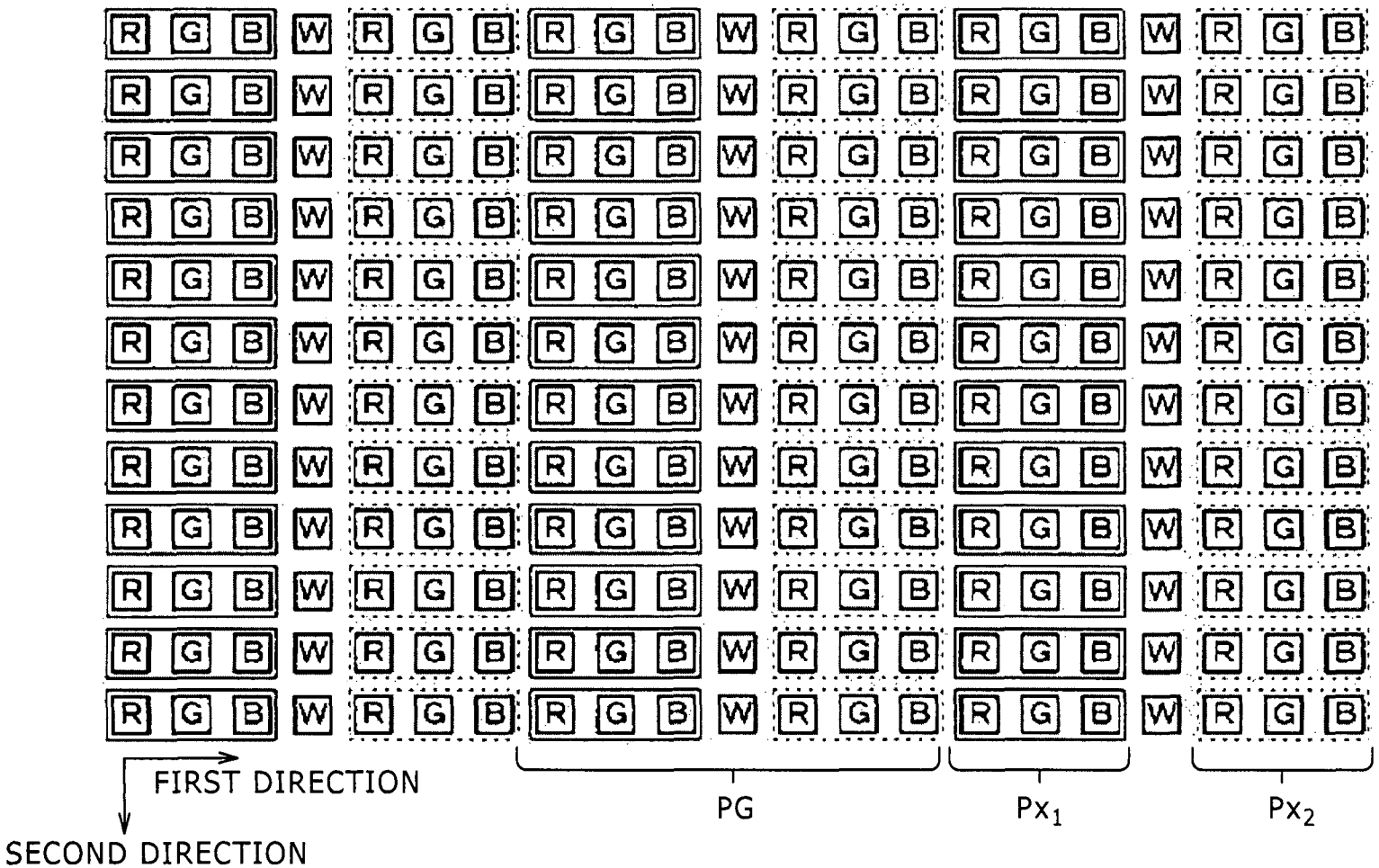
Figure 18:
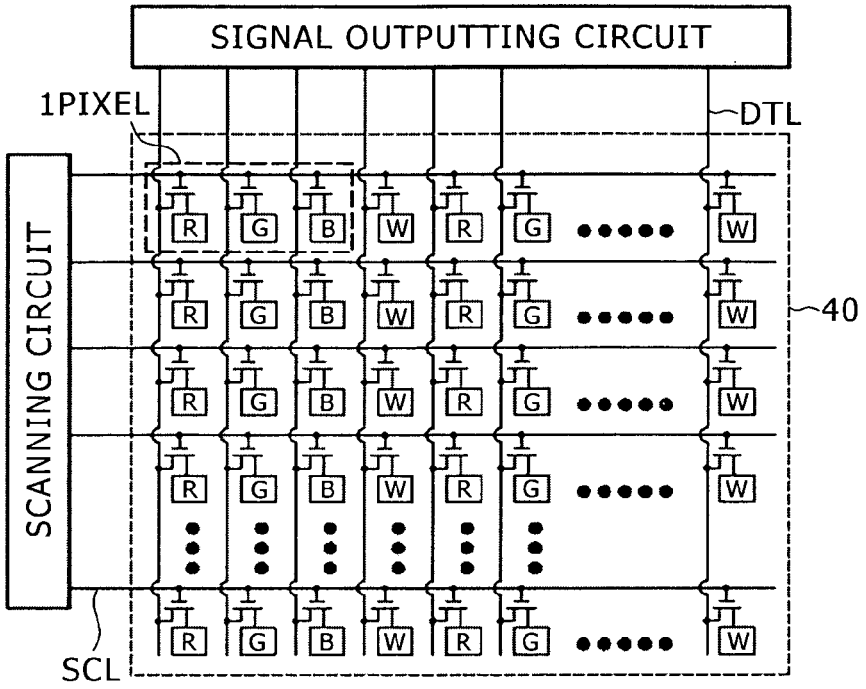
FIG. 18 is a block diagram of an image display panel and an image display panel driving circuit of an image display apparatus of the working example 5.

FIG. 15 schematically shows arrangement of pixels. Referring to FIG. 15, the image display panel 30 of the working example 5 includes pixels Px arrayed in a two-dimensional matrix in a first direction and a second direction. Each of the pixels Px includes a first subpixel R for displaying a first primary color such as, for example, red, a second subpixel G for displaying a second primary color such as, for example, green, and a third subpixel B for displaying a third primary color such as, for example, blue. A pixel group PG is configured from at least a first pixel $Px_1$ and a second pixel $Px_2$ arrayed in the first direction. It is to be noted that, in the working example 5, the pixel group PG is configured from a first pixel $Px_1$ and a second pixel $Px_2$, and where the number of pixels which configures a pixel group PG is represented by $p_0$, $p_0=2$. Further, in each pixel group PG, a fourth subpixel W for displaying a fourth color, in the working example 5, particularly white, is disposed between the first pixel $Px_1$ and second pixel $Px_2$. It is to be noted that, while arrangement of the pixels is schematically shown in FIG. 18 for the convenience of illustration, the arrangement illustrated in FIG. 18 is same as that in the working example 7 hereinafter described.

Here, if a positive number P is the number of pixel groups PG along the first direction and a positive number Q is the number of pixel groups PG along the second direction, then more particularly P×Q pixels Px are arrayed in a two-dimensional matrix including $p_0$×P pixels Px arrayed in a horizontal direction which is the first direction and Q pixels arrayed in a vertical direction which is the second direction. Further, in each pixel group PG in the working example 5, $p_0=2$ as described hereinabove.

Further, in the working example 5, if the first direction is a row direction and the second direction is a column direction, then the first pixel $Px_1$ in the q'th column where $1 \leq q' \leq Q-1$ and the first pixel $Px_1$ in the (q'+1)th column are positioned adjacent each other. However, the fourth subpixel W in the q'th column and the fourth subpixel W in the (q'+1)th column are not positioned adjacent each other. In other words, the second pixels $Px_2$ and the fourth subpixels W are disposed alternately along the second direction. It is to be noted that, in FIG. 15, a first subpixel R, a second subpixel G and a third subpixel B which configure a first pixel $Px_1$ are surrounded by a solid line rectangle, and a first subpixel R, a second subpixel G and a third subpixel B which configure a second pixel $Px_2$ are surrounded by a broken line rectangle. This similarly applies also to FIGS. 16, 17, 20, 21 and 22 hereinafter described. Since the second pixels $Px_2$ and the fourth subpixels W are disposed alternately along the second direction, it can be prevented with certainty that a stripe pattern appears on an image arising from the presence of the fourth subpixels W although this depends upon the pixel pitch.

Here, in the working example 5, regarding a first pixel $Px_{(p,q)-1}$ which configures a (p,q)th pixel group $PG_{(p,q)}$ where $1 \le p \le P$ and $1 \le q \le Q$, to the signal processing section 20, a first subpixel input signal having a signal value of $x_{1-(p,q)-1}$, a second subpixel input signal having a signal value of $x_{2-(p,q)-1}$, and a third subpixel input signal having a signal value of $x_{3-(p,q)-1}$, are input, and regarding a second pixel $Px_{(p,q)-2}$ which configures the (p,q)th pixel group $PG_{(p,q)}$, to the signal processing section 20, a first subpixel input signal having a signal value of $x_{1-(p,q)-2}$, a second subpixel input signal having a signal value of $x_{2-(p,q)-2}$, and a third subpixel input signal having a signal value of $x_{3-(p,q)-2}$, are input.

Further, in the working example 5, regarding the first pixel $Px_{(p,q)-1}$ which configures the (p,q) th pixel group $PG_{(p,q)}$, the signal processing section 20 outputs a first subpixel output signal having a signal value $X_{1-(p,q)-1}$ for determining a display gradation of the first subpixel R, a second subpixel output signal having a signal value $X_{2-(p,q)-1}$ for determining a display gradation of the second subpixel G, and a third subpixel output signal having a signal value $X_{3-(p,q)-1}$ for determining a display gradation of the third subpixel B.

Further, regarding the second pixel $PX_{(p,q)-2}$ which configures the (p,q)th pixel group $PG_{(p,q)}$, the signal processing section 20 outputs a first subpixel output signal having a signal value $X_{1-(p,q)-2}$ for determining a display gradation of the first subpixel R, a second subpixel output signal having a signal value $X_{2-(p,q)-2}$ for determining a display gradation of the second subpixel G, and third subpixel output signal having a signal value $X_{3-(p,q)-2}$ for determining a display gradation of the third subpixel B.

Further, regarding the fourth subpixel W which configures the (p,q)th pixel group $PG_{(p,q)}$, the signal processing section 20 outputs a fourth subpixel output signal having a signal value $X_{4-(p,q)}$ for determining a display gradation of the fourth subpixel W.

Further, in the working example 5, regarding the first pixel $Px_{(p,q)-1}$, the signal processing section 20 determines a first subpixel output signal having a signal value $X_{1-(p,q)-1}$ at least based on a first subpixel input signal having a signal value $x_{1-(p,q)-1}$ and an expansion coefficient $\alpha_0$ and outputs the first subpixel output signal to the first subpixel R;

determines a second subpixel output signal having a signal value $X_{2-(p,q)-1}$ at least based on a second subpixel input signal having a signal value $x_{2-(p,q)-1}$ and the expansion coefficient $\alpha_0$ and outputs the second subpixel output signal to the second subpixel G; and determines a third subpixel output signal having a signal value $X_{3-(p,q)-1}$ at least based on a third subpixel input signal having a signal value $x_{3-(p,q)-1}$ and the expansion coefficient $\alpha_0$ and outputs the third subpixel output signal to the third subpixel B.

Further, regarding the second pixel $Px_{(p,q)-2}$, the signal processing section 20 determines a first subpixel output signal having a signal value $X_{1-(p,q)-2}$ at least based on a first subpixel input signal having a signal value $x_{1-(p,q)-2}$ and the expansion coefficient $\alpha_0$ and outputs the first subpixel output signal to the first subpixel R;

determines a second subpixel output signal having a signal value $X_{2-(p,q)-2}$ at least based on a second subpixel input signal having a signal value $x_{2-(p,q)-2}$ and the expansion coefficient $\alpha_0$ and outputs the second subpixel output signal to the second subpixel G; and determines a third subpixel output signal having a signal value $X_{3-(p,q)-2}$ at least based on a third subpixel input signal having a signal value $x_{3-(p,q)-2}$ and the expansion coefficient $\alpha_0$ and outputs the third subpixel output signal to the third subpixel B.

Further, similarly as in the working example 1 described hereinabove, the signal processing section 20 further (a) determines a maximum value $V_{max}(S)$ of brightness taking a saturation S in an HSV color space enlarged by adding the fourth color as a variable;

(b) determines the saturation S and the brightness V(S) of a plurality of pixels based on subpixel input signal values to the plural pixels; and (c) determines the expansion coefficient $\alpha_0$ based on at least one of values of $V_{max}(S)/V(S)$ determined with regard to the plural pixels.

Further, for each pixel group, the signal processing section 20 determines a first correction signal value based on the expansion coefficient $\alpha_0$, the first subpixel input signals to the first and second pixels and a first constant $K_1$;

determines a second correction signal value based on the expansion coefficient $\alpha_0$, the second subpixel input signals to the first and second pixels and a second constant $K_2$;

determines a third correction signal value based on the expansion coefficient $\alpha_0$, the third subpixel input signals to the first and second pixels and a third constant $K_3$;

determines a correction signal value having a maximum value from among the first, second and third correction signal values as a fourth correction signal value; and determines a fifth correction signal value based on the expansion coefficient $\alpha_0$, the first and second subpixel input signals and third correction signal value to the first pixel, and the first and second subpixel input signals and third correction signal value to the second pixel.

Then, the signal processing section 20 determines, for each of the pixel groups, a fourth subpixel output signal from the fourth and fifth correction signal values and outputs the fourth subpixel output signal to the fourth subpixel.

In particular, in the working example 5, for each of the pixel groups, a first correction signal value $CS_{1-(p,q)}$ is determined based on the expansion coefficient $\alpha_0$, the first subpixel input signal $x_{1-(p,q)-1}$ to the first pixel $Px_{(p,q)-1}$, the first subpixel input signal $x_{1-(p,q)-2}$ to the second pixel $Px_{(p,q)-2}$ and a first constant $K_1$;

a second correction signal value $CS_{2-(p,q)}$ is determined based on the expansion coefficient $\alpha_0$, the second subpixel input signal $x_{2-(p,q)-1}$ to the first pixel $Px_{(p,q)-1}$, the second subpixel input signal $x_{2-(p,q)-2}$ to the second pixel $Px_{(p,q)-2}$ and a second constant $K_2$; and a third correction signal value $CS_{3-(p,q)}$ is determined based on the expansion coefficient $\alpha_0$, the third subpixel input signal $x_{3-(p,q)-1}$ to the first pixel $Px_{(p,q)-1}$, the third subpixel input signal $x_{3-(p,q)-2}$ to the second pixel $Px_{(p,q)-2}$ and a third constant $K_3$.

More particularly, in the working example 5, the first constant $K_1$ is determined as a maximum value capable of being taken by the first subpixel input signal and the second constant $K_2$ is determined as a maximum value capable of being taken by the second subpixel input signal while the third constant $K_3$ is determined as a maximum value capable of being taken by the third subpixel;

a higher one of a value determined by subtracting the first constant $K_1$ from the product of the expansion coefficient $\alpha_0$ and the first subpixel input signal $x_{1-(p,q)-1}$ to the first pixel $Px_{(p,q)-1}$ and another value determined by subtracting the first constant $K_1$ from the product of the expansion coefficient $\alpha_0$ and the first subpixel input signal $x_{1-(p,q)-2}$ to the second pixel $Px_{(p,q)-2}$ is determined as the first correction signal value $CS_{1-(p,q)}$;

a higher one of a value determined by subtracting the second constant $K_2$ from the product of the expansion coefficient $\alpha_0$ and the second subpixel input signal $x_{2-(p,q)-1}$ to the first pixel $Px_{(p,q)-1}$ and another value determined by subtracting the second constant $K_2$ from the product of the expansion coefficient $\alpha_0$ and the second subpixel input signal $x_{2-(p,q)-2}$ to the second pixel $Px_{(p,q)-2}$ is determined as the second correction signal value $CS_{2-(p,q)}$; and a higher one of a value determined by subtracting the third constant $K_3$ from the product of the expansion coefficient $\alpha_0$ and the third subpixel input signal $x_{3-(p,q)-1}$ to the first pixel $Px_{(p,q)-1}$ and another value determined by subtracting the third constant $K_3$ from the product of the expansion coefficient $\alpha_0$ and the third subpixel input signal $x_{3-(p,q)-2}$ to the second pixel $Px_{(p,q)-2}$ is determined as the third correction signal value $CS_{3-(p,q)}$.

$$CS_{1-(p,q)}=\max(x_{1-(p,q)-1}\cdot\alpha_0-K_1,x_{1-(p,q)-2}\cdot\alpha_0-K_1) \quad (1\text{-}a_3)$$

$$CS_{2-(p,q)}=\max(x_{2-(p,q)-1}\cdot\alpha_0-K_2,x_{2-(p,q)-2}\cdot\alpha_0-K_2) \quad (1\text{-}b_3)$$

$$CS_{3-(p,q)}=\max(x_{3-(p,q)-1}\cdot\alpha_0-K_3,x_{3-(p,q)-2}\cdot\alpha_0-K_3) \quad (1\text{-}c_3)$$

Further, a correction signal value having a maximum value from among the first correction signal value $CS_{1-(p,q)}$, second correction signal value $CS_{2-(p,q)}$ and third correction signal value $CS_{3-(p,q)}$ is determined as a fourth correction signal value $CS_{4-(p,q)}$. Further, a correction signal value having a lower value from between the fourth correction signal value $CS_{4-(p,q)}$ and the fifth correction signal value $CS_{5-(p,q)}$ is determined as the fourth subpixel output signal $X_{4-(p,q)}$.

$$SG_{1-(p,q)}=c_{21}(\mathrm{Min}_{(p,q)})\cdot\alpha_0 \quad (2\text{-}1\text{-}1)$$

$$SG_{2-(p,q)}=c_{21}(\mathrm{Min}_{(p,q')})\cdot\alpha_0 \quad (2\text{-}1\text{-}2)$$

$$CS_{5-(p,q)}=\min(SG_{1-(p,q)},SG_{2-(p,q)}) \quad (2\text{-}7)$$

$$CS_{4-(p,q)}=c_{17}\cdot\max(CS_{1-(p,q)},CS_{2-(p,q)},CS_{3-(p,q)}) \quad (1\text{-}d_3)$$

$$X_{4-(p,q)}=\min(CS_{4-(p,q)},CS_{5-(p,q)}) \quad (1\text{-}e_3)$$

Further, regarding the first pixel $Px_{(p,q)-1}$, while the first subpixel output signal $X_{1-(p,q)-1}$ is determined at least based on the first subpixel input signal and the expansion coefficient $\alpha_0$, the first subpixel output signal $X_{1-(p,q)-1}$ is determined based on the first subpixel input signal $x_{1-(p,q)-1}$, the expansion coefficient $\alpha_0$, the fourth subpixel output signal $X_{4-(p,q)}$ and a constant $\chi$, that is, based on $[x_{1-(p,q)-1}, \alpha_0, X_{4-(p,q)}, \chi]$;

while the second subpixel output signal $X_{2-(p,q)-1}$ is determined at least based on the second subpixel input signal and the expansion coefficient $\alpha_0$, the second subpixel output signal $X_{2-(p,q)-1}$ is determined based on the second subpixel input signal $x_{2-(p,q)-1}$, expansion coefficient $\alpha_0$, fourth subpixel output signal $X_{4-(p,q)-1}$ and constant $\chi$, that is, based on $[x_{2-(p,q)-1}, \alpha_0, X_{4-(p,q)}, \chi]$; and while the third subpixel output signal $X_{3-(p,q)-1}$ is determined at least based on the third subpixel input signal and the expansion coefficient $\alpha_0$, the third subpixel output signal $X_{3-(p,q)-1}$ is determined based on the third subpixel input signal $x_{3-(p,q)-1}$, the expansion coefficient $\alpha_0$, the fourth subpixel output signal $X_{4-(p,q)}$ and a constant $\chi$, that is, based on $[x_{3-(p,q)-1}, \alpha_0, X_{4-(p,q)}, \chi]$.

On the other hand, regarding the second pixel $Px_{(p,q)-2}$, while the first subpixel output signal $X_{1-(p,q)-2}$ is determined at least based on the first subpixel input signal and the expansion coefficient $\alpha_0$, the first subpixel output signal $X_{1-(p,q)-2}$ is determined based on the first subpixel input signal $x_{1-(p,q)-2}$, expansion coefficient $\alpha_0$, fourth subpixel output signal $X_{4-(p,q)}$ and constant $\chi$, that is, based on $[x_{1-(p,q)-2}, \alpha_0, X_{4-(p,q)}, \chi]$;

while the second subpixel output signal $X_{2-(p,q)-2}$ is determined at least based on the second subpixel input signal and the expansion coefficient $\alpha_0$, the second subpixel output signal $X_{2-(p,q)-2}$ is determined based on the second subpixel input signal $x_{2-(p,q)-2}$, expansion coefficient $\alpha_0$, fourth subpixel output signal $X_{4-(p,q)}$ and constant $\chi$, that is, based on $[x_{2-(p,q)-2}, \alpha_0, X_{4-(p,q)}, \chi]$; and while the third subpixel output signal $X_{3-(p,q)-2}$ is determined at least based on the third subpixel input signal and the expansion coefficient $\alpha_0$, the third subpixel output signal $X_{3-(p,q)-2}$ is determined based on the third subpixel input signal $x_{3-(p,q)-2}$, the expansion coefficient $\alpha_0$, the fourth subpixel output signal $X_{4-(p,q)}$ and a constant $\chi$, that is, based on $[x_{3-(p,q)-2}, \alpha_0, X_{4-(p,q)}, \chi]$.

The signal processing apparatus 20 can determine the output signal values $X_{1-(p,q)-1}$, $X_{2-(p,q)-1}$, $X_{3-(p,q)-1}$, $X_{1-(p,q)-2}$, $X_{2-(p,q)-2}$ and $X_{3-(p,q)-2}$ based on the expansion coefficient $\alpha_0$ and the constant $\chi$. More particularly, the output signal values can be determined in accordance with the following expressions:

$$X_{1-(p,q)-1}=\alpha_0\cdot x_{1-(p,q)-1}-\chi\cdot X_{4-(p,q)} \quad (2\text{-}A)$$

$$X_{2-(p,q)-1}=\alpha_0\cdot x_{2-(p,q)-1}-\chi\cdot X_{4-(p,q)} \quad (2\text{-}B)$$

$$X_{3-(p,q)-1}=\alpha_0\cdot x_{3-(p,q)-1}-\chi\cdot X_{4-(p,q)} \quad (2\text{-}C)$$

$$X_{1-(p,q)-2}=\alpha_0\cdot x_{1-(p,q)-2}-\chi\cdot X_{4-(p,q)} \quad (2\text{-}D)$$

$$X_{2-(p,q)-2}=\alpha_0\cdot x_{2-(p,q)-2}-\chi\cdot X_{4-(p,q)} \quad (2\text{-}E)$$

$$X_{3-(p,q)-2}=\alpha_0\cdot x_{3-(p,q)-2}-\chi\cdot X_{4-(p,q)} \quad (2\text{-}F)$$

In the following, a method of determining the output signal values $X_{1-(p,q)-1}$, $X_{2-(p,q)-1}$, $X_{3-(p,q)-1}$, $X_{1-(p,q)-2}$, $X_{2-(p,q)-2}$, $X_{3-(p,q)-2}$ and $X_{4-(p,q)}$ of the (p,q)th pixel group $PG_{(p,q)}$, that is, an expansion process, is described. It is to be noted that the following process is carried out so as to keep, in both of a first pixel and a second pixel, or in other words, in each of the pixel groups, the ratio among the luminance of the first primary color displayed by the first subpixel R+fourth subpixel W, the luminance of the second primary color displayed by the second subpixel G+fourth subpixel W and the luminance of the third primary color displayed by the third subpixel B+fourth subpixel W. Besides, the process is carried out so as to keep or maintain the color tone as far as possible. Furthermore, the process is carried out so as to keep or maintain the gradation-luminance characteristic, that is, the gamma characteristic or γ characteristic.

Step 500

First, processes similar to those at steps 100 to 110 in the working example 1 are executed.

Step 510

Then, the signal processing section 20 determines the fourth subpixel output signal value $X_{4-(p,q)}$ to the (p,q)th pixel $P_{x(p,q)}$ in accordance with the expressions (1-$a_3$), (1-$b_3$), (1-$c_3$), (2-1-1), (2-1-2), (2-7), (1-$d_3$) and (1-$e_3$). Then, the signal processing section 20 determines the first subpixel output signal values $X_{1-(p,q)-1}$ and $X_{1-(p,q)-2}$, second subpixel output signal values $X_{2-(p,q)-1}$ and $X_{2-(p,q)-2}$ and third subpixel output signal values $X_{3-(p,q)-1}$ and $X_{3-(p,q)-2}$ to the (p,q)th pixel group $PG_{(p,q)}$ in accordance with the expressions (2-A), (2-B), (2-C), (2-D), (2-E) and (2-F), respectively.

What is significant here resides in that the values of the expressions are expanded by $\alpha_0$. Where the values of the expressions are expanded by $\alpha_0$ in this manner, not only the luminance of the white displaying subpixel, that is, the fourth subpixel W, increases, but also the luminance of the red displaying subpixel, green displaying subpixel and blue displaying subpixel, that is, the first subpixel R, second subpixel G and third subpixel B, increases as seen from the expressions (2-A) to (2-F). In particular, in comparison with an alternative case in which the values of the subpixel output signals are not expanded, the luminance of the entire image increases to $\alpha_0$ times as a result of the expansion of the values of the subpixel output signals by $\alpha_0$. Accordingly, image display of, for example, still pictures can be carried out with a high luminance optimally. Or in order to obtain a luminance of an image equal to the luminance of an image which is not in an expanded state, the luminance of the planar light source apparatus 50 may be reduced based on the expansion coefficient $\alpha_0$. In particular, the luminance of the planar light source apparatus 50 may be reduced to $1/\alpha_0$ time. By this, reduction of the power consumption of the planar light source apparatus can be anticipated.

Figure 19:
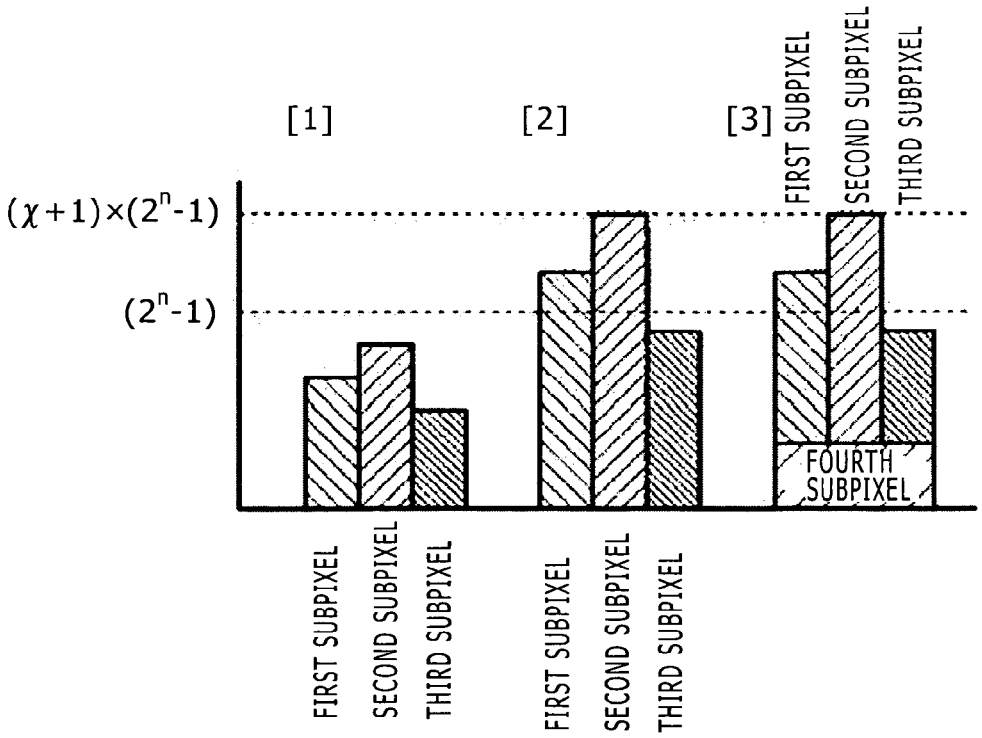
FIG. 19 is a diagrammatic view schematically illustrating input signal values and output signal values in an expansion process in a driving method for the image display apparatus and a driving method for an image display apparatus assembly of the working example 5.

An expansion process in the driving method for the image display apparatus and the driving method for the image display apparatus assembly of the working example 5 is described with reference to FIG. 19. FIG. 19 schematically illustrates input signal values and output signal values. In particular, the input signal values to the set of the first subpixel R, second subpixel G and third subpixel B are indicated by [1]. Meanwhile, those values in a state in which an expansion process, that is, an operation of determining the product of an input signal value and the expansion coefficient $\alpha_0$, is being carried out are indicated by [2]. Further, those in a state after an expansion process is carried out, that is, in a state in which the output signal values $X_{1-(p,q)-1}$, $X_{2-(p,q)-1}$, $X_{3-(p,q)-1}$ and $X_{4-(p,q)-1}$ are obtained, are indicated by [3]. Further, in the example illustrated in FIG. 19, a maximum luminance which can be implemented is obtained by the second subpixel G.

In the driving method for the image display apparatus or the driving method for the image display apparatus assembly of the working example 5, the signal processing section 20 determines the fourth subpixel output signal based on the fourth subpixel control first signal value $SG_{1-(p,q)}$ and the fourth subpixel control second signal value $SG_{2-(p,q)}$ determined from the first, second and third subpixel input signals to the first pixel $Px_1$ and the second subpixel $Px_2$ of each pixel group PG. Then, the signal processing section 20 outputs the determined fourth subpixel output signal. In other words, the fourth subpixel output signal is determined based on the input signals to the first pixel $Px_1$ and the second subpixel $Px_2$ which are positioned adjacent each other. Therefore, optimization of the output signal to the fourth subpixel is achieved. Besides, since one fourth subpixel W is disposed for each pixel group PG configured at least from a first pixel $Px_1$ and a second subpixel $Px_2$, reduction of the area of the opening region for the subpixels can be suppressed. As a result, increase of the luminance can be achieved with certainty, and enhancement of the display quality can be anticipated.

For example, if the length of a pixel along the first direction is represented by $L_1$, then in the technique disclosed in Patent Document 1 or Patent Document 2, since it is necessary to form one pixel from four subpixels, the length of one subpixel along the first direction is $L_1/4=0.25L_1$. On the other hand, in the working example 5, the length of one subpixel along the first direction is $2L_1/7=0.286L_1$. Accordingly, the length of one subpixel along the first direction exhibits an increase by 14% in comparison with the technique disclosed in Patent Document 1 or Patent Document 2.

It is to be noted that, in the working example 5, it is possible to determine the signal values $X_{1-(p,q)-1}$, $X_{2-(p,q)-1}$, $X_{3-(p,q)-1}$, $X_{1-(p,q)-2}$, $X_{2-(p,q)-2}$ and $X_{3-(p,q)-2}$ in accordance, respectively, with $[x_{1-(p,q)-1}, x_{1-(p,q)-2}, \alpha_0, SG_{1-(p,q)}, \chi]$ $[x_{2-(p,q)-1}, x_{2-(p,q)-2}, \alpha_0, SG_{1-(p,q)}, \chi]$ $[x_{3-(p,q)-1}, x_{3-(p,q)-2}, \alpha_0, SG_{1-(p,q)}, \chi]$ $[x_{1-(p,q)-1}, x_{1-(p,q)-2}, \alpha_0, SG_{2-(p,q)}, \chi]$ $[x_{2-(p,q)-1}, x_{2-(p,q)-2}, \alpha_0, SG_{2-(p,q)}, \chi]$ and $[x_{3-(p,q)-1}, x_{3-(p,q)-2}, \alpha_0, SG_{2-(p,q)}, \chi]$.

WORKING EXAMPLE 6

The working example 6 is a modification to the working example 5. In the working example 6, the array state of the first and second pixels and the fourth subpixel W is modified. In particular, in the working example 6, if the first direction is a row direction and the second direction is a column direction as seen from FIG. 16 which schematically illustrates arrangement of the pixels, then the first pixel $Px_1$ in the q'th column where $1 \le q' \le Q-1$ and the second pixel $Px_2$ in the (q'+1)th column are positioned adjacent each other. However, the fourth subpixel W in the q'th column and the fourth subpixel W in the (q'+1)th column are not positioned adjacent each other.

Except this, the image display panel, the driving method for the image display apparatus, image display apparatus assembly and the driving method for the image display apparatus assembly of the working example 6 may be similar to those of the working example 5, and therefore, detailed description of them is omitted herein to avoid redundancy.

WORKING EXAMPLE 7

Also the working example 7 is a modification to the working example 5. Also in the working example 7, the array state of the first and second pixels and the fourth subpixel W, is modified. In particular, in the working example 7, if the first direction is a row direction and the second direction is a column direction as seen from FIG. 17 which schematically illustrates arrangement of the pixels, then the first pixel $Px_1$ in the q'th column where $1 \le q' \le Q-1$ and the first pixel $Px_1$ in the (g'+1)th column are positioned adjacent each other. Further, the fourth subpixel W in the q'th column and the fourth subpixel W in the (q'+1)th column are positioned adjacent each other. In the examples illustrated in FIGS. 15 and 17, the first subpixels R, second subpixels G, third subpixels B and fourth subpixels W are arrayed in an array similar to a stripe array.

Except this, the image display panel, the driving method for the image display apparatus, image display apparatus assembly and the driving method for the image display apparatus assembly of the working example 7 may be similar to those of the working example 5, and therefore, detailed description of them is omitted herein to avoid redundancy.

WORKING EXAMPLE 8

Figure 21:
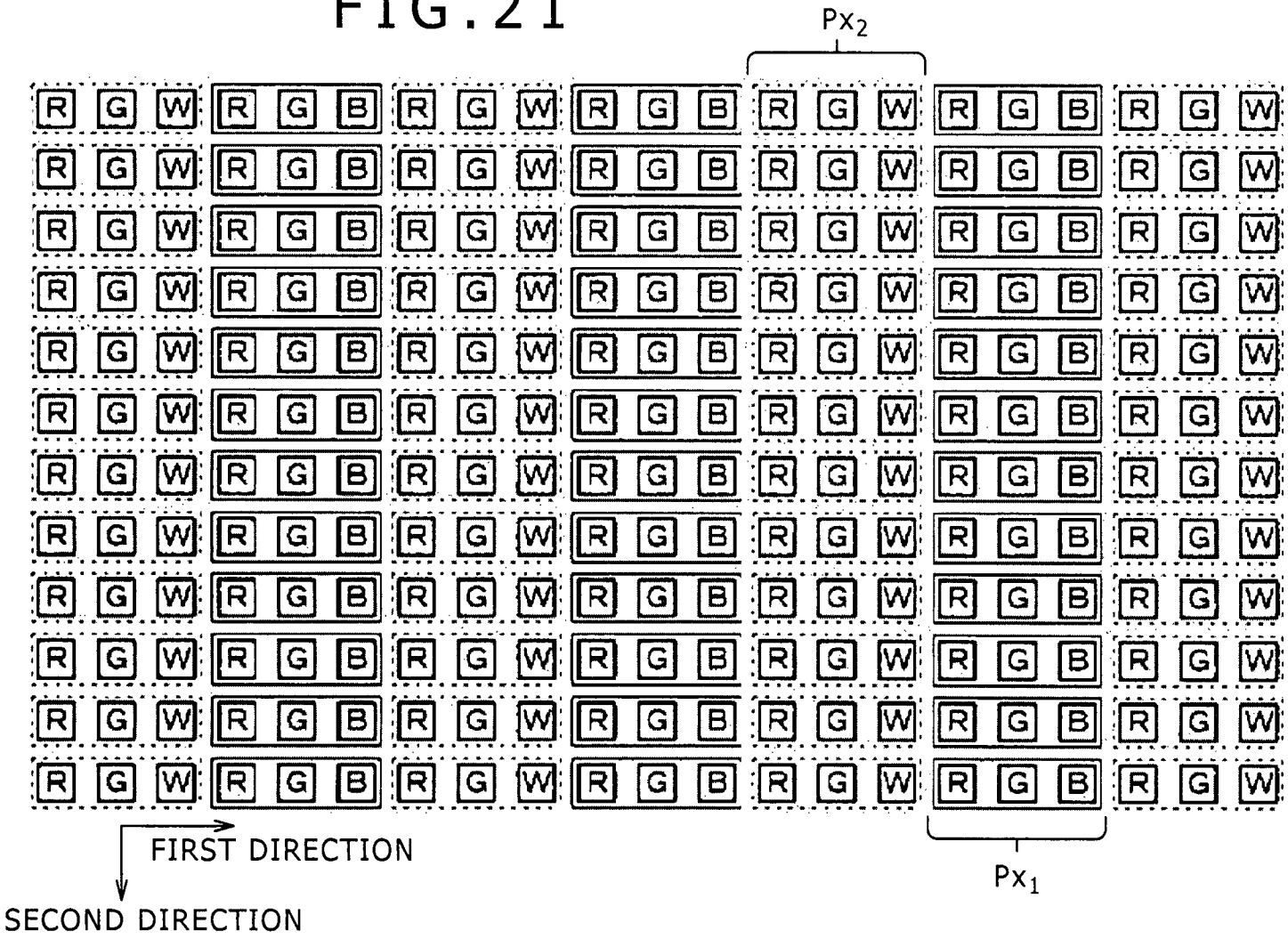
Figure 22:
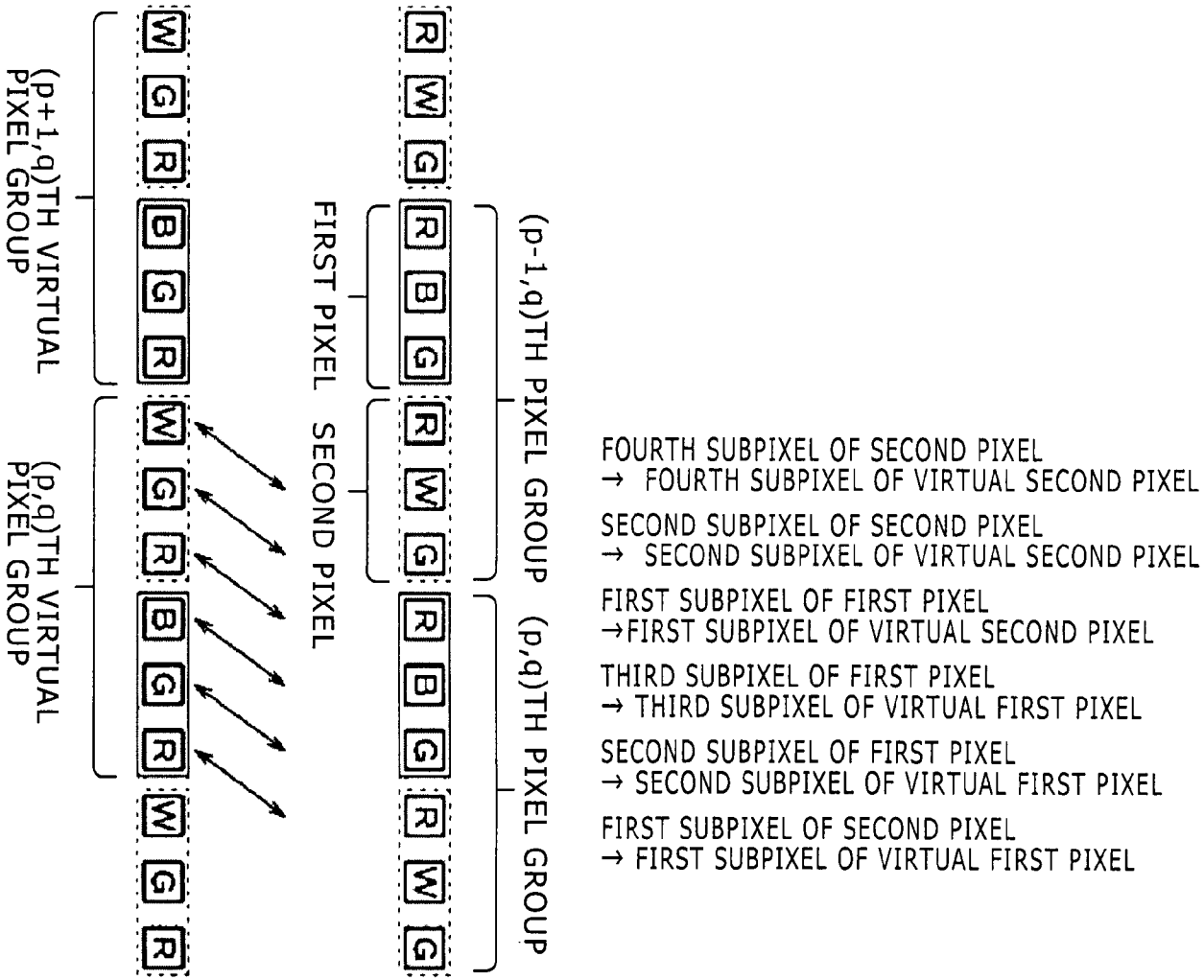
FIG. 22 is a view illustrating a modification to arrangement of first, second, third and fourth subpixels in first and second pixels which configure a pixel group in the working example 9.

The working example 8 relates to the driving method according to the fourth embodiment and the driving method for an image display apparatus assembly according to the fourth embodiment. FIGS. 21 and 22 illustrate arrangement of pixels and pixel groups on an image display panel of the working example 8.

In the working example 8, an image display panel is provided in which totaling P×Q pixel groups PG are arrayed in a two-dimensional matrix including P pixel groups arrayed in a first direction and Q pixel groups arrayed in a second direction. Further, each pixel group PG is configured from a first pixel and a second pixel along the first direction. The first pixel $Px_1$ is configured from a first subpixel R for displaying a first primary color such as, for example, red, a second subpixel G for displaying a second primary color such as, for example, green and a third subpixel B for displaying a third primary color such as, for example, blue. The second pixel $Px_2$ is configured from a first subpixel R for displaying the first primary color such as, for example, red, a second subpixel G for displaying the second primary color such as, for example, green and a fourth subpixel W for displaying a fourth color such as, for example, white. More particularly, in the first pixel $Px_1$, the first subpixel R for displaying the first primary color, second subpixel G for displaying the second primary color and third subpixel B for displaying the third primary color are arrayed successively along the first direction. Meanwhile, in the second pixel $Px_2$, the first subpixel R for displaying the first primary color, second subpixel G for displaying the second primary color and fourth subpixel W for displaying the fourth color are arrayed successively along the first direction. The third subpixel B which configures the first pixel $Px_1$ and the first subpixel R which configures the second pixel $Px_2$ are positioned adjacent each other. Further, the fourth subpixel W which configures the second pixel $Px_2$ and the first subpixel R which configures the first pixel $Px_1$ in a pixel group adjacent the pixel group to which the fourth subpixel W belongs are positioned adjacent each other. It is to be noted that the shape of each subpixel is a rectangular shape, and the suppixels are disposed such that the long side of the rectangular shape is in parallel to the second direction and the short side of the rectangular shape is in parallel to the first direction.

It is to be noted that, in the working example 8, the third subpixel B is determined as a subpixel for displaying blue. This is because the luminous factor of blue is approximately ⅙ in comparison with the luminous factor of green, and a serious problem does not give rise even if the number of subpixels for displaying blue in the pixel groups is set to one half. This similarly applies also to the working examples 9 and 10 hereinafter described.

In the working example 8, to the signal processing section 20, regarding the first pixel $Px_{(p,q)-1}$:

a first subpixel input signal whose signal value is $x_{1-(p,q)-1}$;

a second subpixel input signal whose signal value is $x_{2-(p,q)-1}$; and a third subpixel input signal whose signal value is $x_{3-(p,q)-1}$ are input, and regarding the second pixel $Px_{(p,q)-2}$:

a first subpixel input signal whose signal value is $x_{1-(p,q)-2}$;

a second subpixel input signal whose signal value is $x_{2-(p,q)-2}$; and a third subpixel input signal whose signal value is $x_{3-(p,q)-2}$ are input.

Further, the signal processing section 20 outputs, regarding the first pixel $Px_{(p,q)-1}$:

a first subpixel output signal whose signal value is $X_{1-(p,q)-1}$ for determining a display gradation of the first subpixel R;

a second subpixel output signal whose signal value is $X_{2-(p,q)-1}$ for determining a display gradation of the second subpixel G; and a third subpixel output signal whose signal value is $X_{3-(p,q)-1}$ for determining a display gradation of the third subpixel B; and the signal processing section 20 outputs, regarding the second pixel $Px_{(p,q)-2}$:

a first subpixel output signal whose signal value is $X_{1-(p,q)-2}$ for determining a display gradation of the first subpixel R;

a second subpixel output signal whose signal value is $X_{2-(p,q)-2}$ for determining a display gradation of the second subpixel G; and a fourth subpixel output signal whose signal value is $X_{4-(p,q)}$ regarding the fourth subpixel W for determining a display gradation of the fourth subpixel W.

Further, regarding an adjacent pixel adjacent the (p,q)th pixel, to the signal processing section 20:

a first subpixel input signal whose signal value is $x_{1-(p',q)}$;

a second subpixel input signal whose signal value is $x_{2-(p',q)}$; and a third subpixel input signal whose signal value is $x_{3-(p',q)}$ are input.

Here, while the adjacent pixel is positioned adjacent the second pixel of the (p,q)th pixel along the first direction, particularly in the working example 8, the adjacent pixel is the first pixel of the (p,q)th pixel. Accordingly, a third subpixel control signal value having the signal value $SG_{3-(p,q)}$ is determined based on the first subpixel input signal having the signal value $x_{1-(p,q)-1}$, second subpixel input signal having the signal value $x_{2-(p,q)-1}$ and third subpixel input signal having the signal value $x_{3-(p,q)-1}$, and is substantially equal to a fourth subpixel control first signal value $SG_{1-(p,q)}$.

Then, regarding the first pixel $Px_{(p,q)-1}$:

the first subpixel output signal $X_{1-(p,q)-1}$ is determined at least based on the first subpixel input signal $x_{1-(p,q)-1}$ and an expansion coefficient $\alpha_0$ and is output to the first subpixel R;

the second subpixel output signal $X_{2-(p,q)-1}$ is determined at least based on the second subpixel input signal $x_{2-(p,q)-1}$ and the expansion coefficient $\alpha_0$ and is output to the second subpixel G; and the third subpixel output signal $X_{3-(p,q)-1}$ to the (p,q)th first pixel where p=1, 2, . . . , P and q=1, 2, . . . , Q when the pixels are counted along the first direction is determined at least based on the third subpixel input signal $x_{3-(p,q)-1}$ to the (p,q)th first pixel and the third subpixel input signal $x_{2-(p,q)-3}$ to the (p,q)th second pixel and then is output to the third subpixel B.

Further, regarding the second pixel $Px_{(p,q)-2}$:

the first subpixel output signal $x_{1-(p,q)-2}$ is determined at least based on the first subpixel input signal $x_{1-(p,q)-2}$ and the expansion coefficient $\alpha_0$ and is output to the first subpixel R; and the second subpixel output signal $x_{2-(p,q)-2}$ is determined at least based on the second subpixel input signal $x_{2-(p,q)-2}$ and the expansion coefficient $\alpha_0$ and is output to the second subpixel G.

Then, substantially similarly as in the working example 1 described, the signal processing section 20:

(a) determines a maximum value $V_{max}(S)$ of brightness taking the saturation S in an HSV color space enlarged by adding the fourth color as a variable;

(b) determines the saturation S and brightness V(S) in a plurality of first pixels and second pixels based on subpixel input signal values to the plural first and second pixels; and (c) determines the expansion coefficient $\alpha_0$ based on at least one of values of $V_{max}(S)/V(S)$ determined with regard to the plural first and second pixels.

Further, regarding the (p,q)th pixel group, the signal processing section 20 determines:

a first correction signal value $CS_{1-(p,q)}$ based on the expansion coefficient $\alpha_0$, the first subpixel input signal $x_{1-(p,q)-2}$ to the second pixel, a first subpixel input signal $x_{1-(p',q)}$ to an adjacent pixel adjacent the second pixel along the first direction and a first constant $K_1$;

a second correction signal value $CS_{2-(p,q)}$ based on the expansion coefficient $\alpha_0$, the second subpixel input signal $x_{2-(p,q)-2}$ to the second pixel, a second subpixel input signal $x_{2-(p',q)}$ to the adjacent pixel and a second constant $K_2$; and a third correction signal value $CS_{3-(p,q)}$ based on the expansion coefficient $\alpha_0$, the third subpixel input signal $x_{3-(p,q)-2}$ to the second pixel, a third subpixel input signal $x_{3-(p',q)}$ to the adjacent pixel and a third constant $K_3$.

More particularly, in the working example 8 or the working examples 9 and 10 hereinafter described, the first constant $K_1$ is determined as a maximum value capable of being taken by the first subpixel input signal; the second constant $K_2$ is a determined as a maximum value capable of being taken by the second subpixel input signal; and the third constant $K_3$ is determined as one half (½) of a maximum value capable of being taken by the third subpixel input signal.

Then, in the working example 8, more particularly:

a higher one of a value determined by subtracting the first constant $K_1$ from the product of the expansion coefficient $\alpha_0$ and the first subpixel input signal $x_{1-(p',q)}$ to the adjacent pixel and another value determined by subtracting the first constant $K_1$ from the product of the expansion coefficient $\alpha_0$ and the first subpixel input signal $x_{1-(p,q)-2}$ to the second pixel is determined as the first correction signal value $CS_{1-(p,q)}$;

a higher one of a value determined by subtracting the second constant $K_2$ from the product of the expansion coefficient $\alpha_0$ and the second subpixel input signal $x_{2-(p',q)}$ to the adjacent pixel and another value determined by subtracting the second constant $K_2$ from the product of the expansion coefficient $\alpha_0$ and the second subpixel input signal $x_{2-(p,q)-2}$ to the second pixel is determined as the second correction signal value $CS_{2-(p,q)}$; and a higher one of a value determined by subtracting the third constant $K_3$ from the product of the expansion coefficient $\alpha_0$ and the third subpixel input signal $x_{3-(p',q)}$ to the adjacent pixel and another value determined by subtracting the third constant $K_3$ from the product of the expansion coefficient $\alpha_0$ and the third subpixel input signal $x_{3-(p,q)-2}$ to the second pixel is determined as the third correction signal value $CS_{3-(p,q)}$.

$$CS_{1-(p,q)}=\max(x_{1-(p,q)-2}\cdot\alpha_0-K_1, x_{1-(p',q)}\cdot\alpha_0-K_1) \quad (1\text{-}a_4)$$

$$CS_{2-(p,q)}=\max(x_{2-(p,q)-2}\cdot\alpha_0-K_2, x_{2-(p',q)}\cdot\alpha_0-K_2) \quad (1\text{-}b_4)$$

$$CS_{3-(p,q)}=\max(x_{3-(p,q)-2}\cdot\alpha_0-K_3, x_{3-(p',q)}\cdot\alpha_0-K_3) \quad (1\text{-}c_4)$$

Then, in the (p,q)th pixel group, a correction signal value having a maximum value from among the first correction signal value $CS_{1-(p,q)}$, second correction signal value $CS_{2-(p,q)}$ and third correction signal value $CS_{3-(p,q)}$ is determined as a fourth correction signal value $CS_{4-(p,q)}$, and a fifth correction signal value is determined based on the expansion coefficient $\alpha_0$, first subpixel input signal $x_{1-(p,q)-2}$, second subpixel input signal $x_{2-(p,q)-2}$ and third subpixel input signal $x_{2-(p,q)-3}$ to the second pixel, and the first subpixel input signal $x_{1-(p',q)}$, second subpixel input signal $x_{2-(p',q)}$ and third subpixel input signal $x_{3-(p',q)}$ to the adjacent pixel. Further, in the (p,q)th pixel group, a fourth subpixel output signal $X_{4-(p,q)}$ is determined from the fourth correction signal value $CS_{4-(p,q)}$ and the fifth correction signal value $CS_{5-(p,q)}$ and is output to the fourth subpixel.

$$SG_{3-(p,q)}=c_{21}(\mathrm{Min}_{(p',q)})\cdot\alpha_0 \quad (2\text{-}1\text{-}1)$$

$$SG_{2-(p,q)}=c_{21}(\mathrm{Min}_{(p,q)-2})\cdot\alpha_0 \quad (2\text{-}1\text{-}2)$$

$$CS_{5-(p,q)}=\min(SG_{2-(p,q)}, SG_{3-(p,q)}) \quad (2\text{-}8)$$

$$CS_{4-(p,q)}=c_{17}\cdot\max(CS_{1-(p,q)}, CS_{2-(p,q)}, CS_{3-(p,q)}) \quad (1\text{-}d_4)$$

$$x_{4-(p,q)}=\min(CS_{4-(p,q)}, CS_{5-(p,q)}) \quad (1\text{-}e_4)$$

Further, the signal processing section 20 determines a third subpixel output signal having the signal value $X_{3-(p,q)-1}$ to the (p,q)th first pixel where p=1, 2, . . . , P and q=1, 2, . . . , Q when the pixels are counted along the first direction at least based on the third subpixel input signal having the signal value $x_{3-(p,q)-1}$) to the (p,q)th first pixel and the third subpixel input signal having the signal value $x_{3-(p,q)-2}$ to the (p,q)th second pixel and outputs the third subpixel output signal to the third subpixel B of the (p,q)th first pixel.

Figure 20:
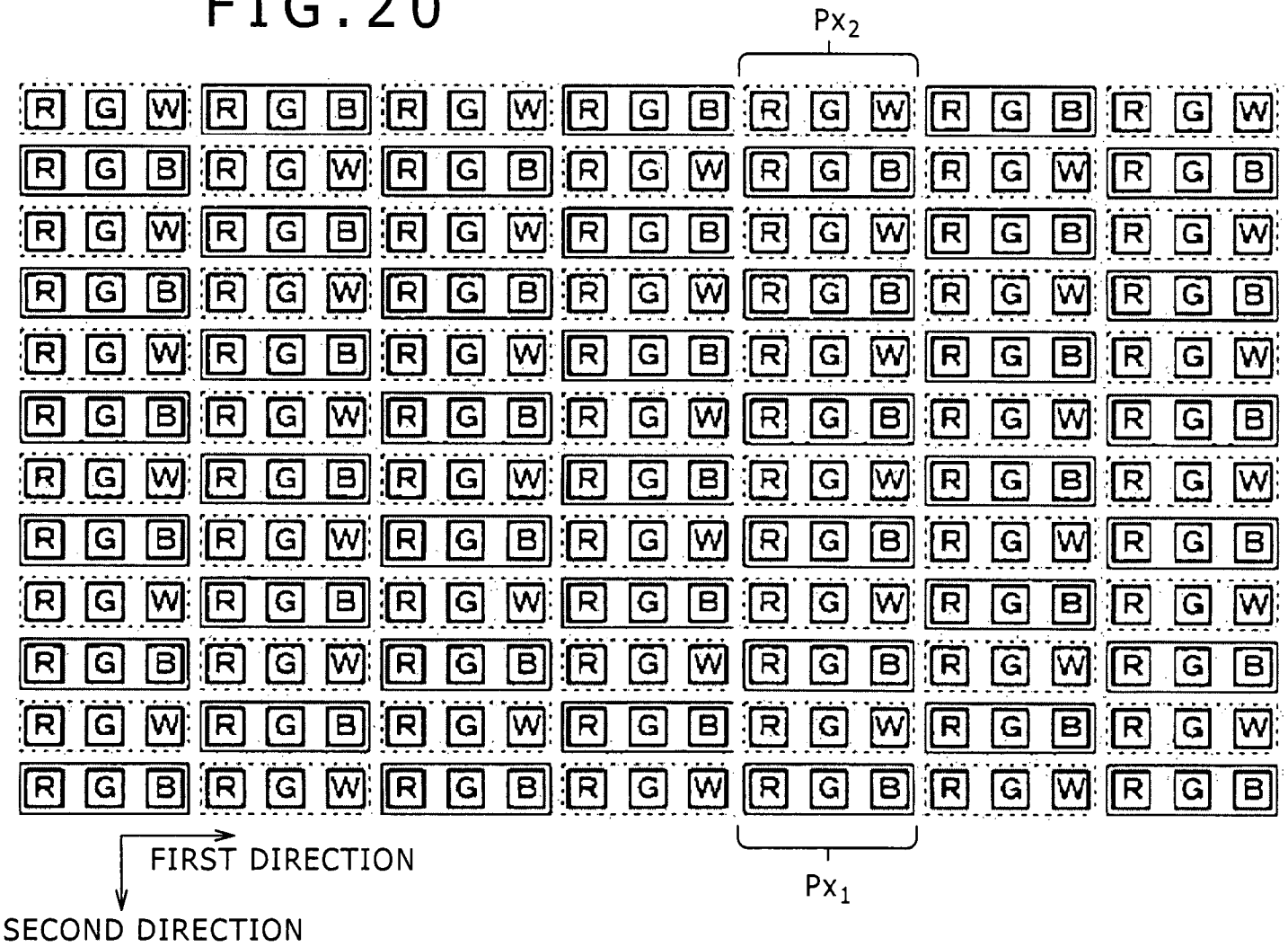
FIGS. 20 and 21 are diagrammatic views schematically showing different examples of arrangement of pixels and pixel groups on an image display panel in a working example 8, 9 or 10.

It is to be noted that, regarding the pixel array of the first and second pixels, the totaling P×Q pixel groups PG including P pixel groups arrayed in the first direction and Q pixel groups arrayed in the second direction are arrayed in a two-dimensional matrix, and such a configuration as shown in FIG. 20 may be applied in which the first pixel $Px_1$ and the second pixel $Px_2$ are disposed in an adjacent relationship to each other along the second direction or such another configuration as shown in FIG. 21 may be applied in which a first pixel $Px_1$ and another first pixel $Px_1$ are disposed in an adjacent relationship to each other along the second direction which a second pixel $Px_2$ and another second pixel $Px_2$ are disposed in an adjacent relationship to each other along the second direction.

Further, regarding the second pixel $Px_{(p,q)-2}$:

while the first subpixel output signal is determined at least based on the first subpixel input signal and the expansion coefficient $\alpha_0$, particularly the first subpixel output signal value $X_{1-(p,q)-2}$ is determined based on the first subpixel input signal value $x_{1-(p,q)-2}$, the expansion coefficient $\alpha_0$, the fourth subpixel output signal $X_{4-(p,q)}$ and a constant $\chi$, that is, $[x_{1-(p,q)-2}, \alpha_0, X_{4-(p,q)}, \chi]$; and while the second subpixel output signal is determined at least based on the second subpixel input signal and the expansion coefficient $\alpha_0$, particularly the second subpixel output signal value $X_{2-(p,q)-2}$ is determined based on the second subpixel input signal value $x_{2-(p,q)-2}$, expansion coefficient $\alpha_0$, fourth subpixel output signal $X_{4-(p,q)}$ and constant $\chi$, that is, $[x_{2-(p,q)-2}, \alpha_0, X_{4-(p,q)}, \chi.]$.

Further, regarding the first pixel $Px_{(p,q)-1}$:

while the first subpixel output signal is determined at least based on the first subpixel input signal and the expansion coefficient $\alpha_0$, particularly the first subpixel output signal value $X_{1-(p,q)-1}$ is determined based on the first subpixel input signal value $x_{1-(p,q)-1}$, expansion coefficient $\alpha_0$, fourth subpixel output signal $X_{4-(p,q)}$ and constant $\chi$, that is, $[x_{1-(p,q)-1}, \alpha_0, X_{4-(p,q)}, \chi]$;

while the second subpixel output signal is determined at least based on the second subpixel input signal and the expansion coefficient $\alpha_0$, particularly the second subpixel output signal value $X_{2-(p,q)-1}$ is determined based on the second subpixel input signal value $x_{2-(p,q)-1}$, expansion coefficient $\alpha_0$, fourth subpixel output signal $X_{4-(p,q)}$ and constant $\chi$, that is, $[x_{2-(p,q)-1}, \alpha_0, X_{4-(p,q)}, \chi]$; and while the third subpixel output signal is determined at least based on the third subpixel input signal and the expansion coefficient $\alpha_0$, particularly the third subpixel output signal value $X_{3-(p,q)-1}$ is determined based on the third subpixel input signal values $x_{3-(p,q)-1}$ and $x_{3-(p,q)-2}$, expansion coefficient $\alpha_0$, fourth subpixel output signal $X_{4-(p,q)}$ and constant $\chi$, that is, $[x_{3-(p,q)-1}$ and $x_{3-(p,q)-2}, \alpha_0, X_{4-(p,q)}, \chi]$.

In particular, the signal processing section 20 can determine the output signal values $X_{1-(p,q)-2}$, $X_{2-(p,q)-2}$, $X_{1-(p,q)-1}$, $X_{2-(p,q)-1}$ and $X_{3-(p,q)-1}$ based on the expansion coefficient $\alpha_0$ and the constant $\chi$, and more particularly, can determine the output signal values in accordance with the following expressions (3-A) to (3-D), (3-af), (3-d) and (3-e):

$$X_{1-(p,q)-2}=\alpha_0 \cdot x_{1-(p,q)-2}-\chi \cdot X_{4-(p,q)} \quad \text{(3-A)}$$

$$X_{2-(p,q)-2}=\alpha_0 \cdot x_{2-(p,q)-2}-\chi \cdot X_{4-(p,q)} \quad \text{(3-B)}$$

$$X_{1-(p,q)-1}=\alpha_0 \cdot x_{1-(p,q)-1}-\chi \cdot X_{4-(p,q)} \quad \text{(3-C)}$$

$$X_{2-(p,q)-1}=\alpha_0 \cdot x_{2-(p,q)-1}-\chi \cdot X_{4-(p,q)} \quad \text{(3-D)}$$

$$X_{3-(p,q)-1}=(X'_{3-(p,q)-1}+X'_{3-(p,q)-2})/2 \quad \text{(3-a')}$$

where $$X'_{3-(p,q)-1}=\alpha_0 \cdot x_{3-(p,q)-1}-\chi \cdot X_{4-(p,q)} \quad \text{(3-d)}$$

$$X'_{3-(p,q)-2}=\alpha_0 \cdot x_{3-(p,q)-2}-\chi \cdot X_{4-(p,q)} \quad \text{(3-e)}$$

A determination method or expansion process for the output signal values $X_{1-(p,q)-2}$, $X_{2-(p,q)-2}$, $X_{4-(p,q)}$, $X_{1(p,q)-1}$, $X_{2-(p,q)-1}$ and $X_{3-(p,q)-1}$ to the (p,q)th pixel group $PG_{(p,q)}$ is described below. It is to be noted that, similarly as in the working example 5, the process described below is carried out such that a ratio of luminance is maintained as far as possible in the entire first and second pixels, that is, in each pixel group. Besides, the process is carried out such that a color tone is maintained. Furthermore, the process is carried out such that a gradation-luminance characteristic, that is, a gamma characteristic or $\gamma$ characteristic, is maintained.

Step 800

First, processes similar to those at steps 100 to 110 in the working example 1 are executed.

Step 810

Then, the signal processing section 20 determines the fourth subpixel output signal value $X_{4-(p,q)}$ to the (p,q)th pixel group $PG_{(p,q)}$ based on the expressions (1-$a_4$), (1-$b_4$), (1-$c_4$), (2-1-1), (2-1-2), (2-8), (1-$d_4$) and (1-$e_4$) given hereinabove. Further, the signal processing section 20 determines the first subpixel output signal values $X_{1-(p,q)-1}$ and $X_{1-(p,q)-2}$, second subpixel output signal values $X_{2-(p,q)-1}$ and $X_{2-(p,q)-2}$, and third subpixel output signal value $X_{3-(p,q)-1}$ to the (p,q)th pixel group $PG_{(p,q)}$ based on the expressions (3-A), (3-B), (3-C), (3-D), (3-a'), (3-d) and (3-e).

It is to be noted that, in each pixel group, ratios of the output signal values in the first and second pixels:

$X_{1-(p,q)-1}:X_{2-(p,q)-1}:X_{3-(p,q)-1}$;

$X_{1-(p,q)-2}:X_{2-(p,q)-2}$;

are different a little from ratios of the input signal values:

$x_{1-(p,q)-1}:x_{2-(p,q)-1}:x_{3-(p,q)-1}$;

$x_{1-(p,q)-2}:x_{2-(p,q)-2}$

Therefore, where the pixels are viewed individually, although color tones regarding the pixels are different a little from each other with respect to the input signal, where the pixels are viewed as pixel groups, no problem occurs with the color tone of each pixel group. This similarly applies also to the following description.

Also in the working example 8, what is significant is that the values of the expressions are expanded by the expansion coefficient $\alpha_0$. By expanding the values of the expressions by the expansion coefficient $\alpha_0$ in this manner, not only the luminance of the white display subpixel, that is, the fourth subpixel W, increases but also the luminance of the red display subpixel, green display subpixel and blue display subpixel, that is, the first subpixel R, second subpixel G, third subpixel B, increases as represented by the expressions (3-A) to (3-D), (3-a'), (3-d) and (3-e). In particular, in comparison with a case in which the values regarding the subpixel output signal values are not expanded, by expanding the values regarding the subpixel output signal values by the expansion coefficient $\alpha_0$, the luminance increases to $\alpha_0$ times over the overall image. Accordingly, for example, image display of a still picture or the like can be carried out with high luminance, which is optimum. Or, in order to obtain luminance of an image equal to the luminance of an image in a non-expanded state, the luminance of the planar light source apparatus 50 may be decreased based on the expansion coefficient $\alpha_0$. In particular, the luminance of the planar light source apparatus 50 may be set to $1/\alpha_0$ time. Consequently, reduction of power consumption of the planar light source apparatus can be achieved. This similarly applies also to the working examples 9 and 10 hereinafter described.

Further, regarding the driving method for an image display apparatus or the driving method for an image display apparatus assembly in the working example 8, the signal processing section 20 determines and outputs the fourth subpixel output signal based on the fourth subpixel control first signal value $SG_{1-(p,q)}$ determined from the first, second and third subpixel input signals to the first pixel $Px_1$ and the second pixel $Px_2$ of each pixel group PG and the third subpixel controlling signal value $SG_{3-(p,q)}$. In particular, since the fourth subpixel output signal is determined based on the input signals to the first pixel $Px_1$ and the second pixel $Px_2$ which are positioned adjacent each other, optimization of the output signal to the fourth subpixel W is achieved. Besides, since one third subpixel B and one fourth subpixel W are disposed in the pixel group PG configured at least from the first pixel $Px_1$ and the second pixel $Px_2$, reduction of the area of the opening region for the subpixels can be suppressed further. As a result, increase of the luminance can be achieved with certainty. Further, enhancement of display quality can be achieved.

WORKING EXAMPLE 9

The working example 9 is a modification to the working example 8. In the working example 8, a pixel adjacent the (p,q)th second pixel along the first direction is determined as the adjacent pixel. On the other hand, in the working example 9, a (p+1,q)th first pixel is determined as the adjacent pixel. The disposition of the pixels in the working example 9 is similar to that of the working example 8, and is same as that schematically shown in FIG. 20 or FIG. 21.

It is to be noted that, in the example shown in FIG. 20, the first pixel and the second pixel are disposed in an adjacent relationship to each other along the second direction. In this instance, along the second direction, a first subpixel R which configures the first pixel and another first subpixel R which configures the second pixel may be disposed in an adjacent relationship to each other or may not be disposed in an adjacent relationship to each other. Similarly, along the second direction, a second subpixel G which configures the first pixel and another second subpixel G which configures the second pixel may be disposed in an adjacent relationship to each other or may not be disposed in an adjacent relationship to each other. Similarly, along the second direction, a third subpixel B which configures the first pixel and a fourth subpixel W which configures the second pixel may be disposed in an adjacent relationship to each other or may not be disposed in an adjacent relationship to each other. On the other hand, in the example shown in FIG. 21, along the second direction, a first pixel and another first pixel are disposed in an adjacent relationship to each other and a second pixel and another second pixel are disposed in an adjacent relationship to each other. Also in this instance, along the second direction, a first subpixel R which configures the first pixel and another first subpixel R which configures the second pixel may be disposed in an adjacent relationship to each other or may not be disposed in an adjacent relationship to each other. Similarly, along the second direction, a second subpixel G which configures the first pixel and another second subpixel G which configures the second pixel may be disposed in an adjacent relationship to each other or may not be disposed in an adjacent relationship to each other. Similarly, along the second direction, a third subpixel B which configures the first pixel and a fourth subpixel W which configures the second pixel may be disposed in an adjacent relationship to each other or may not be disposed in an adjacent relationship to each other. This can similarly apply also to the working example 8 or the working example 10 hereinafter described.

In the working example 9, similarly as in the working example 8, the third subpixel output signal value $X_{3-(p,q)-1}$ to a (p,q)th first pixel $Px_{(p,q)-1}$ is determined at least based on the third subpixel input signal value $x_{3-(p,q)-1}$ to the (p,q)th first pixel $Px_{(p,q)-1}$ and the third subpixel input signal value $x_{3-(p,q)-2}$ to a (p,q)th second pixel $Px_{(p,q)-2}$ and is output to the third subpixel B.

On the other hand, different from the working example 8, the fourth subpixel output signal value $X_{4-(p,q)}$ to the (p,q)th second pixel $Px_2$ is determined based on the fourth subpixel controlling second signal value $SG_{2-(p,q)}$ obtained from the first subpixel input signal value $x_{1-(p,q)-2}$, second subpixel input signal value $x_{2-(p,q)-2}$ and third subpixel input signal value $x_{3-(p,q)-2}$ to the (p,q)th second pixel $Px_{(p,q)-2}$ and the third subpixel controlling signal value $SG_{3-(p,q)}$ obtained from the first subpixel input signal value $x_{1-(p',q)}$, second subpixel input signal value $x_{2-(p',q)}$ and third subpixel input signal value $x_{3-(p',q)}$ to a (p+1,q)th first pixel $Px_{(p+1,q)-1}$, and the determined value is output to the fourth subpixel W.

In this manner, the fourth subpixel output signal to the (p,q)th second pixel is determined not based on the third subpixel input signal to the (p,q)th first pixel and the third subpixel input signal to the (p,q)th second pixel but at least based on the third subpixel input signal to the (p,q)th second pixel and the third subpixel input signal to the (p+1,q)th first pixel. In particular, since the fourth subpixel output signal to the second pixel which configures a certain pixel group is determined not only based on the input signal to the second pixel which configures the certain pixel group but also based on the input signal to the first pixel which configures a pixel group adjacent the second pixel, further optimization of the output signal to the fourth subpixel is achieved.

A determination method or expansion process for the output signals $X_{1-(p,q)-2}$, $X_{2-(p,q)-2}$, $X_{4-(p,q)}$, $X_{1-(p,q)-1}$, $X_{2-(p,q)-1}$ and $X_{3-(p,q)-1}$ of the (p,q)th pixel group $PG_{(p,q)}$ is described below. It is to be noted that the process described below is carried out so that a gradation-luminance characteristic, that is, a gamma characteristic or γ characteristic, is maintained. Further, the process described below is carried out so that the ratio in luminance is maintained as far as possible in the entire first and second pixels, that is, in each pixel group, and besides, the process is carried out so that the color tone is maintained as far as possible.

Step-900

First, processes similar to those at steps 100 to 110 in the working example 1 are executed.

Step-910

Then, similarly as in the working example 8, the signal processing section 20 determines the fourth subpixel output signal value $X_{4-(p,q)}$ to the (p,q)th pixel group $PG_{(p,q)}$ based on the expressions (1-$a_4$), (1-$b_4$), (1-$c_4$), (2-1-1), (2-1-2), (2-8), (1-$d_4$) and (1-$e_4$) given hereinabove. Further, the first subpixel output signal values $X_{1-(p,q)-1}$ and $X_{1-(p,q)-2}$, second subpixel output signal values $X_{2-(p,q)-1}$ and $X_{2-(p,q)-2}$, and third subpixel output signal value $X_{3-(p,q)-1}$ to the (p,q)th pixel group $PG_{(p,q)}$ are determined based on the expressions (3-A), (3-B), (3-C), (3-D), (3-a'), (3-d) and (3-e).

Such a configuration may be adopted that, if the relationship between the fourth subpixel control first signal value $SG_{1-(p,q)}$ and the fourth subpixel control second signal value $SG_{2-(p,q)}$ satisfies a certain condition, for example, then the working example 8 is executed, but, if the certain condition is not satisfied, for example, then the working example 9 is executed. For example, in the case where a process based on $$CS_{5-(p,q)}=\min(SG_{2-(p,q)},SG_{3-(p,q)}) \tag{2-8}$$

is carried out, if the value of $|SG_{1-(p,q)}-SG_{2-(p,q)}|$ is higher, or lower, than a predetermined value $\Delta X_1$, then the working example 8 may be executed, but, in any other case, the working example 9 may be executed. Or, for example, if the value of $|SG_{1-(p,q)}-SG_{2-(p,q)}|$ is higher, or lower, than the predetermined value $\Delta X_1$, then a value only based on the value $SG_{1-(p,q)}$ may be applied or a value only based on the value $SG_{2-(p,q)}$ may be applied as the value $X_{4-(p,q)}$, and the working example 8 or 9 can be applied. Or, in each of a case in which the value of "$SG_{1-(p,q)}-SG_{2-(p,q)}$" is higher than a predetermined value $\Delta X_2$ and another case in which the value of "$SG_{1(p,q)}-SG_{2-(p,q)}$" is lower than a predetermined value $\Delta X_3$, the working example 8 or the working example 9 may be executed, but in any other case, the working example 9 or the working example 8 may be executed.

In the working example 8 or 9, where the array order of the subpixels which configure the first pixel and the second pixel is represented as [(first pixel) (second pixel)], the subpixels are arrayed in the order of

[(first subpixel R, second subpixel G, third subpixel B) (first subpixel R, second subpixel G, fourth subpixel W)]

is adopted, or, where the array order is represented as [(second pixel), (first pixel)], the subpixels are arrayed in the order of

[(fourth subpixel W, second subpixel G, first subpixel R) (third subpixel B, second subpixel G, first subpixel R)]

However, the array order of the subpixels is not limited to such array orders as just described. For example, in the case of the array order of [(first pixel) (second pixel)], the order of

[(first subpixel R, third subpixel B, second subpixel G) (first subpixel R, fourth subpixel W, second subpixel G)]

may be adopted.

While such a state as described above in the working example 9 is illustrated at the upper stage of FIG. 22, if a point of view is changed, then the array order is equivalent to an array order in which three subpixels including the first subpixel R in the first pixel of the (p,q)th pixel group and the second subpixel G and the fourth subpixel W in the second pixel of the (p−1,q)th pixel group are virtually considered as (first subpixel R, second subpixel G, fourth subpixel W) of the second pixel of the (p,q)th pixel group as indicated by a virtual pixel partition at the lower stage of FIG. 22. Further, the array order is equivalent to an array order in which the three subpixels including the first subpixel R in the second pixel of the (p,q)th pixel group and the second subpixel G and third subpixel B in the first pixel are considered as the first pixel of the (p,q)th pixel group. Therefore, the working example 9 may be applied to the first pixel and the second pixel which configure a virtual pixel group described above. Further, while the first direction is represented as a direction from the left toward the right in the working example 8 or 9, the first direction may be determined as a direction from the right toward the left as in the array order [(second pixel) (first pixel)].

WORKING EXAMPLE 10

The working example 10 relates to the driving method according to the fifth embodiment and the driving method for an image display apparatus assembly according to the fifth embodiment. Disposition of the pixels and pixel groups on the image display panel of the working example 10 is similar to that of the working example 8 and is same as that schematically shown in FIG. 20 or 21.

In the image display panel 30 of the working example 10, totaling P×Q pixel groups including P pixel groups arrayed in the first direction such as, for example, a horizontal direction and Q pixel groups displayed in the second direction such as, for example, a vertical direction, are arrayed in a two-dimensional matrix. It is to be noted that, where the number of pixels which configure a pixel group is indicated by $p_0$, $p_0=2$. In particular, as shown in FIG. 20 or 21, in the image display panel 30 in the working example 10, the pixel groups are individually configured from a first pixel $Px_1$ and a second pixel $Px_2$ along the first direction. Further, the first pixel $Px_1$ includes a first subpixel R for displaying a first primary color such as, for example, red, a second subpixel G for displaying a second primary color such as, for example, green and a third subpixel B for displaying a third primary color such as, for example, blue. On the other hand, the second pixel $Px_2$ includes a first subpixel R for displaying the first primary color, a second subpixel G for displaying the second primary color and a fourth subpixel W for displaying a fourth color such as, for example, white. More particularly, in the first pixel $Px_1$, the first subpixel R for displaying the first primary color, second subpixel G for displaying the second primary color and third subpixel B for displaying the third primary color are successively arrayed along the first direction. Meanwhile, in the second pixel $Px_2$, the first subpixel R for displaying the first primary color, second subpixel G for displaying the second primary color and fourth subpixel W for displaying the fourth color are successively arrayed along the first direction. The third subpixel B which configures the first pixel $Px_1$ and the first subpixel R which configures the second pixel $Px_2$ are positioned adjacent each other. Further, the fourth subpixel W which configures the second pixel $Px_2$ and the first subpixel R which configures the first pixel $Px_1$ in a pixel group adjacent the pixel group to which the second pixel just described belongs are positioned adjacent each other. It is to be noted that the shape of the subpixels is a rectangular shape, and the subpixels are disposed such that the long side of the rectangular shape extends in parallel to the second direction and the short side extends in parallel to the first direction. It is to be noted that, in the example shown in FIG. 20, the first pixel and the second pixel are disposed in an adjacent relationship to each other along the second direction. On the other hand, in the example shown in FIG. 21, a first pixel and another first pixel are disposed in an adjacent relationship to each other and a second pixel and another second pixel are disposed in an adjacent relationship to each other along the second direction.

Here, in the working example 10, regarding a first pixel $Px_{(p,q)-1}$ which configures a (p,q)th pixel group $PG_{(p,q)}$ where $1 \le p \le P$ and $1 \le q \le Q$, to the signal processing section 20, a first subpixel input signal having a signal value $x_{1-(p,q)-1}$, a second subpixel input signal having a signal value $x_{2-(p,q)-1}$, and a third subpixel input signal having a signal value $x_{3-(p,q)-1}$ are input, and regarding a second pixel $Px_{(p,q)-2}$ which configures the (p,q)th pixel group $PG_{(p,q)}$, a first subpixel input signal having a signal value $x_{1-(p,q)-2}$, a second subpixel input signal having a signal value $x_{2-(p,q)-2}$, and a third subpixel input signal having a signal value $x_{3-(p,q)-2}$ are input.

Further, in the working example 10, the signal processing section 20 outputs, regarding the first pixel $Px_{(p,q)-1}$ which configures the (p,q) th pixel group $PG_{(p,q)}$, a first subpixel output signal having a signal value $X_{1-(p,q)-1}$ for determining a display gradation of the first subpixel R, a second subpixel output signal having a signal value $X_{2-(p,q)-1}$ for determining a display gradation of the second subpixel G, and a third subpixel output signal having a signal value $X_{3-(p,q)-1}$ for determining a display gradation of the first subpixel B, and regarding the second pixel $PX_{(p,q)-2}$ which configures the (p,q)th pixel group $PG_{(p,q)}$, a first subpixel output signal having a signal value $X_{1-(p,q)-2}$ for determining a display gradation of the first subpixel R, a second subpixel output signal having a signal value $X_{2-(p,q)-2}$ for determining a display gradation of the second subpixel G, and a fourth subpixel output signal having a signal value $X_{4-(p,q)}$ for determining a display gradation of the fourth subpixel W.

Further, regarding an adjacent pixel which is positioned adjacent the (p,q)th second pixel, to the signal processing section 20, a first subpixel input signal having a signal value $x_{1-(p,q')}$, a second subpixel input signal having a signal value $x_{2-(p,q')}$, and a third subpixel input signal having a signal value $x_{3-(p,q')}$ are input.

Then, in the working example 10, the signal processing section 20 determines the first subpixel output signal to the first pixel $Px_1$ at least based on the first subpixel input signal to the first pixel $Px_1$ and the expansion coefficient $\alpha_0$ and outputs the first subpixel output signal to the first subpixel R of the first pixel $Px_1$;

determines the second subpixel output signal to the first pixel $Px_1$ at least based on the second subpixel input signal to the first pixel $Px_1$ and the expansion coefficient $\alpha_0$ and outputs the second subpixel output signal to the second subpixel G of the first pixel $Px_1$; and determines the third subpixel output signal $X_{3-(p,q)-1}$ based on the third subpixel input signal $x_{3-(p,q)-1}$ to the (p,q)th first pixel $Px_{(p,q)-1}$ where p=1, 2, . . . , P and q=1, 2, . . . , Q when the pixels are counted along the second direction and the third subpixel output signal $X_{3-(p,q)-1}$ based on the third subpixel input signal $x_{3-(p,q)-2}$ to the (p,q)th second pixel $Px_{(p,q)-2}$ and outputs the third subpixel output signal $X_{3-(p,q)-1}$ to the third subpixel B.

Further, the signal processing section 20 determines the first subpixel output signal to the second pixel $Px_2$ at least based on the first subpixel input signal to the second pixel $Px_2$ and the expansion coefficient $\alpha_0$ and outputs the first subpixel output signal to the first subpixel R of the second pixel $Px_2$. Further, the signal processing section 20 determines the second subpixel output signal to the second pixel $Px_2$ at least based on the second subpixel input signal to the second pixel $Px_2$ and the expansion coefficient $\alpha_0$ and outputs the second subpixel output signal to the second subpixel G of the second pixel $Px_2$.

Then, substantially similarly as in the description of the working example 1, the signal processing section 20

(a) determines a maximum value $V_{max}(S)$ of brightness taking the saturation S in an HSV color space enlarged by adding the fourth color as a variable;

(b) determines the saturation S and brightness V(S) in a plurality of first pixels and second pixels based on subpixel input signal values to the plural first and second pixels; and (c) determines the expansion coefficient $\alpha_0$ based on at least one of values of $V_{max}(S)/V(S)$ determined with regard to the plural first and second pixels.

Further, regarding the (p,q)th pixel group, the signal processing section 20 determines:

a first correction signal value $CS_{1-(p,q)}$ based on the expansion coefficient $\alpha_0$, the first subpixel input signal $X_{1-(p,q)-2}$ to the second pixel, a first subpixel input signal $x_{1-(p,q')}$ to an adjacent pixel adjacent the second pixel along the second direction and a first constant $K_1$;

a second correction signal value $CS_{2-(p,q)}$ based on the expansion coefficient $\alpha_0$, the second subpixel input signal $x_{2-(p,q)-2}$ to the second pixel, a second subpixel input signal $x_{2-(p,q')}$ to the adjacent pixel and a second constant $K_2$; and a third correction signal value $CS_{3-(p,q)}$ based on the expansion coefficient $\alpha_0$, the third subpixel input signal $x_{3-(p,q)-2}$ to the second pixel, a third subpixel input signal $x_{3-(p,q')}$ to the adjacent pixel and a third constant $K_3$.

More particularly, in the working example 10:

the first correction signal value $CS_{1-(p,q)}$ is set to a higher one of a value determined by subtracting the first constant $K_1$ from the product of the expansion coefficient $\alpha_0$ and the first subpixel input signal $x_{1-(p,q')}$ to the adjacent pixel and another value determined by subtracting the first constant $K_1$ from the product of the expansion coefficient $\alpha_0$ and the first subpixel input signal $x_{1-(p,q)-2}$ to the second pixel;

the second correction signal value $CS_{2-(p,q)}$ is set to a higher one of a value determined by subtracting the second constant $K_2$ from the product of the expansion coefficient $\alpha_0$ and the second subpixel input signal $x_{2-(p,q')}$ to the adjacent pixel and another value determined by subtracting the second constant $K_2$ from the product of the expansion coefficient $\alpha_0$ and the second subpixel input signal $x_{2-(p,q)-2}$ to the second pixel; and the third correction signal value $CS_{3-(p,q)}$ is set to a higher one of a value determined by subtracting the third constant $K_3$ from the product of the expansion coefficient $\alpha_0$ and the third subpixel input signal $x_{3-(p,q')}$ to the adjacent pixel and another value determined by subtracting the third constant $K_3$ from the product of the expansion coefficient $\alpha_0$ and the third subpixel input signal $x_{3-(p,q)-2}$ to the second pixel.

$$CS_{1-(p,q)}=\max(x_{1-(p,q)-2}\cdot\alpha_0-K_1, x_{1-(p,q')}\cdot\alpha_0-K_1) \quad (1\text{-}a_5)$$

$$CS_{2-(p,q)}=\max(x_{2-(p,q)-2}\cdot\alpha_0-K_2, x_{2-(p,q')}\cdot\alpha_0-K_2) \quad (1\text{-}b_5)$$

$$CS_{3-(p,q)}=\max(x_{3-(p,q)-2}\alpha_0-K_3, x_{3-(p,q')}\cdot\alpha_0-K_3) \quad (1\text{-}c_5)$$

Then, in the (p,q)th pixel group, a correction signal value having a maximum value from among the first correction signal value $CS_{1-(p,q)}$, second correction signal value $CS_{2-(p,q)}$ and third correction signal value $CS_{3-(p,q)}$ is determined as a fourth correction signal value $CS_{4-(p,q)}$, and a fifth correction signal value is determined based on the expansion coefficient $\alpha_0$, first subpixel input signal $x_{1-(p,q)-2}$, second subpixel input signal $x_{2-(p,q)-2}$ and third subpixel input signal $x_{2-(p,q)-3}$ to the second pixel, and the first subpixel input signal $x_{1-(p,q')}$, second subpixel input signal $x_{2-(p,q')}$ and third subpixel input signal $x_{3-(p,q')}$ to the adjacent pixel. Further, in the (p,q)th pixel group, a fourth subpixel output signal $X_{4-(p,q)}$ is determined from the fourth correction signal value $CS_{4-(p,q)}$ and the fifth correction signal value $CS_{5-(p,q)}$ and is output to the fourth subpixel.

$$SG_{3-(p,q)}=c_{21}(\mathrm{Min}_{(p,q')})\cdot\alpha_0 \quad (2\text{-}1\text{-}1)$$

$$SG_{2-(p,q)}=c_{21}(\mathrm{Min}_{(p,q)-2})\cdot\alpha_0 \quad (2\text{-}1\text{-}2)$$

$$CS_{5-(p,q)}=\min(SG_{2-(p,q)}, SG_{3-(p,q)}) \quad (2\text{-}8)$$

$$CS_{4-(p,q)}=c_{17}\cdot\max(CS_{1-(p,q)}, CS_{2-(p,q)}, CS_{3-(p,q)}) \quad (1\text{-}d_5)$$

$$X_{4-(p,q)}=\min(CS_{4-(p,q)}, CS_{5-(p,q)}) \quad (1\text{-}e_5)$$

Further, regarding the second pixel $Px_2$, similarly as in the working example 8:

while the first subpixel output signal $X_{1-(p,q)-2}$ is determined at least based on the first subpixel input signal $x_{1-(p,q)-2}$ and the expansion coefficient $\alpha_0$, particularly the first subpixel output signal having the signal value $X_{1-(p,q)-2}$ is determined at least based on the first subpixel input signal value $x_{1-(p,q)-2}$, the expansion coefficient $\alpha_0$ and the fourth subpixel output signal $x_{4-(p,q)}$; and while the second subpixel output signal $X_{2-(p,q)-2}$ is determined at least based on the second subpixel input signal $x_{2-(p,q)-2}$ and the expansion coefficient $\alpha_0$, particularly the second subpixel output signal having the signal value $X_{2-(p,q)-2}$ is determined at least based on the second subpixel input signal value $x_{2-(p,q)-2}$, expansion coefficient $\alpha_0$ and fourth subpixel output signal $X_{4-(p,q)}$.

Further, regarding the first pixel $Px_1$:

while the first subpixel output signal $X_{1-(p,q)-1}$ is determined at least based on the first subpixel input signal $x_{1-(p,q)-1}$ and the expansion coefficient $\alpha_0$, particularly the first subpixel output signal having the signal value $X_{1-(p,q)-1}$ is determined at least based on the first subpixel input signal value $x_{1-(p,q)-1}$, expansion coefficient $\alpha_0$ and fourth subpixel output signal $X_{4-(p,q)}$;

while the second subpixel output signal $X_{2-(p,q)-1}$ is determined at least based on the second subpixel input signal $x_{2-(p,q)-1}$ and the expansion coefficient $\alpha_0$, particularly the second subpixel output signal having the signal value $X_{2-(p,q)-1}$ is determined at least based on the second subpixel input signal value $x_{2-(p,q)-1}$, expansion coefficient $\alpha_0$ and fourth subpixel output signal $X_{4-(p,q)}$; and while the third subpixel output signal $X_{3-(p,q)-1}$ is determined at least based on the third subpixel input signal $x_{3-(p,q)-1}$ and the expansion coefficient $\alpha_0$, particularly the third subpixel output signal having the signal value $X_{3-(p,q)-1}$ is determined at least based on the third subpixel input signal values $x_{3-(p,q)-1}$ and $x_{3-(p,q)-2}$, expansion coefficient $\alpha_0$ and fourth subpixel output signal $X_{4-(p,q)}$.

More particularly, in the driving method of the working example 10, the signal processing section 20 can determine the output signal values $X_{1-(p,q)-2}$, $X_{2-(p,q)-2}$, $X_{1-(p,q)-1}$ and $X_{2-(p,q)-1}$ in accordance with the following expressions:

$$X_{1-(p,q)-2}=\alpha_0 \cdot x_{1-(p,q)-2}-\chi \cdot x_{4-(p,q)} \quad (3\text{-A})$$

$$X_{2-(p,q)-2}=\alpha_0 \cdot x_{2-(p,q)-2}-\chi \cdot x_{4-(p,q)} \quad (3\text{-B})$$

$$X_{1-(p,q)-1}=\alpha_0 \cdot x_{1-(p,q)-1}-\chi \cdot x_{4-(p,q)} \quad (3\text{-C})$$

$$X_{2-(p,q)-1}=\alpha_0 \cdot x_{2-(p,q)-1}-\chi \cdot x_{4-(p,q)} \quad (3\text{-D})$$

Further, the third subpixel output signal, that is, the third subpixel output signal value $X_{3-(p,q)-1}$, can be determined, where $C_{11}$ and $C_{12}$ are constants such as, for example, "1," in accordance with the following expressions:

$$X_{3-(p,q)-1}=(C_{11} \cdot X'_{3-(p,q)-1}+C_{12} \cdot X'_{3-(p,q)-2})/(C_{11}+C_{12}) \quad (3\text{-a})$$

where $$X'_{3-(p,q)-1}=\alpha_0 \cdot x_{3-(p,q)-1}-\chi \cdot X_{4-(p,q)} \quad (3\text{-d})$$

$$X'_{3-(p,q)-2}=\alpha_0 \cdot x_{3-(p,q)-2}-\chi \cdot X_{4-(p,q)} \quad (3\text{-e})$$

It is to be noted that, in the working example 10, the adjacent pixel positioned adjacent the (p,q)th pixel is the (p,q−1)th pixel. However, the adjacent pixel is not limited to this, but may be the (p,q+1)th pixel or may be both of the (p,q−1)th pixel and the (p,q+1)th pixel.

In the following, a method of determining the output signal values $X_{1-(p,q)-2}$, $X_{2-(p,q)-2}$, $X_{4-(p,q)}$, $X_{1-(p,q)-1}$, $X_{2-(p,q)-1}$, and $X_{3-(p,q)-1}$ of the (p,q)th pixel group $PG_{(p,q)}$ is described. It is to be noted that the following process is carried out such that the gradation-luminance characteristic, that is, the gamma characteristic or γ characteristic, is kept or maintained. Further, the following process is carried out so as to keep, in both of a first pixel and a second pixel, or in other words, in each of the pixel groups, the ratio in luminance as far as possible, and besides carried out so as to keep or maintain the color tone as far as possible.

Step 1000

First, processes similar to those at steps 100 to 110 in the working example 1 are executed.

Step 1010

Then, the signal processing section 20 determines the fourth subpixel output signal value $X_{4-(p,q)}$ to the (p,q)th pixel group $PG_{(p,q)}$ in accordance with the expressions (1-$a_5$), (1-$b_5$), (1-$c_5$), (2-1-1), (2-1-2), (2-8), (1-$d_5$) and (1-$e_5$). Further, the signal processing section 20 determines the first subpixel output signal values $X_{1-(p,q)-1}$ and $X_{1-(p,q)-2}$, second subpixel output signal values $X_{2-(p,q)-1}$ and $X_{2-(p,q)-2}$ and third subpixel output signal value $X_{3-(p,q)-1}$ to the (p,q)th pixel group $PG_{(p,q)}$ in accordance with the expressions (3-A), (3-B), (3-C), (3-D), (3-a), (3-d) and (3-e), respectively.

Also in the driving method for an image display apparatus assembly of the working example 10, the output signal values $X_{1-(p,q)-2}$, $X_{2-(p,q)-2}$, $X_{1-(p,q)-1}$, $X_{2-(p,q)-1}$, and $X_{3-(p,q)-1}$ of the (p,q)th pixel group $PG_{(p,q)}$ are in a form expanded to $\alpha_0$ times. Therefore, in order to obtain a luminance of an image equal to the luminance of an image which is not in an expanded state, the luminance of the planar light source apparatus 50 may be reduced based on the expansion coefficient $\alpha_0$. In particular, the luminance of the planar light source apparatus 50 may be reduced to $1/\alpha_0$ time. As a result, reduction of the power consumption of the planar light source apparatus can be anticipated.

Besides, the fourth subpixel output signal to the (p,q)th second pixel is determined based on input signals to the (p,q)th second pixel and input signals to an adjacent pixel positioned adjacent the (p,q)th second pixel along the second direction. In other words, the fourth subpixel output signal to the second pixel which configures a certain pixel group is determined based not only on the input signals to the second pixel which configures the certain pixel group but also on the input signals to the adjacent pixel adjacent the second pixel. Therefore, further optimization of the output signal to the fourth subpixel is achieved. Besides, since one fourth subpixel is disposed for each pixel group configured from a first pixel and a second pixel, reduction of the area of the opening region for the subpixels can be suppressed. As a result, increase of the luminance can be achieved with certainty and enhancement of the display quality can be anticipated.

It is to be noted that, in each pixel group, ratios of the output signal values in the first and second pixels:

$X_{1-(p,q)-2}:X_{2-(p,q)-2}$;

$X_{1-(p,q)-1}:X_{2-(p,q)-1}:X_{3-(p,q)-1}$;

are different a little from ratios of the input signal values:

$x_{1-(p,q)-2}:x_{2-(p,q)-2}$ $x_{1-(p,q)-1}:x_{2-(p,q)-1}:x_{3-(p,q)-1}$;

Therefore, where the pixels are viewed individually, although color tones regarding the pixels are sometimes different a little from each other with respect to the input signal, where the pixels are viewed as pixel groups, no problem occurs with the color tone of each pixel group.

If the relationship between the fourth subpixel control first signal value $SG_{1-(p,q)}$ and the fourth subpixel control second signal value $SG_{2-(p,q)}$ comes to dissatisfy a certain condition, then the adjacent pixel may be changed. In particular, in the case where the adjacent pixel is the (p,q−1)th pixel, the adjacent pixel may be changed to the (p,q+1)th pixel or may be changed to both of the (p,q−1)th pixel and the (p,q+1)th pixel.

Or, if the relationship between the fourth subpixel control first signal value $SG_{1-(p,q)}$ and the fourth subpixel control second signal value $SG_{2-(p,q)}$ comes to dissatisfy a certain condition, for example, if the value of $|SG_{1-(p,q)}-SG_{2-(p,q)}|$ becomes higher or lower than a predetermined value $\Delta X_1$, then a value based only on the fourth subpixel control first signal value $SG_{1-(p,q)}$ or only on the fourth subpixel control second signal value $SG_{2-(p,q)}$ may be adopted as the value of the fourth subpixel output signal value $X_{4-(p,q)}$ to which the embodiments are to be applied. Or, if the value of $|SG_{1-(p,q)}-SG_{2-(p,q)}|$ becomes higher than another predetermined value $\Delta X_2$ or if the value of $|SG_{1-(p,q)}-SG_{2-(p,q)}|$ becomes lower than a further predetermined value $\Delta X_3$, then such an operation as to carry out a process different from that in the working example 10 may be executed.

Figure 23:
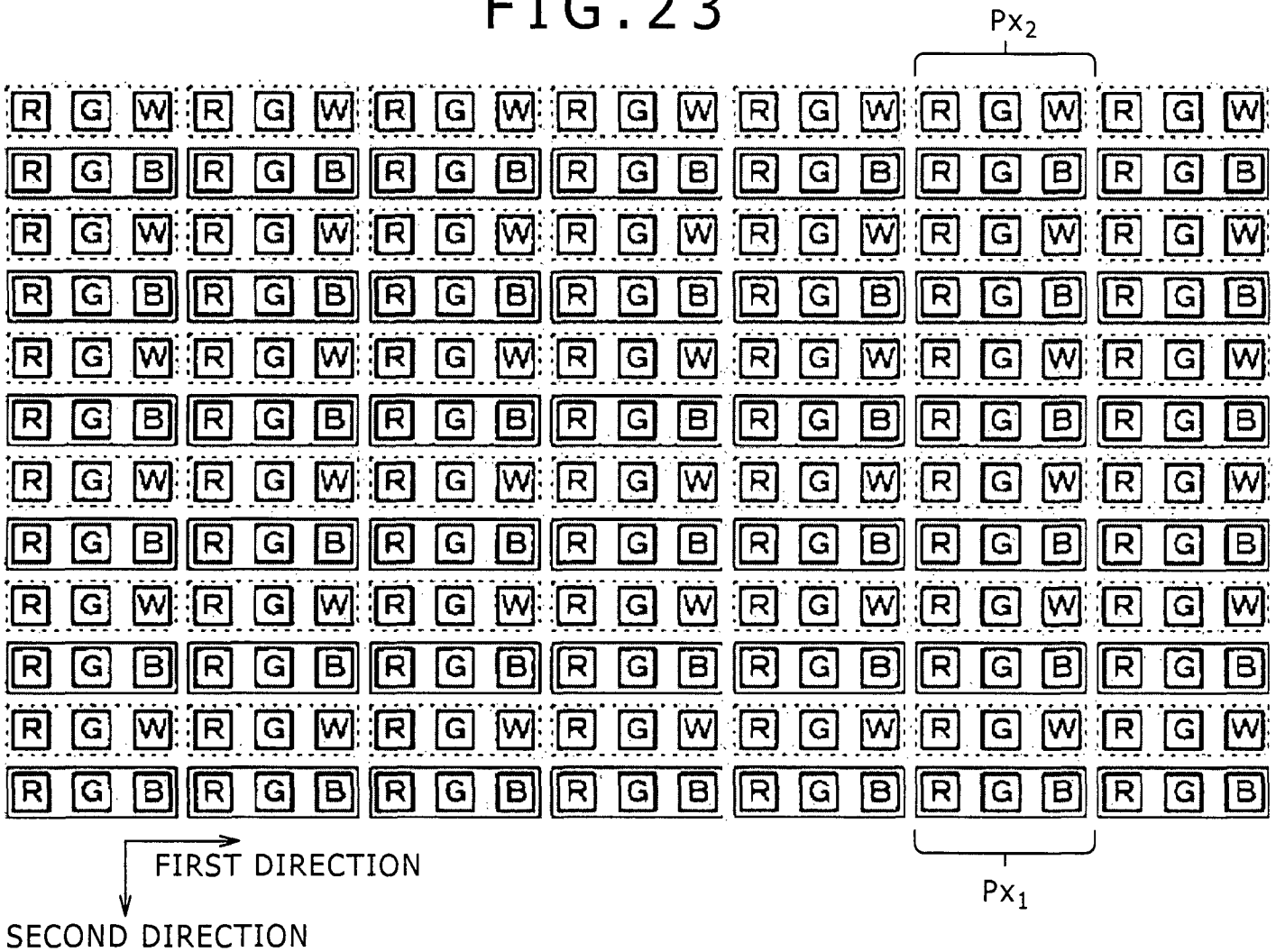
FIG. 23 is a diagrammatic view schematically showing a different example of arrangement of pixels and pixel groups in the image display apparatus of the working example 10.

As occasion derriands, the array of pixel groups described hereinabove in connection with the working example 10 may be modified in the following manner to substantially execute the driving method for an image display apparatus and the driving method for an image display apparatus assembly described in connection with the working example 10. In particular, there may be adopted a driving method for an image display apparatus which includes, as shown in FIG. 23, an image display panel wherein totaling P×Q pixels are arrayed in a two-dimensional matrix including P pixels arrayed in a first direction and Q pixels arrayed in a second direction, and a signal processing section, the image display panel being configured from first pixel columns each including first pixels arrayed along a first direction and second pixel columns disposed adjacent and alternately with the first pixel columns and each including second pixels along the first direction, each of the first pixels being formed from a first subpixel R for displaying a first primary color, a second subpixel G for displaying a second primary color and a third subpixel B for displaying a third primary color, each of the second pixels being formed from a first subpixel R for displaying the first primary color, a second subpixel G for displaying the second primary color and a fourth subpixel W for displaying a fourth primary color, the signal processing section being capable of determining a first subpixel output signal to the first pixel at least based on a first subpixel input signal to the first pixel and an expansion coefficient $\alpha_0$ and outputting the first subpixel output signal to the first subpixel R of the first pixel, determining a second subpixel output signal to the first pixel at least based on a second subpixel input signal to the first pixel and the expansion coefficient $\alpha_0$ and outputting the second subpixel output signal to the second subpixel G of the first pixel, determining a first subpixel output signal to the second pixel at least based on a first subpixel input signal to the second pixel and the expansion coefficient $\alpha_0$ and outputting the first subpixel output signal to the first subpixel R of the second pixel, and determining a second subpixel output signal to the second pixel at least based on a second subpixel input signal to the second pixel and the expansion coefficient $\alpha_0$ and outputting the second subpixel output signal to the second subpixel G of the second pixel, the driving method being carried out by the signal processing section and including:

determining a fourth subpixel output signal based on a fourth subpixel control second signal determined from the first subpixel input signal and second subpixel input signal and a third subpixel input signal to the second pixel of a (p,q)th second pixel where p=1, 2 . . . , P and q=1, 2 . . . , Q when the pixels are counted along the second direction and a fourth subpixel control first signal determined from a first subpixel input signal, a second subpixel input signal and a third subpixel input signal to a first pixel positioned adjacent the (p,q)th second pixel along the second direction and outputting the determined fourth subpixel output signal to the (p,q)th second pixel, and determining a third subpixel output signal at least based on a third subpixel input signal to the (p,q)th second pixel and a third subpixel input signal to the first pixel positioned adjacent the (p,q)th second pixel and outputting the determined third subpixel output signal to the (p,q)th first pixel.

While several preferred working examples are described above, the disclosed technology is not limited to the embodiments. The configuration and structure of the color liquid crystal display apparatus assemblies, color liquid crystal display apparatus, planar light source apparatus, planar light source units and drive circuits described hereinabove in connection with the working example are merely illustrative, and also the members, materials and so forth which configure them are merely illustrative. Thus, all of them can be altered suitably.

In the working examples described above, the plural pixels or the plural sets of a first subpixel R, a second subpixel G and a third subpixel B, with regard to which the saturation S and the brightness V(S) are to be determined are all of P×Q pixels or all of sets of a first subpixel R, a second subpixel G and a third subpixel B or all of $P_0 \times Q_0$ pixel groups. However, such plural pixels or sets of pixels are not limited to them. In particular, the plural pixels or the plural sets of a first subpixel R, a second subpixel G and a third subpixel B, with regard to which the saturation S and the brightness V(S) are to be determined, may be, for example, one for every four pixels or pixel sets or for every eight pixels or pixel sets.

While, in the working example 1, the expansion coefficient $\alpha_0$ is determined based on the first, second and third subpixel input signals and so forth, it may be determined alternatively based on one of the first, second and third subpixel input signals or on one of subpixel input signals to a set of a first subpixel R, a second subpixel G and third subpixel B or else on one of the first, second and third input signals. In particular, as an input signal value of such one input signal, for example, the input signal value $x_{2-(p,q)}$ can be applied. Then, the signal value $X_{4-(p,q)}$ and signal values $X_{1-(p,q)}$, $X_{2-(p,q)}$ and $X_{3-(p,q)}$ may be determined from the determined expansion coefficient $\alpha_0$ similarly as in the working examples. It is to be noted that, in this instance, in place of $S_{(p,q)}$ and $V(S)_{(p,q)}$ in the expressions (12-1) and (12-2), "1" may be used as the value of $S_{(p,q)}$, or in other words, $x_{2-(p,q)}$ may be used as the value of $Max_{(p,q)}$ in the expression (12-1) while $Min_{(p,q)}$ is set to $Min_{(p,q)}=0$, and $x_{2-(p,q)}$ may be used as the value of $V(S)_{(p,q)}$. Similarly, the expansion coefficient $\alpha_0$ may be determined based on input signal values of two ones of the first, second and third subpixel input signals or on two ones from among subpixel input signals to a set of a first subpixel R, a second subpixel G and a third subpixel B or else on two ones from among the first, second and third input signals. In particular, as input signal values of such input signals, for example, the input signal value $x_{1-(p,q)}$ for red and the input signal value $x_{2-(p,q)}$ for green may be applied. Then, from the determined expansion coefficient $\alpha_0$, the signal value $X_{4-(p,q)}$, and signal values $X_{1-(p,q)}$, $X_{2-(p,q)}$ and $X_{3-(p,q)}$, may be determined similarly as in the working examples. It is to be noted that, in this instance, in place of $S_{(p,q)}$ and $V(S)_{(p,q)}$ in the expressions (12-1) and (12-2), as the values of $S_{(p,q)}$ and $VS_{(p,q)}$, in the case where $x_{1-(p,q)} \geq x_{2-(p,q)}$, $$S_{(p,q)}=(x_{1-(p,q)}-x_{2-(p,q)})/x_{1-(p,q)}$$

$$V(S)_{(p,q)}=x_{1-(p,q)}$$

may be used, but in the case where $x_{1-(p,q)}<x_{2-(p,q)}$, $$S_{(p,q)}=(x_{2-(p,q)}-x_{1-(p,q)})/x_{2-(p,q)}$$

$$V(S)_{(p,q)}=x_{2-(p,q)}$$

may be used. For example, in the case where an image of a single color is displayed on a color image display apparatus, it is sufficient to carry out such an expansion process as just described. This similarly applies also to the other working examples.

Further, in place of executing such a series of steps as the steps (a), (b) and (c), such a process as to

[1] determine a maximum value $V_{max}(S)$ of the brightness by means of the signal processing section taking the saturation S in an HSV color space expanded by addition of a fourth color as a variable,

[2] determine the saturation S and the brightness V(S) of a plurality of pixels based on subpixel input signal values to the plural pixels by means of the signal processing section, and

[3] determine the expansion coefficient $\alpha_0$ so that the ratio of those pixels with regard to which the value of the expanded luminance determined from the product of the brightness V(S) and the expansion coefficient $\alpha_0$ exceeds the maximum value $V_{max}(S)$ to all pixels may be equal to or lower than a predetermined value $\beta_0$ may be executed.

It is to be noted that the predetermined value $\beta_0$ may be 0.003 to 0.05. In other words, such a mode that the expansion coefficient $\alpha_0$ is determined so that the ratio of those pixels with regard to which the value of the expanded brightness determined from the product of the brightness V(S) and the expansion coefficient $\alpha_0$ exceeds the maximum value $V_{max}(S)$ to all pixels is equal to or higher than 0.3% but equal to or lower than 5%. In this manner, the maximum value $V_{max}(S)$ of the brightness taking the saturation S as a variable is determined, and the saturation S and the brightness V(S) of a plurality of pixels are determined based on subpixel input signal values to the plural pixels, and then the expansion coefficient $\alpha_0$ is determined so that the ratio of those pixels with regard to which the value of the expanded luminance determined from the product of the luminance V(S) and the expansion coefficient $\alpha_0$ exceeds the maximum value $V_{max}(S)$ of the brightness is equal to or lower than the predetermined value $\beta_0$. Accordingly, optimization of the output signals to the subpixels can be achieved, and appearance of such a phenomenon that an unnatural image in that so-called "gradation collapse" stands out is displayed can be prevented. Meanwhile, increase of the luminance can be achieved with certainty, and reduction of the power consumption of the entire image display apparatus assembly in which the image display apparatus is incorporated.

Further, in place of executing such a series of steps as the steps (a), (b) and (c), such a mode may be adopted that, where the luminance of an aggregate of first, second and third subpixels which configure a pixel in the first or second embodiment or a pixel group in the third, fourth or fifth embodiment when a signal having a value corresponding to a maximum signal value of a first subpixel output signal is input to the first subpixel and a signal having a value corresponding to a maximum signal value of a second subpixel output signal is input to the second subpixel and besides a signal having a value corresponding to a maximum signal value of a third subpixel output signal is input to the third subpixel is represented by $BN_{1-3}$ and the luminance of a fourth subpixel when a signal having a value corresponding to a maximum signal value of a fourth subpixel output signal is input to a fourth subpixel which configures the pixel in the first or second embodiment or the pixel group in the third, fourth or fifth embodiment is represented by $BN_4$, $$\alpha_0=BN_4/BN_{1-3}+1$$

is satisfied. It is to be noted that, in a broad sense, such a mode that the expansion coefficient $\alpha_0$ is given by a function of $BN_4/BN_{1-3}$ can be adopted. By setting the expansion coefficient $\alpha_0$ to $$\alpha_0=BN_4/BN_{1-3}+1$$

in this manner, appearance of a phenomenon that an image unnatural in that so-called "gradation collapse" stands out is displayed can be prevented, and increase of the luminance of can be achieved with certainty. Thus, reduction of the power consumption of the entire image display apparatus assembly in which the image display apparatus is incorporated can be achieved.

Further, in place of executing such a series of steps as the steps (a), (b) and (c), such a mode can be adopted that, assuming that a color defined by (R, G, B) is displayed by a pixel, when the ratio of those pixels with regard to which the hue H and the saturation S in the HSV color space fall within ranges defined by the following expressions $$40 \le H \le 65$$

$$0.5 \le S \le 1.0$$

to all pixels exceeds a predetermined value $\beta'_0$ which may particularly be 2%, the expansion coefficient $\alpha_0$ is set to a value equal to or lower than a predetermined value $\alpha'_0$, particularly equal to or lower than 1.3. It is to be noted that the lower limit value to the expansion coefficient $\alpha_0$ is 1.0. This similarly applies also to the description given below. Here, when the value of R among (R, G, B) is in the maximum, $$H=60(G-B)/(\text{Max}-\text{Min})$$

but when the value of G is in the maximum, $$H=60(B-R)/(\text{Max}-\text{Min})+120$$

but when the value of B is in the maximum, $$H=60(R-G)/(\text{Max}-\text{Min})+240$$

and $$S=(\text{Max}-\text{Min})/\text{Max}$$

In this manner, when the ratio of those pixels with regard to which the hue H and the saturation S in the HSV color space fall within predetermined ranges exceeds the predetermined value $\beta'_0$, particularly 2%, or in other words, when yellow is included much as a color in an image, the expansion coefficient $\alpha_0$ is set to a value equal to or lower than the predetermined value $\alpha'_0$, particularly equal to or lower than 1.3. Consequently, even in the case where yellow is included much as a color in an image, optimization of the output signals to the subpixels can be achieved. Thus, appearance of an unnatural image can be prevented and increase of the luminance can be achieved with certainty, and reduction of the power consumption of the entire image display apparatus assembly in which the image display apparatus is incorporated can be achieved.

Further, in place of executing such a series of steps as the steps (a), (b) and (c), such a mode can be adopted that, assuming that a color defined by (R, G, B) is displayed by a pixel, when the ratio of those pixels with regard to which (R, G, B) fall within ranges defined by the expressions given below to all pixels exceeds the predetermined value $\beta'_0$ which may particularly be 2%, the expansion coefficient $\alpha_0$ is set to a value equal to or lower than the predetermined value $\alpha'_0$, particularly equal to or lower than 1.3. The expressions mentioned above are, when the value of R among (R, G, B) is in the maximum and the value of B is in the minimum, $$R \ge 0.78\times(2^n-1)$$

$$G \ge 2R/3+B/3$$

$$B \le 0.50R$$

but are, when the value of G among (R, G, B) is in the maximum and the value of B is in the minimum, $$R \ge 4B/60+56G/60$$

$$G \ge 0.78\times(2^n-1)$$

$$B \le 0.50R$$

where n is a display gradation bit number. When the ratio of those pixels with regard to which (R, G, B) have particular values in this manner to all pixels exceeds the predetermined value $\beta'_0$ which may particularly 2%, or in other words, when yellow exists much as a color in an image, the expansion coefficient $\alpha_0$ is set to a value equal to or lower than the predetermined value $\alpha'_0$, particularly equal to or lower than 1.3. Also by this, even in the case where yellow is included much as a color in an image, optimization of output signals to the subpixels can be achieved and appearance of an unnatural image can be prevented while increase of the luminance can be achieved with certainty. Thus, reduction of the power consumption of the entire image display apparatus assembly in which the image display apparatus is incorporated can be achieved. Besides, whether or not yellow is included much as a color in an image can be decided by a comparatively small amount of determination, and the circuit scale of the signal processing section can be reduced and reduction of the determination time can be achieved.

Further, in place of executing such a series of steps as the steps (a), (b) and (c), such a mode can be adopted that, when the ratio of those pixels which display yellow to all pixels exceeds a predetermined value $\beta'_0$, particularly 2%, the expansion coefficient $\alpha_0$ is set to a value equal to or lower than a predetermined value, for example, equal to or lower than 1.3. When the ratio of those pixels which display yellow to all pixels exceeds the predetermined value $\beta'_0$, particularly 2%, the expansion coefficient $\alpha_0$ is set to a value equal to or lower than the predetermined value, for example, equal to or lower than 1.3. Also by this countermeasure, optimization of the output signals to the subpixels can be achieved, and appearance of an unnatural image can be prevented while increase of the luminance can be achieved with certainty. Thus, reduction of the power consumption of the entire image display apparatus assembly in which the image display apparatus is incorporated can be achieved.

Further, in place of executing such a series of steps as the steps (a), (b) and (c), such steps as

[1] to determine a maximum value $V_{max}(S)$ of the brightness using the saturation S in an HSV color space expanded by adding a fourth color as a variable by means of the signal processing section and further determine the reference expansion coefficient $\alpha_{0\text{-}std}$ based on the maximum value $V_{max}(S)$ by means of the signal processing section, and

[2] to determine the expansion coefficient $\alpha_0$ of each pixel from the reference expansion coefficient $\alpha_{0p\text{-}std}$, input signal correction coefficients based on subpixel input signal values of the pixel and an external light intensity correction coefficient based on the intensity of external light may be executed. By the steps, the maximum value $V_{max}(S)$ of the brightness using the saturation S as a variable is determined, and the reference expansion coefficient $\alpha_{0\text{-}std}$ is determined such that the ratio of those pixels with regard to which the value of the expanded brightness determined from the product of the brightness V(S) and the standard expansion coefficient $\alpha_{0\text{-}std}$ of each pixel exceeds the maximum value $V_{max}(S)$ to all pixels becomes equal to or lower than the predetermined value $\beta_0$. Accordingly, optimization of the output signals to the subpixels can be achieved, and appearance of such a phenomenon that an unnatural image in that so-called "gradation collapse" stands out is displayed can be prevented. Meanwhile, increase of the luminance can be achieved with certainty, and reduction of the power consumption of the entire image display apparatus assembly in which the image display apparatus is incorporated can be achieved.

Or, in place of executing such a series of steps as the steps (a), (b) and (c), such steps as

[1] to determine, where the luminance of an aggregate of first, second and third subpixels which configure a pixel in the first or second embodiment or a pixel group in the third, fourth or fifth embodiment when a signal having a value corresponding to a maximum signal value of a first subpixel output signal is input to the first subpixel and a signal having a value corresponding to a maximum signal value of a second subpixel output signal is input to the second subpixel and besides a signal having a value corresponding to a maximum signal value of a third subpixel output signal is input to the third subpixel is represented by $BN_{1\text{-}3}$ and the luminance of a fourth subpixel when a signal having a value corresponding to a maximum signal value of a fourth subpixel output signal is input to a fourth subpixel which configures the pixel in the first or second embodiment or the pixel group in the third, fourth or fifth embodiment is represented by $BN_4$, the reference expansion coefficient $\alpha_{0\text{-}std}$ in accordance with the following expression $$\alpha_{0\text{-}std}=BN_4/BN_{1\text{-}3}+1$$

and

[2] to determine the expansion coefficient $\alpha_0$ of each pixel from the reference expansion coefficient $\alpha_{0\text{-}std}$, the input signal correction coefficient based on the subpixel input signal values to the pixels and an external light intensity correction coefficient based on the intensity of external light may be executed. It is to be noted that, in a broad sense, such a mode that the reference expansion coefficient $\alpha_{0\text{-}std}$ is given by a function of $BN_4/BN_{1\text{-}3}$ can be adopted. By defining the reference expansion coefficient $\alpha_{0\text{-}std}$ as $$\alpha_{0\text{-}std}=BN_4/BN_{1\text{-}3}+1$$

in this manner, appearance of a phenomenon that an image unnatural in that so-called "gradation collapse" stands out is displayed can be prevented, and increase of the luminance can be achieved with certainty. Thus, reduction of the power consumption of the entire image display apparatus assembly in which the image display apparatus is incorporated can be achieved.

Or, in place of executing such a series of steps as the steps (a), (b) and (c), such steps as

[1] to determine, when a color defined by (R, G, B) is displayed by a pixel and the hue H and the saturation S in an HSV color space are defined by the following expressions $$40 \le H \le 65$$

$$0.5 \le S \le 1.0$$

and then the ratio of those pixels with regard to which the hue H and the saturation S fall within the ranges given above to all pixels exceeds the predetermined value $\beta'_0$, for example, 2%, to determine the reference expansion coefficient $\alpha_{0\text{-}std}$ as a value equal to or lower than the predetermined value $\alpha'_{0\text{-}std}$, particularly equal to or lower than 1.3 and

[2] to determine the expansion coefficient $\alpha_0$ of each pixel from the reference expansion coefficient $\alpha_{0\text{-}std}$, the input signal correction coefficient based on the subpixel input signal values to the pixels and an external light intensity correction coefficient based on the intensity of external light may be executed. It is to be noted that the lower limit value to the reference expansion coefficient $\alpha_{0\text{-}std}$ is 1.0. This similarly applies also to the description given below. Here, when the value of R among (R, G, B) is in the maximum, $$H=60(G-B)/(\text{Max}-\text{Min})$$

but when the value of G is in the maximum, $$H=60(B-R)/(\text{Max}-\text{Min})+120$$

but when the value of B is in the maximum, $$H=60(R-G)/(\text{Max}-\text{Min})+240$$

and $$S=(\text{Max}-\text{Min})/\text{Max}$$

Further,

Max: a maximum value of three subpixel input signal values including the first, second and third subpixel input signal values to the pixel Min: a minimum value of three subpixel input signal values including the first, second and third subpixel input signal values to the pixel From various examinations, it has been found that, in the case where yellow is included much as a color in an image, if the reference expansion coefficient $\alpha_{0\text{-}std}$ exceeds a predetermined value $\alpha'_{0\text{-}std}$ which may be, for example, $\alpha'_{0\text{-}std}=1.3$, then the image exhibits an unnatural color. However, if the ratio of those pixels with regard to which the hue H and the saturation S in an HSV color space fall within predetermined ranges to all pixels exceeds the predetermined value $\beta'_0$, particularly 2%, or in other words, if yellow is included much as a color in an image, then the reference expansion coefficient $\alpha_{0\text{-}std}$ is set to a value equal to or lower than the predetermined value $\alpha'_{0\text{-}std}$, particularly equal to or lower than 1.3. By this, even in the case where yellow is included much as a color in an image, optimization of output signals to the subpixels can be achieved and appearance of an unnatural image can be prevented while increase of the luminance can be achieved with certainty. Thus, reduction of the power consumption of the entire image display apparatus assembly in which the image display apparatus is incorporated can be achieved.

Or, in place of executing such a series of steps as the steps (a), (b) and (c), such steps as

[1] to determine, when a color defined by (R, G, B) is displayed by a pixel and the ratio of those pixels whose (R, G, B) satisfy the expressions given below to all pixels exceeds the predetermined value $\beta'_0$, particularly 2%, the reference expansion coefficient $\alpha_{0\text{-}std}$ to a value equal to or lower than a predetermined value $\alpha'_{0\text{-}std}$, particular, for example, equal to or lower than 1.3, and

[2] to determine the expansion coefficient $\alpha_0$ of each pixel from the reference expansion coefficient $\alpha_{0\text{-}std}$, the input signal correction coefficient based on the subpixel input signal values to the pixel and an external light intensity correction coefficient based on the intensity of external light may be executed. The expressions mentioned above are, when the value of R among (R, G, B) is in the maximum and the value of B is in the minimum, $$R \geq 0.78 \times (2^n - 1)$$

$$G \geq 2R/3 + B/3$$

$$B \leq 0.50R$$

but are, when the value of G among (R, G, B) is in the maximum and the value of B is in the minimum, $$R \geq 4B/60 + 56G/60$$

$$G \geq 0.78 \times (2^n - 1)$$

$$B \leq 0.50R$$

where n is a display gradation bit number. When the ratio of those pixels with regard to which (R, G, B) have particular values in this manner to all pixels exceeds the predetermined value $\beta'_0$ which may particularly 2%, or in other words, when yellow exists much as a color in an image, the reference expansion coefficient $\alpha_{0\text{-}std}$ is set to a value equal to or lower than the predetermined value $\alpha'_{0\text{-}std}$, particularly equal to or lower than 1.3. Also by this, even in the case where yellow is included much as a color in an image, optimization of output signals to the subpixels can be achieved and appearance of an unnatural image can be prevented while increase of the luminance can be achieved with certainty. Thus, reduction of the power consumption of the entire image display apparatus assembly in which the image display apparatus is incorporated can be achieved. Besides, whether or not yellow is included much as a color in an image can be decided by a comparatively small amount of determination, and the circuit scale of the signal processing section can be reduced and reduction of the determination time can be achieved.

Or, in place of executing such a series of steps as the steps (a), (b) and (c), such steps as

[1] to determine, when the ration of those pixels which display yellow to all pixels exceeds the predetermined value $\beta'_0$, particularly 2%, the reference expansion coefficient $\alpha_{0\text{-}std}$ to a value equal to or lower than a predetermined value, particularly equal to or lower than 1.3, and

[2] to determine the expansion coefficient $\alpha_0$ of each pixel from the reference expansion coefficient $\alpha_{0\text{-}std}$, the input signal correction coefficient based on the subpixel input signal values to the pixel and an external light intensity correction coefficient based on the intensity of external light may be executed. In this manner, when the ratio of those pixels which display yellow to all pixels exceeds the predetermined value $\beta'_0$, particularly 2%, the reference expansion coefficient $\alpha_{0\text{-}std}$ is set to a value equal to or lower than the predetermined value, particularly equal to or lower than 1.3. Also by this, optimization of output signals to the subpixels can be achieved and appearance of an unnatural image can be prevented while increase of the luminance can be achieved with certainty. Thus, reduction of the power consumption of the entire image display apparatus assembly in which the image display apparatus is incorporated can be achieved.

Figure 25:
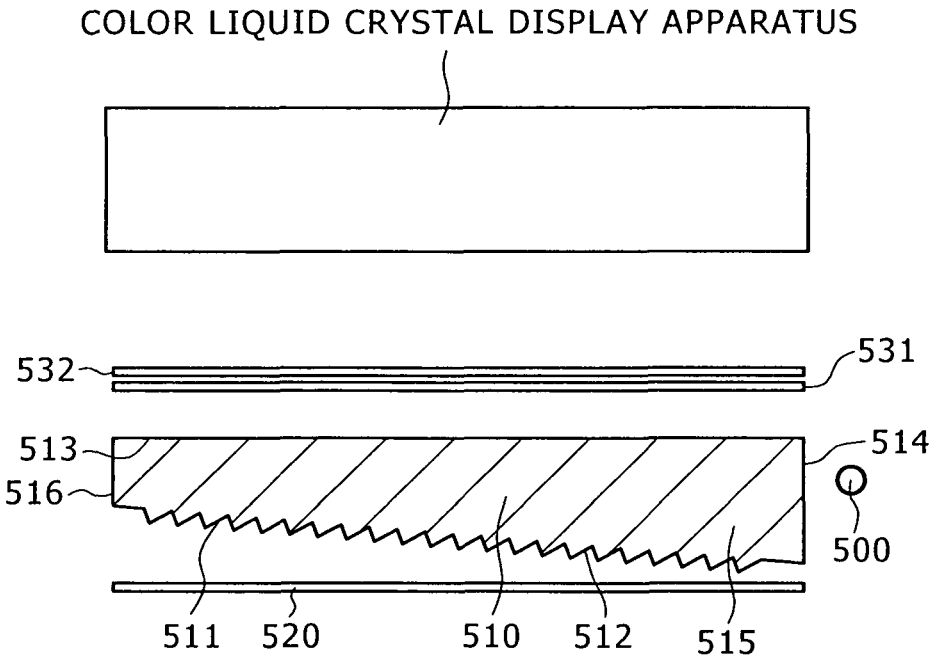
FIG. 25 is a view schematically showing a planar light source apparatus of the edge light or side light type.

Also it is possible to adopt a planar light source apparatus of the edge light type, that is, of the side light type. In this instance, as seen in FIG. 25, a light guide plate 510 formed, for example, from a polycarbonate resin has a first face 511 which is a bottom face, a second face 513 which is a top face opposing to the first face 511, a first side face 514, a second side face 515, a third side face 516 opposing to the first side face 514, and a fourth side face opposing to the second side face 515. A more particular shape of the light guide plate 510 is a generally wedge-shaped truncated quadrangular pyramid shape, and two opposing side faces of the truncated quadrangular pyramid correspond to the first face 511 and the second face 513 while the bottom face of the truncated quadrangular pyramid corresponds to the first side face 514. Further, the first side face 511 is provided on a surface portion with recessed and projected portions 512. The cross sectional shape of continuous recessed and projected portions when the light guide plate 510 is cut along a virtual plane perpendicular to the first face 511 in a first primary color light incoming direction to the light guide plate 510 is a triangular shape. In other words, recessed and projected portions 512 provided on the surface portion of the first face 511 have a prism shape. The second face 513 of the light guide plate 510 may be smooth, that is, may be formed as a mirror face, or may have blast embosses which have a light diffusing effect, that is, may be formed as a fine recessed and projected face. A light reflecting member 520 is disposed in an opposing relationship to the first face 511 of the light guide plate 510. Further, an image display panel such as a color liquid crystal display panel, is disposed in an opposing relationship to the second face 513 of the light guide plate 510. Furthermore, a light diffusing sheet 531 and a prism sheet 532 are disposed between the image display panel and the second face 513 of the light guide plate 510. First primary color light emitted from a light source 500 advances into the light guide plate 510 through the first side face 514, which is a face corresponding to the bottom face of the truncated quadrangular pyramid, of the light guide plate 510. Then, the first primary color light comes to and is scattered by the recessed and projected portions 512 of the first face 511 and goes out from the first face 511, whereafter it is reflected by the light reflecting member 520 and advances into the first face 511 again. Thereafter, the first primary color light goes out from the second face 513, passes through the light diffusing sheet 531 and the prism sheet 532 and irradiates the image display panel, for example, of the various working examples.

As the light source, a fluorescent lamp or a semiconductor laser which emits blue light as the first primary color light may be adopted. In this instance, the wavelength $\lambda_1$ of the first primary color light which corresponds to the first primary color, which is blue, to be emitted from the fluorescent lamp or the semiconductor laser may be, for example, 450 nm. Meanwhile, green light emitting particles which correspond to second primary color light emitting particles which are excited by the fluorescent lamp or the semiconductor laser may be, for example, green light emitting phosphor particles made of, for example, $SrGa_2S_4$:Eu. Further, red light emitting particles which correspond to third primary color light emitting particles may be red light emitting phosphor particles made of, for example, CaS:Eu. Or else, where a semiconductor laser is used, the wavelength $\lambda_1$ of the first primary color light which corresponds to the first primary color, that is blue, which is emitted by the semiconductor laser, may be, for example, 457 nm. In this instance, green light emitting particles which correspond to second primary color light emitting particles which are excited by the semiconductor laser may be green light emitting phosphor particles made of, for example, $SrGs_2S_4$:Eu, and red light emitting particles which correspond to third primary color light emitting particles may be red color light emitting phosphor particles made of, for example, CaS:Eu. Or else, it is possible to use, as the light source of the planar light source apparatus, a fluorescent lamp (CCFL) of the cold cathode type, a fluorescent lamp (HCFL) of the hot cathode type or a fluorescent lamp of the external electrode type (EEFL, External Electrode Fluorescent Lamp).

The present disclosure contains subject matter related to that disclosed in Japanese Priority Patent Application JP 2010-195430 filed in the Japan Patent Office on Sep. 1, 2010, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A driving method for an image display apparatus which includes (A) an image display panel wherein pixels each including a first subpixel for displaying a first primary color, a second subpixel for displaying a second primary color, a third subpixel for displaying a third primary color and a fourth subpixel for displaying a fourth color are arrayed in a two-dimensional matrix; and (B) a signal processing section;

the signal processing section being capable of determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal at least based on a third subpixel input signal and the expansion coefficient $\alpha_0$ and outputting the third subpixel output signal to the third subpixel;

the driving method being carried out by the signal processing section and comprising:

(a) determining a maximum value $V_{max}(S)$ of brightness taking a saturation S in an HSV color space enlarged by adding the fourth color as a variable, HSV of the HSV color space standing for hue, saturation and brightness value;

(b) determining the saturation S and the brightness V(S) of a plurality of pixels based on subpixel input signal values to the plural pixels;

(c) determining the expansion coefficient $\alpha_0$ based on at least one of values of $V_{max}(S)/V(S)$ determined with regard to the plural pixels;

(d) for each of the pixels determining a first correction signal value based on the expansion coefficient $\alpha_o$, the first subpixel input signal and a first constant;

determining a second correction signal value based on the expansion coefficient $\alpha_0$, the second subpixel input signal and a second constant;

determining a third correction signal value based on the expansion coefficient $\alpha_0$, the third subpixel input signal and a third constant;

determining a correction signal value having a maximum value from among the first, second and third correction signal values as a fourth correction signal value; and determining a fifth correction signal value based on the expansion coefficient $\alpha_0$ and a minimum value from among the first subpixel input signal, the second subpixel input signal and the third subpixel input signal; and (e) determining, for each of the pixels, a fourth subpixel output signal from the fourth and fifth correction signal values and outputting the determined signal to the fourth subpixel.

2. The driving method for an image display apparatus according to claim 1, wherein the first constant is determined as a maximum value capable of being taken by the first subpixel and the second constant is determined as a maximum value capable of being taken by the second subpixel input signal while the third constant is determined as a maximum value capable of being taken by the third subpixel;

the first correction signal value being determined by subtracting the first constant from the product of the expansion coefficient $\alpha_0$ and the first subpixel input signal input signal;

the second correction signal value being determined by subtracting the second constant from the product of the expansion coefficient $\alpha_0$ and the second subpixel input signal;

the third correction signal value being determined by subtracting the third constant from the product of the expansion coefficient $\alpha_0$ and the third subpixel input signal.

3. The driving method for an image display apparatus according to claim 1, wherein a correction signal value having a lower value from between the fourth and fifth correction signal values is determined as the fourth subpixel output signal.

4. The driving method for an image display apparatus according to claim 1, wherein an average value of the fourth and fifth correction signal values is determined as the fourth subpixel output signal.

5. A driving method for an image display apparatus which includes (A) an image display panel wherein totaling $P_0$ x $Q_0$ pixels are arrayed in a two-dimensional matrix including $P_0$ pixels arrayed in a first direction and $Q_0$ pixels arrayed in a second direction; and (B) a signal processing section;

each of the pixels including a first subpixel for displaying a first primary color, a second subpixel for displaying a second primary color, a third subpixel for displaying a third primary color and a fourth subpixel for displaying a fourth color;

the signal processing section being capable of:

determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal at least based on a third subpixel input signal and the expansion coefficient $\alpha_0$ and outputting the third subpixel output signal to the third subpixel;

the driving method being carried out by the signal processing section and comprising:

(a) determining a maximum value $V_{max}(S)$ of brightness taking a saturation S in an HSV color space enlarged by adding the fourth color as a variable, HSV of the HSV color space standing for hue, saturation and brightness value;

(b) determining the saturation S and the brightness V(S) of a plurality of pixels based on subpixel input signal values to the plural pixels;

(c) determining the expansion coefficient $\alpha_0$ based on at least one of values of $V_{max}(S)/V(S)$ determined with regard to the plural pixels;

(d) for a (p,q)th pixel where p =1, 2 ... $P_0$ and q =1, 2 ..., $Q_0$ when the pixels are counted along the second direction, determining a first correction signal value based on the expansion coefficient $\alpha_0$, a first subpixel input signal to the (p,q)th pixel, a first subpixel input signal to an adjacent pixel adjacent to the (p,q)th pixel along the second direction and a first constant;

determining a second correction signal value based on the expansion coefficient $\alpha_0$, a second subpixel input signal to the (p,q)th pixel, a second subpixel input signal to the adjacent pixel and a second constant;

determining a third correction signal value based on the expansion coefficient $\alpha_0$, a third subpixel input signal to the (p,q)th pixel, a third subpixel input signal to the adjacent pixel and a third constant;

determining a correction signal value having a maximum value from among the first, second and third correction signal values as a fourth correction signal value; and determining a fifth correction signal value based on the expansion coefficient $\alpha_0$, a minimum value from among the first subpixel input signal, the second subpixel input signal and the third subpixel input signal to the (p,q)th pixel and a minimum value from among the first subpixel input signal, the second subpixel input signal and the third subpixel input signal to the adjacent pixel; and (e) determining, for the (p,q)th pixel, a fourth subpixel output signal of the (p,q)th pixel from the fourth and fifth correction signal values and outputting the fourth subpixel output signal to the fourth subpixel in the (p,q)th pixel.

6. The driving method for an image display apparatus according to claim 5, wherein the first constant is determined as a maximum value capable of being taken by the first subpixel input signal and the second constant is determined as a maximum value capable of being taken by the second subpixel input signal while the third constant is determined as a maximum value capable of being taken by the third subpixel input signal;

a higher one of a value determined by subtracting the first constant from the product of the expansion coefficient $\alpha_0$ and the first subpixel input signal to the (p,q)th pixel and another value determined by subtracting the first constant from the product of the expansion coefficient $\alpha_0$ and the first subpixel input signal to the adjacent pixel being determined as the first correction signal value;

a higher one of a value determined by subtracting the second constant from the product of the expansion coefficient $\alpha_0$ and the second subpixel input signal to the (p,q)th pixel and another value determined by subtracting the second constant from the product of the expansion coefficient $\alpha_0$ and the second subpixel input signal to the adjacent pixel being determined as the second correction signal value;

a higher one of a value determined by subtracting the third constant from the product of the expansion coefficient $\alpha_0$ and the third subpixel input signal to the (p,q)th pixel and another value determined by subtracting the third constant from the product of the expansion coefficient $\alpha_0$ and the third subpixel input signal to the adjacent pixel being determined as the third correction signal value.

7. The driving method for an image display apparatus according to claim 5, wherein a correction signal value having a lower value from between the fourth and fifth correction signal values is determined as the fourth subpixel output signal.

8. The driving method for an image display apparatus according to claim 5, wherein an average value of the fourth and fifth correction signal values is determined as the fourth subpixel output signal.

9. A driving method for an image processing apparatus which includes (A) an image display panel wherein pixels each including a first subpixel for displaying a first primary color, a second subpixel for displaying a second primary color, and a third subpixel for displaying a third primary color are arrayed in first and second directions in a two-dimensional matrix such that each of pixel groups is configured at least from a first pixel and a second pixel arrayed in the first direction, between which a fourth subpixel for displaying a fourth color is disposed; and (B) a signal processing section;

the signal processing section being capable of regarding the first pixel, determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal at least based on a third subpixel input signal and the expansion coefficient $\alpha_0$ and outputting the third subpixel output signal to the third subpixel; and regarding the second pixel, determining a first subpixel output signal at least based on a first subpixel input signal and the expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal at least based on a third subpixel input signal and the expansion coefficient $\alpha_0$ and outputting the third subpixel output signal to the third subpixel;

the driving method being carried out by the signal processing section and comprising:

(a) determining a maximum value $V_{max}(S)$ of brightness taking a saturation S in an HSV color space enlarged by adding the fourth color as a variable, HSV of the HSV color space standing for hue, saturation and brightness value;

(b) determining the saturation S and the brightness V(S) of a plurality of first pixels and second pixels based on subpixel input signal values to the plural first and second pixels;

(c) determining the expansion coefficient $\alpha_0$ based on at least one of values of $V_{max}(S)/V(S)$ determined with regard to the plural first and second pixels;

(d) for each pixel group, determining a first correction signal value based on the expansion coefficient $\alpha_0$, the first subpixel input signals to the first and second pixels and a first constant;

determining a second correction signal value based on the expansion coefficient $\alpha_0$, the second subpixel input signals to the first and second pixels and a second constant;

determining a third correction signal value based on the expansion coefficient $\alpha_0$, the third subpixel input signals to the first and second pixels and a third constant;

determining a correction signal value having a maximum value from among the first, second and third correction signal values as a fourth correction signal value; and determining a fifth correction signal value based on the expansion coefficient $\alpha_0$, a minimum value from among the first subpixel input signal, the second subpixel input signal and the third subpixel input signal to the first pixel, and a minimum value from among the first subpixel input signal, the second subpixel input signal and the third subpixel input signal to the second pixel; and (e) determining, for each of the pixel groups, a fourth subpixel output signal from the fourth and fifth correction signal values and outputting the fourth subpixel output signal to the fourth subpixel.

10. The driving method for an image display apparatus according to claim 9, wherein the first constant is determined as a maximum value capable of being taken by the first subpixel and the second constant is determined as a maximum value capable of being taken by the second subpixel input signal while the third constant is determined as a maximum value capable of being taken by the third subpixel input signal;

a higher one of a value determined by subtracting the first constant from the product of the expansion coefficient $\alpha_0$ and the first subpixel input signal to the first pixel and another value determined by subtracting the first constant from the product of the expansion coefficient $\alpha_0$ and the first subpixel input signal to the second pixel being determined as the first correction signal value;

a higher one of a value determined by subtracting the second constant from the product of the expansion coefficient $\alpha_0$ and the second subpixel input signal to the first pixel and another value determined by subtracting the second constant from the product of the expansion coefficient $\alpha_0$ and the second subpixel input signal to the second pixel being determined as the second correction signal value;

a higher one of a value determined by subtracting the third constant from the product of the expansion coefficient $\alpha_0$ and the third subpixel input signal to the first pixel and another value determined by subtracting the third constant from the product of the expansion coefficient $\alpha_0$ and the third subpixel input signal to the second pixel being determined as the third correction signal value.

11. The driving method for an image display apparatus according to claim 9, wherein a correction signal value having a lower value from between the fourth and fifth correction signal values is determined as the fourth subpixel output signal.

12. The driving method for an image display apparatus according to claim 9, wherein an average value of the fourth and fifth correction signal values is determined as the fourth subpixel output signal.

13. A driving method for an image display apparatus which includes (A) an image display panel wherein totaling P x Q pixel groups are arrayed in a two-dimensional matrix including P pixel groups arrayed in a first direction and Q pixel groups arrayed in a second direction; and (B) a signal processing section;

each of the pixel groups including a first pixel and a second pixel along the first direction;

the first pixel including a first subpixel for displaying a first primary color, a second subpixel for displaying a second primary color and a third subpixel for displaying a third primary color;

the second pixel including a first subpixel for displaying the first primary color, a second subpixel for displaying the second primary color and a fourth subpixel for displaying a fourth color;

the signal processing section being capable of regarding the first subpixel, determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal to a (p,q)th, where p =1, 2 ... P and q =1, 2 ..., Q, first pixel when the pixels are counted along the first direction at least based on a third subpixel input signal to the (p,q)th first pixel and a third subpixel input signal to a (p,q)th second pixel and outputting the third subpixel output signal to the third subpixel;

regarding the second pixel, determining a first subpixel output signal at least based on a first subpixel input signal and the expansion coefficient $\alpha_0$ and outputting the first subpixel output signal to the first subpixel; and determining a second subpixel output signal at least based on a second subpixel input signal and the expansion coefficient $\alpha_0$ and outputting the second subpixel output signal to the second subpixel;

the driving method being carried out by the signal processing section and comprising:

(a) determining a maximum value $V_{max}(S)$ of brightness taking a saturation S in an HSV color space enlarged by adding the fourth color as a variable, HSV of the HSV color space standing for hue, saturation and brightness value;

(b) determining the saturation S and the brightness V(S) of a plurality of first pixels and second pixels based on subpixel input signal values to the plural first and second pixels;

(c) determining the expansion coefficient $\alpha_0$ based on at least one of values of $V_{max}(S)/V(S)$ determined with regard to the plural first and second pixels;

(d) for the (p,q)th pixel group, determining a first correction signal value based on the expansion coefficient $\alpha_0$, the first subpixel input signal to the second pixel, a first subpixel input signal to an adjacent pixel adjacent to the second pixel along the first direction and a first constant;

determining a second correction signal value based on the expansion coefficient $\alpha_0$, the second subpixel input signal to the second pixel, a second subpixel input signal to the adjacent pixel and a second constant; and determining a third correction signal value based on the expansion coefficient $\alpha_0$, the third subpixel input signal to the second pixel, a third subpixel input signal to the adjacent pixel and a third constant;

determining a correction signal value having a maximum value from among the first, second and third correction signal values as a fourth correction signal value; and determining a fifth correction signal value based on the expansion coefficient $\alpha_0$, first, second and third subpixel input signals to the second pixel and first, second and third subpixel input signals to the adjacent pixel; and (e) determining, for the (p,q)th pixel group, a fourth subpixel output signal from the fourth and fifth correction signal values and outputting the fourth subpixel output signal to the fourth subpixel.

14. A driving method for an image display apparatus which includes (A) an image display panel wherein totaling P x Q pixel groups are arrayed in a two-dimensional matrix including P pixel groups arrayed in a first direction and Q pixel groups arrayed in a second direction; and (B) a signal processing section;

each of the pixel groups including a first pixel and a second pixel along the first direction;

the first pixel including a first subpixel for displaying a first primary color, a second subpixel for displaying a second primary color and a third subpixel for displaying a third primary color;

the second pixel including a first subpixel for displaying the first primary color, a second subpixel for displaying the second primary color and a fourth subpixel for displaying a fourth color;

the signal processing section being capable of regarding the first pixel, determining a first subpixel output signal at least based on a first subpixel input signal and an expansion coefficient $\alpha_0$ and outputting the first subpixel output signal to the first subpixel;

determining a second subpixel output signal at least based on a second subpixel input signal and the expansion coefficient $\alpha_0$ and outputting the second subpixel output signal to the second subpixel; and determining a third subpixel output signal based on a third subpixel input signal to a (p,q)th, where p =1, 2, ..., P and q =1, 2, ..., Q, first pixel when the pixels are counted along the second direction and a third subpixel input signal to a (p,q)th second pixel and outputting the third subpixel output signal to the third subpixel;

regarding the second pixel determining a first subpixel output signal at least based on a first subpixel input signal and the expansion coefficient $\alpha_0$ and outputting the first subpixel output signal to the first subpixel; and determining a second subpixel output signal at least based on a second subpixel input signal and the expansion coefficient $\alpha_0$ and outputting the second subpixel output signal to the second subpixel;

the driving method being carried out by the signal processing section and comprising:

(a) determining a maximum value $V_{max}(S)$ of brightness taking a saturation S in an HSV color space enlarged by adding the fourth color as a variable, HSV of the HSV color space standing for hue, saturation and brightness value;

(b) determining the saturation S and the brightness V(S) of a plurality of first pixels and second pixels based on subpixel input signal values to the plural first and second pixels;

(c) determining the expansion coefficient $\alpha_0$ based on at least one of values of $V_{max}(S)/V(S)$ determined regarding the plural first and second pixels;

(d) for the (p,q)th pixel group, determining a first correction signal value based on the expansion coefficient $\alpha_0$, the first subpixel input signal to the second pixel, a first subpixel input signal to an adjacent pixel adjacent to the second pixel along the second direction and a first constant;

determining a second correction signal value based on the expansion coefficient $\alpha_0$, the second subpixel input signal to the second pixel, a second subpixel input signal to the adjacent pixel and a second constant;

determining a third correction signal value based on the expansion coefficient $\alpha_0$, the third subpixel input signal to the second pixel, a third subpixel input signal to the adjacent pixel and a third constant;

determining a correction signal value having a maximum value from among the first, second and third correction signal values as a fourth correction signal value; and determining a fifth correction signal value based on the expansion coefficient $\alpha_0$, first, second and third subpixel input signals to the first pixel, and first, second and third subpixel input signals to the adjacent pixel; and (e) determining, for the (p,q)th pixel group, a fourth subpixel output signal from the fourth and fifth correction signal values and outputting the fourth subpixel output signal to the fourth subpixel.

* * * * *